US007258171B2

(12) United States Patent
Bourgoyne et al.

(10) Patent No.: US 7,258,171 B2
(45) **Date of Patent: *Aug. 21, 2007**

(54) INTERNAL RISER ROTATING CONTROL HEAD

(75) Inventors: Darryl A. Bourgoyne, Baton Rouge, LA (US); Don M. Hannegan, Fort Smith, AR (US); Thomas F. Bailey, Houston, TX (US); James W. Chambers, Hackett, AR (US); Timothy L. Wilson, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/284,308

(22) Filed: Nov. 21, 2005

(65) Prior Publication Data

US 2006/0102387 A1 May 18, 2006

Related U.S. Application Data

(60) Division of application No. 10/281,534, filed on Oct. 28, 2002, now Pat. No. 7,159,669, which is a continuation-in-part of application No. 09/516,368, filed on Mar. 1, 2000, now Pat. No. 6,470,975.

(60) Provisional application No. 60/122,530, filed on Mar. 2, 1999.

(51) Int. Cl.

| | |
|---|---|
| ***E21B 23/03*** | (2006.01) |
| ***E21B 41/00*** | (2006.01) |
| ***E21B 33/06*** | (2006.01) |

(52) U.S. Cl. ..... 166/382; 166/348; 166/88.2; 166/92.1; 166/85.4; 166/85.5

(58) Field of Classification Search ..... 166/335, 166/338, 348, 365, 367, 368, 377, 378, 379, 166/380, 381, 382, 75.11, 96.1, 88.1, 88.2, 166/92.1, 94.1, 85.1, 85.4, 85.5, 75.13, 75.14
See application file for complete search history.

(56) References Cited

U.S. PATENT DOCUMENTS 517,509 A 4/1894 Williams (Continued)

FOREIGN PATENT DOCUMENTS

AU 199927822 B2 9/1999

(Continued)

OTHER PUBLICATIONS

The Modular T BOP Stack System, Cameron Iron Works © 1985 (5 pages).

(Continued)

*Primary Examiner*—Jennifer H Gay
(74) *Attorney, Agent, or Firm*—Strasburger & Price, LLP

(57) ABSTRACT

A holding member provides for releasably positioning a rotating control head assembly in a subsea housing. The holding member engages an internal formation in the subsea housing to resist movement of the rotating control head assembly relative to the subsea housing. The rotating control head assembly is sealed with the subsea housing when the holding member engages the internal formation. An extendible portion of the holding member assembly extrudes an elastomer between an upper portion and a lower portion of the internal housing to seal the rotating control head assembly with the subsea housing. Pressure relief mechanisms release excess pressure in the subsea housing and a pressure compensation mechanism pressurize bearings in the bearing assembly at a predetermined pressure.

177 Claims, 35 Drawing Sheets

U.S. PATENT DOCUMENTS

| | | | |
|---|---|---|---|
| 1,157,644 | A | 10/1915 | London |
| 1,472,952 | A | 11/1923 | Anderson |
| 1,503,476 | A | 8/1924 | Childs et al. |
| 1,528,560 | A | 3/1925 | Myers et al. |
| 1,546,467 | A | 7/1925 | Bennett |
| 1,560,763 | A | 11/1925 | Collins |
| 1,700,894 | A | 2/1929 | Joyce et al. |
| 1,708,316 | A | 4/1929 | MacClatchie |
| 1,769,921 | A | 7/1930 | Hansen |
| 1,776,797 | A | 9/1930 | Sheldon |
| 1,813,402 | A | 7/1931 | Hewitt |
| 1,831,956 | A | 11/1931 | Harrington |
| 1,836,470 | A | 12/1931 | Humason et al. |
| 1,902,906 | A | 3/1933 | Seamark |
| 1,942,366 | A | 1/1934 | Seamark |
| 2,036,537 | A | 4/1936 | Otis |
| 2,071,197 | A | 2/1937 | Burns et al. |
| 2,124,015 | A | 7/1938 | Stone et al. |
| 2,126,007 | A | 8/1938 | Guiberson et al. |
| 2,144,682 | A | 1/1939 | MacClatchie |
| 2,163,813 | A | 6/1939 | Stone et al. |
| 2,165,410 | A | 7/1939 | Penick et al. |
| 2,170,915 | A | 8/1939 | Schweitzer |
| 2,170,916 | A | 8/1939 | Schweitzer et al. |
| 2,175,648 | A | 10/1939 | Roach |
| 2,176,355 | A | 10/1939 | Otis |
| 2,185,822 | A | 1/1940 | Young |
| 2,199,735 | A | 5/1940 | Beckman |
| 2,222,082 | A | 11/1940 | Leman et al. |
| 2,233,041 | A | 2/1941 | Alley |
| 2,243,340 | A | 5/1941 | Hild |
| 2,243,439 | A | 5/1941 | Pranger et al. |
| 2,287,205 | A | 6/1942 | Stone |
| 2,303,090 | A | 11/1942 | Pranger et al. |
| 2,313,169 | A | 3/1943 | Penick et al. |
| 2,325,556 | A | 7/1943 | Taylor, Jr. et al. |
| 2,338,093 | A | 1/1944 | Caldwell |
| 2,480,955 | A | 9/1949 | Penick |
| 2,506,538 | A | 5/1950 | Bennett |
| 2,529,744 | A | 11/1950 | Schweitzer |
| 2,609,836 | A | 9/1952 | Knox |
| 2,628,852 | A | 2/1953 | Voytech |
| 2,646,999 | A | 7/1953 | Barske |
| 2,649,318 | A | 8/1953 | Skillman |
| 2,731,281 | A | 1/1956 | Knox |
| 2,746,781 | A | 5/1956 | Jones |
| 2,760,750 | A | 8/1956 | Schweitzer, Jr. et al. |
| 2,760,795 | A | 8/1956 | Vertson |
| 2,764,999 | A | 10/1956 | Stanbury |
| 2,808,229 | A | 10/1957 | Bauer et al. |
| 2,808,230 | A | 10/1957 | McNeill et al. |
| 2,846,178 | A | 8/1958 | Minor |
| 2,846,247 | A | 8/1958 | Davis |
| 2,853,274 | A | 9/1958 | Collins |
| 2,862,735 | A | 12/1958 | Knox |
| 2,886,350 | A | 5/1959 | Horne |
| 2,904,357 | A | 9/1959 | Knox |
| 2,927,774 | A | 3/1960 | Ormsby |
| 2,929,610 | A | 3/1960 | Stratton |
| 2,995,196 | A | 8/1961 | Gibson et al. |
| 3,023,012 | A | 2/1962 | Wilde |
| 3,029,083 | A | 4/1962 | Wilde |
| 3,032,125 | A | 5/1962 | Hiser et al. |
| 3,033,011 | A | 5/1962 | Garrett |
| 3,052,300 | A | 9/1962 | Hampton |
| 3,100,015 | A | 8/1963 | Regan |
| 3,128,614 | A | 4/1964 | Auer |
| 3,134,613 | A | 5/1964 | Regan |
| 3,176,996 | A | 4/1965 | Barnett |
| 3,203,358 | A | 8/1965 | Regan et al. |
| 3,209,829 | A | 10/1965 | Haeber |
| 3,216,731 | A | 11/1965 | Dollison |
| 3,225,831 | A | 12/1965 | Knox |
| 3,259,198 | A | 7/1966 | Montgomery et al. |
| 3,268,233 | A | 8/1966 | Brown |
| 3,285,352 | A | 11/1966 | Hunter |
| 3,288,472 | A | 11/1966 | Watkins |
| 3,289,761 | A | 12/1966 | Smith et al. |
| 3,294,112 | A | 12/1966 | Watkins |
| 3,313,345 | A | 4/1967 | Fischer |
| 3,313,358 | A | 4/1967 | Postlewaite et al. |
| 3,323,773 | A | 6/1967 | Walker |
| 3,333,870 | A | 8/1967 | Watkins |
| 3,347,567 | A | 10/1967 | Watkins |
| 3,360,048 | A | 12/1967 | Watkins |
| 3,372,761 | A | 3/1968 | van Gils |
| 3,387,851 | A | 6/1968 | Cugini |
| 3,397,928 | A | 8/1968 | Galle |
| 3,400,938 | A | 9/1968 | Williams |
| 3,405,763 | A | 10/1968 | Pitts et al. |
| 3,421,580 | A | 1/1969 | Fowler et al. |
| 3,443,643 | A | 5/1969 | Jones |
| 3,445,126 | A | 5/1969 | Watkins |
| 3,452,815 | A | 7/1969 | Watkins |
| 3,472,518 | A | 10/1969 | Harlan |
| 3,476,195 | A | 11/1969 | Galle |
| 3,485,051 | A | 12/1969 | Watkins |
| 3,492,007 | A | 1/1970 | Jones |
| 3,493,043 | A | 2/1970 | Watkins |
| 3,529,835 | A | 9/1970 | Lewis |
| 3,583,480 | A | 6/1971 | Regan |
| 3,587,734 | A | 6/1971 | Shaffer |
| 3,603,409 | A | 9/1971 | Watkins |
| 3,621,912 | A | 11/1971 | Wooddy, Jr. |
| 3,631,834 | A | 1/1972 | Gardner et al. |
| 3,638,721 | A * | 2/1972 | Harrison ..... 166/351 |
| 3,638,742 | A | 2/1972 | Wallace |
| 3,653,350 | A | 4/1972 | Koons et al. |
| 3,661,409 | A | 5/1972 | Brown et al. |
| 3,664,376 | A | 5/1972 | Watkins |
| 3,667,721 | A | 6/1972 | Vujasinovic |
| 3,677,353 | A | 7/1972 | Baker |
| 3,724,862 | A | 4/1973 | Biffle |
| 3,779,313 | A | 12/1973 | Regan |
| 3,815,673 | A | 6/1974 | Bruce et al. |
| 3,827,511 | A | 8/1974 | Jones |
| 3,847,215 | A | 11/1974 | Herd |
| 3,868,832 | A | 3/1975 | Biffle |
| 3,924,678 | A | 12/1975 | Ahlstone |
| 3,934,887 | A | 1/1976 | Biffle |
| 3,952,526 | A | 4/1976 | Watkins et al. |
| 3,955,622 | A | 5/1976 | Jones |
| 3,965,987 | A | 6/1976 | Biffle |
| 3,976,148 | A | 8/1976 | Maus et al. |
| 3,984,990 | A | 10/1976 | Jones |
| 3,992,889 | A | 11/1976 | Watkins et al. |
| 3,999,766 | A | 12/1976 | Barton |
| 4,037,890 | A | 7/1977 | Kurita et al. |
| 4,046,191 | A | 9/1977 | Neath |
| 4,053,023 | A | 10/1977 | Herd et al. |
| 4,063,602 | A | 12/1977 | Howell et al. |
| 4,091,881 | A | 5/1978 | Maus |
| 4,098,341 | A | 7/1978 | Lewis |
| 4,099,583 | A | 7/1978 | Maus |
| 4,109,712 | A | 8/1978 | Regan |
| 4,143,880 | A | 3/1979 | Bunting et al. |
| 4,143,881 | A | 3/1979 | Bunting |
| 4,149,603 | A | 4/1979 | Arnold |
| 4,154,448 | A | 5/1979 | Biffle |
| 4,157,186 | A | 6/1979 | Murray et al. |
| 4,183,562 | A | 1/1980 | Watkins et al. |
| 4,200,312 | A | 4/1980 | Watkins |
| 4,208,056 | A | 6/1980 | Biffle |
| 4,222,590 | A | 9/1980 | Regan |

4,281,724 A 8/1981 Garrett
4,282,939 A 8/1981 Maus et al.
4,285,406 A 8/1981 Garrett et al.
4,291,772 A 9/1981 Beynet
4,293,047 A 10/1981 Young
4,304,310 A 12/1981 Garrett
4,310,058 A 1/1982 Bourgoyne, Jr.
4,312,404 A 1/1982 Morrow
4,313,054 A 1/1982 Martini
4,326,584 A 4/1982 Watkins
4,335,791 A 6/1982 Evans
4,349,204 A 9/1982 Malone
4,353,420 A 10/1982 Miller
4,355,784 A 10/1982 Cain
4,361,185 A 11/1982 Biffle
4,363,357 A 12/1982 Hunter
4,367,795 A 1/1983 Biffle
4,378,849 A 4/1983 Wilks
4,383,577 A 5/1983 Pruitt
4,386,667 A 6/1983 Millsapps, Jr.
4,398,599 A 8/1983 Murray
4,406,333 A 9/1983 Adams
4,407,375 A 10/1983 Nakamura
4,413,653 A 11/1983 Carter, Jr.
4,416,340 A 11/1983 Bailey
4,423,776 A 1/1984 Wagoner et al.
4,424,861 A 1/1984 Carter, Jr. et al.
4,440,232 A 4/1984 LeMoine
4,441,551 A 4/1984 Biffle
4,444,250 A 4/1984 Keithahn et al.
4,444,401 A 4/1984 Roche et al.
4,448,255 A 5/1984 Shaffer et al.
4,456,062 A 6/1984 Roche et al.
4,456,063 A 6/1984 Roche
4,480,703 A 11/1984 Garrett
4,484,753 A 11/1984 Kalsi
4,486,025 A 12/1984 Johnston
4,500,094 A 2/1985 Biffle
4,502,534 A 3/1985 Roche et al.
4,509,405 A 4/1985 Bates
4,524,832 A 6/1985 Roche et al.
4,526,243 A 7/1985 Young
4,527,632 A 7/1985 Chaudot
4,529,210 A 7/1985 Biffle
4,531,580 A 7/1985 Jones
4,531,593 A 7/1985 Elliott et al.
4,540,053 A 9/1985 Baugh et al.
4,546,828 A 10/1985 Roche
4,553,591 A 11/1985 Mitchell
D282,073 S 1/1986 Bearden et al.
4,566,494 A 1/1986 Roche
4,595,343 A 6/1986 Thompson et al.
4,597,447 A 7/1986 Roche et al.
4,597,448 A 7/1986 Baugh
4,611,661 A 9/1986 Hed et al.
4,615,544 A 10/1986 Baugh
4,618,314 A 10/1986 Hailey
4,621,655 A 11/1986 Roche
4,626,135 A 12/1986 Roche
4,646,826 A 3/1987 Bailey et al.
4,646,844 A 3/1987 Roche et al.
4,690,220 A 9/1987 Braddick
4,697,484 A 10/1987 Klee et al.
4,709,900 A 12/1987 Dyhr
4,712,620 A 12/1987 Lim et al.
4,719,937 A 1/1988 Roche et al.
4,722,615 A 2/1988 Bailey et al.
4,727,942 A 3/1988 Galle et al.
4,736,799 A 4/1988 Ahlstone
4,745,970 A 5/1988 Bearden et al.
4,749,035 A 6/1988 Cassity
4,754,820 A 7/1988 Watts et al.
4,759,413 A 7/1988 Bailey et al.
4,765,404 A 8/1988 Bailey et al.
4,783,084 A 11/1988 Biffle
4,807,705 A 2/1989 Henderson et al.
4,813,495 A 3/1989 Leach
4,817,724 A 4/1989 Funderburg, Jr. et al.
4,825,938 A 5/1989 Davis
4,828,024 A 5/1989 Roche
4,832,126 A 5/1989 Roche
4,836,289 A 6/1989 Young
4,909,327 A 3/1990 Roche
4,949,796 A 8/1990 Williams
4,955,436 A 9/1990 Johnston
4,955,949 A 9/1990 Bailey et al.
4,962,819 A 10/1990 Bailey et al.
4,971,148 A 11/1990 Roche et al.
4,984,636 A 1/1991 Bailey et al.
4,995,464 A 2/1991 Watkins et al.
5,009,265 A 4/1991 Bailey et al.
5,022,472 A 6/1991 Bailey et al.
5,028,056 A 7/1991 Bemis et al.
5,040,600 A 8/1991 Bailey et al.
5,062,479 A 11/1991 Bailey et al.
5,072,795 A 12/1991 Delgado et al.
5,076,364 A 12/1991 Hale et al.
5,085,277 A 2/1992 Hopper
5,137,084 A 8/1992 Gonzales et al.
5,154,231 A 10/1992 Bailey et al.
5,163,514 A 11/1992 Jennings
5,178,215 A 1/1993 Yenulis et al.
5,184,686 A 2/1993 Gonzalez
5,195,754 A 3/1993 Dietle
5,213,158 A 5/1993 Bailey et al.
5,215,151 A 6/1993 Smith et al.
5,224,557 A 7/1993 Yenulis et al.
5,230,520 A 7/1993 Dietle et al.
5,251,869 A 10/1993 Mason
5,277,249 A 1/1994 Yenulis et al.
5,279,365 A 1/1994 Yenulis et al.
5,305,839 A 4/1994 Kalsi et al.
5,320,325 A 6/1994 Young et al.
5,322,137 A 6/1994 Gonzales
5,325,925 A 7/1994 Smith et al.
5,348,107 A 9/1994 Bailey et al.
5,443,129 A 8/1995 Bailey et al.
5,588,491 A 12/1996 Brugman et al.
5,607,019 A 3/1997 Kent
5,647,444 A 7/1997 Williams
5,662,171 A 9/1997 Brugman et al.
5,662,181 A 9/1997 Williams et al.
5,671,812 A 9/1997 Bridges
5,678,829 A 10/1997 Kalsi et al.
5,738,358 A 4/1998 Kalsi et al.
5,823,541 A 10/1998 Dietle et al.
5,829,531 A 11/1998 Hebert et al.
5,848,643 A 12/1998 Carbaugh et al.
5,873,576 A 2/1999 Dietle et al.
5,878,818 A 3/1999 Hebert et al.
5,901,964 A 5/1999 Williams et al.
5,944,111 A 8/1999 Bridges
6,007,105 A 12/1999 Dietle et al.
6,016,880 A 1/2000 Hall et al.
6,036,192 A 3/2000 Dietle et al.
6,102,123 A 8/2000 Bailey et al.
6,102,673 A 8/2000 Mott et al.
6,109,348 A 8/2000 Caraway
6,109,618 A 8/2000 Dietle
6,129,152 A 10/2000 Hosie et al.
6,138,774 A 10/2000 Bourgoyne et al.
6,202,745 B1 3/2001 Reimert et al.
6,213,228 B1 4/2001 Saxman
6,227,547 B1 5/2001 Dietle et al.
6,230,824 B1 5/2001 Peterman et al.
6,244,359 B1 6/2001 Bridges et al.

| | | | |
|---|---|---|---|
| 6,263,982 | B1 | 7/2001 | Hannegan et al. |
| 6,325,159 | B1 | 12/2001 | Peterman et al. |
| 6,354,385 | B1 | 3/2002 | Ford et al. |
| 6,450,262 | B1 | 9/2002 | Regan |
| 6,457,529 | B2 | 10/2002 | Calder et al. |
| 6,470,975 | B1 | 10/2002 | Bourgoyne et al. |
| 6,478,303 | B1 | 11/2002 | Radcliffe |
| 6,547,002 | B1 | 4/2003 | Bailey et al. |
| 6,554,016 | B2 | 4/2003 | Kinder |
| RE38,249 | E | 9/2003 | Tasson et al. |
| 6,655,460 | B2 | 12/2003 | Bailey et al. |
| 6,702,012 | B2 | 3/2004 | Bailey et al. |
| 6,732,804 | B2 | 5/2004 | Hosie et al. |
| 6,749,172 | B2 | 6/2004 | Kinder |
| 6,843,313 | B2 | 1/2005 | Hult |
| 6,913,092 | B2 | 7/2005 | Bourgoyne |
| 7,004,444 | B2 | 2/2006 | Kinder |
| 7,040,394 | B2 | 5/2006 | Bailey et al. |
| 7,080,685 | B2 | 7/2006 | Bailey et al. |
| 2001/0040052 | A1 | 11/2001 | Bourgoyne et al. |
| 2001/0050185 | A1 | 12/2001 | Calder |
| 2003/0070842 | A1 | 4/2003 | Bailey et al. |
| 2003/0102136 | A1 | 6/2003 | Nelson et al. |
| 2003/0106712 | A1 | 6/2003 | Bourgoyne et al. |
| 2003/0121671 | A1 | 7/2003 | Bailey et al. |
| 2004/0055755 | A1 | 3/2004 | Roesner et al. |
| 2004/0084220 | A1 | 5/2004 | Bailey et al. |
| 2004/0108108 | A1 | 6/2004 | Bailey et al. |
| 2004/0238175 | A1 | 12/2004 | Wade et al. |
| 2005/0000698 | A1 | 1/2005 | Bailey et al. |
| 2005/0151107 | A1 | 7/2005 | Shu |
| 2005/0241833 | A1 | 11/2005 | Bailey et al. |
| 2006/0102387 | A1 | 5/2006 | Bourgoyne et al. |
| 2006/0108119 | A1 | 5/2006 | Bailey et al. |

FOREIGN PATENT DOCUMENTS

| | | | |
|---|---|---|---|
| AU | 200028183 | A1 | 9/2000 |
| AU | 200028183 | B2 | 9/2000 |
| CA | 2363132 | A1 | 9/2000 |
| CA | 2447196 | A1 | 4/2004 |
| EP | 0290250 | A2 | 11/1988 |
| EP | 0290250 | A3 | 11/1988 |
| EP | 267140 | B1 | 3/1993 |
| GB | 2067235 | A | 7/1981 |
| GB | 2394741 | A | 5/2004 |
| WO | WO99/50524 | A2 | 10/1999 |
| WO | WO99/51852 | A1 | 10/1999 |
| WO | WO99/50524 | A3 | 12/1999 |
| WO | WO00/52299 | A | 9/2000 |
| WO | WO 00/52299 | A1 | 9/2000 |

OTHER PUBLICATIONS

Cameron HC Collet Connector, © 1996 Cooper Cameron Corporation, Cameron Division (12 pages).

Riserless drilling: circumventing the size/cost cycle in deepwater—Conoco, Hydril project seek enabling technologies to drill in deepest water depths economically, May 1996 Offshore Drilling Technology (pp. 49, 50, 52, 53, 54 and 55).

Williams Tool Company—Home Page—Under Construction Williams Rotating Control Heads (2 pages); Seal-Ability for the pressures of drilling (2 pages); Williams Model 7000 Series Rotating Control Heads (1 page): Williams Model 7000 & 7100 Series Rotating Control Heads (2 pages); Williams Model IP1000 Rotating Control Head (2 pages); Williams Conventional Models 8000 & 9000 (2 pages); Applications Where using a Williams rotating control head while drilling is a plus (1 page); Williams higher pressure rotating control head systems are Ideally Suited for New Technology Flow Drilling and Closed Loop Underbalanced Drilling (UBD) Vertical and Horizontal (2 pages); and How to Contact Us (2 pages).

Offshore—World Trends and Technology for Offshore Oil and Gas Operations, Mar. 1998, Seismic: Article entitled, "Shallow Flow Diverter JIP Spurred by Deepwater Washouts" (3 pages including cover page, table of contents and p. 90).

Williams Tool Co., Inc. Rotating Control Heads and Strippers for Air, Gas, Mud, and Geothermal Drilling Worldwide—Sales Rental Service, © 1988 (19 pages).

Williams Tool Co., Inc. 19 page brochure © 1991 Williams Tool Co., Inc. (19 pages).

Fig. 14. Floating Piston Drilling Choke Design; May of 1997.

Blowout Preventer Testing for Underbalanced Drilling by Charles R. "Rick" Stone and Larry A. Cress, Signa Engineering Corp., Houston, Texas (24 pages) Sep. 1997.

Williams Tool Co., Inc. Instructions, Assemble & Disassemble Model 9000 Bearing Assembly (cover page and 27 numbered pages).

Williams Tool Co., Inc. Rotating Control Heads Making Drilling Safer While Reducing Costs Since 1968, © 1989 (4 pages).

Williams Tool Company, Inc. International Model 7000 Rotating Control Head, © 1991 (4 pages).

Williams Rotating Control Heads, Reduce Costs Increase Safety Reduce Environmental Impact, 4 pages, (© 1995).

Williams Rotating Control Heads, Reduce Costs Increase Safety Reduce Environmental Impact (4 pages).

Williams Tool Co., Inc., Sales-Rental-Service, Williams Rotating Control Heads and Strippers for Air, Gas, Mud, and Geothermal Drilling, © 1982 (7 pages).

Williams Tool Co., Inc., Rotating Control Heads and Strippers for Air, Gas, Mud, Geothermal and Pressure Drilling, © 1991 (19 pages).

An article—The Brief Jan. '96, The Brief's Guest Columnists, Williams Tool Co., Inc., Communicating Dec. 13, 1995 (Fort Smith, Arkansas) The When? and Why? of Rotating Control Head Usage, Copyright © Murphy Publishing, Inc. 1996 (2 pages).

A reprint from the Oct. 9, 1995 edition of Oil & Gas Journal, "Rotating control head applications increasing", by Adam T. Bourgoyne, Jr., Copyright 1995 by PennWell Publishing Company (6 pages).

1966-1967 Composite Catalog-Grant Rotating Drilling Head for Air, Gas or Mud Drilling, (1 page).

1976-1977 Composite Catalog Grant Oil Tool Company Rotating Drilling Head Models 7068, 7368, 8068 (Patented), Equally Effective with Air, Gas, or Mud Circulation Media (3 pages).

A Subsea Rotating Control Head for Riserless Drilling Applications; Darryl A. Bourgoyne, Adam T. Bourgoyne, and Don Hannegan—1998 (International Association of Drilling Contractors International Deep Water Well Control Conference held in Houston, Texas, Aug. 26-27, 1998), (14 pages).

Hannegan, "Applications Widening for Rotating Control Heads," Drilling Contractor, cover page, table of contents and pp. 17 and 19, Drilling Contractor Publications Inc., Houston, Texas Jul. 1996.

Composite Catalog, Hughes Offshore 1986-87 Subsea Systems and Equipment, Hughes Drilling Equipment Composite Catalog (pp. 2986-3004).

Williams Tool Co., Inc., Technical Specifications Model for The Model 7100, (3 pages).

Williams Tool Co., Inc. Website, Underbalanced Drilling (UBD), The Attraction of UBD (2 pages).

Williams Tool Co., Inc. Website, "Applications, Where Using a Williams Rotating Control Head While Drilling is a Plus" (2 pages).

Williams Tool Co., Inc. Website, "Model 7100," (3 pages).

Composite Catalog, Hughes Offshore 1982/1983, Regan Products, © Copyright 1982, (Two cover sheets and 4308-27 thru 4308-43, and end sheet) See p. 4308-36 Type KFD Diverter.

Coflexip Brochure; 1-Coflexip Sales Offices, 2-The Flexible Steel Pipe for Drilling and Service Applications, 3-New 5" I.D. General Drilling Flexible, 4-Applications, and 5-Illustration (5 unnumbered pages).

Baker, Ron, "A Primer of Oilwell Drilling", Fourth Edition, Published by Petroleum Extension Service, The University of Texas at Austin, Austin, Texas, in cooperation with International Association of Drilling Contractors Houston Texas © 1979, (3 cover pages and pp. 42-49 re Circulation System).

Brochure, Lock down Lubricator System, Dutch Enterprises Inc., "Safety with Savings," (cover sheet and 16 unnumbered pages) See above U.S. Patent No. 4,836,289 referred to therein.
Hydril GL series Annular Blowout Preventers (Patented—see Roche patents above), (cover sheet and 2 pages).
Other Hydril Product Information (The GH Gas Handler Series Product is Listed), © 1996, Hydril Company (Cover sheet and 19 pages).
Brochure, Shaffer Type 79 Rotating Blowout Preventer, NL Rig Equipment/NL Industries, Inc., (6 unnumbered pages).
Shaffer, A Varco Company, (Cover page and pages 1562-1568).
Avoiding Explosive Unloading of Gas in a Deep Water Riser When SOBM is in Use; Colin P. Leach & Joseph R. Roche-1998 (The Paper Describes an Application for the Hydril Gas Handler, The Hydril GH 211-2000 Gas Handler is Depicted in Figure 1 of the Paper), (9 unnumbered pages).
Feasibility Study of Dual Density Mud System for Deepwater Drilling Operations; Clovis A. Lopes & A.T. Bourgoyne Jr.—1997 (Offshore Technology Conference Paper No. 8465), (pp. 257-266).
April 1998 Offshore Drilling with Light Weight Fluids Joint Industry Project Presentation, (9 unnumbered pages).
Nakagawa, Edson Y., Santos, Helio and Cunha, J.C., "Application of Aerated-Fluid Drilling in Deepwater", SPE/IADC 52787 Presented by Don Hannegan, P.E., SPE © 1999 SPE/IADC Drilling Conference, Amsterdam, Holland, Mar. 9-11, 1999 (5 unnumbered pages).
Brochure: "Inter-Tech Drilling Solutions Ltd.'s RBOP™ Means Safety and Experience for Underbalanced Drilling", Inter-Tech Drilling Solutions Ltd./Big D Rentals & Sales (1981) Ltd. and Color Copy of "Rotating BOP" (2 unnumbered pages).
"Pressure Control While Drilling", Shaffer® A Varco Company, Rev. A (2 unnumbered pages).
Field Exposure (As of Aug. 1998), Shaffer® A Varco Company (1 unnumbered page).
Graphic: "Rotating Spherical BOP" (1 unnumbered page).
"JIP's Work Brightens Outlook for UBD in Deep Waters" by Edson Yoshihito Nakagawa Helio Santos and Jose Carlos Cunha American Oil & Gas Reporter, Apr. 1999, pp. 53, 56, 58-60 and 63.
"Seal-Tech 1500 PSI Rotating Blowout Preventer", Undated, 3 pages.
"RPM System 3000™ Rotating Blowout Preventer, Setting a new standard in Well Control", by Techcorp Industries, Undated, 4 pages.
"RiserCap™ Materials Presented at the 1999 LSU/MMS/IADC Well Control Workshop", by Williams Tool Company, Inc., Mar. 24-25, pp. 1-14.
"The 1999 LSU/MMS Well Control Workshop: An overview," by John Rogers Smith, World Oil, Jun. 1999, Cover page and pp. 4, 41-42, and 44-45.
Dag Oluf Nessa, "Offshore underbalanced drilling system could revive field developments," World Oil, vol. 218, No. 10, Oct. 1997, 1 unnumbered page and pp. 83-84, 86, and 88.
D. O. Nessa, "Offshore underbalanced drilling system could revive field developments", World Oil Exploration Drilling Production, vol. 218 No. 7, Color copies of Cover Page and pp. 3, 61-64, and 66, Jul. 1997.
PCT Search Report, International Application No. PCT/US99/06695, 4 pages (Date of Completion May 27, 1999).
PCT Search Report, International Application No. PCT/GB00/00731, 3 pages (Date of Completion Jun. 16, 2000).
National Academy of Sciences—National Research Council, "Design of a Deep Ocean Drilling Ship", Cover Page and pp. 114-121, Undated but cited in above U.S. Patent No. 6,230,824B1.
"History and Development of a Rotating Blowout Preventer," by A. Cress, Rick Stone, and Mike Tangedahl, IADC/SPE 23931, 1992 IADC/SPE Drilling Conference, Feb. 1992, pp. 757-773.
Helio Santos, Email message to Don Hannegan, et al., 1 page, (Aug. 20, 2001).
Rehm, Bill, "Practical Underbalanced Drilling and Workover," Petroleum Extension Service, The University of Texas at Austin Continuing & Extended Education, Cover page, title page, copyright page, and pp. 6-6, 11-2, 11-3, G-9, and G-10, (2002).
Williams Tool Company Inc., "RISERCAP™: Rotating Control Head System For Floating Drilling Rig Applications", 4 unnumbered pages, (© 1999 Williams Tool Company, Inc.).
Antonio C.V.M. Lage, Helio Santos and Paulo R.C. Silva, Drilling With Aerated Drilling Fluid From a Floating Unit Part 2: Drilling the Well, SPE 71361, 11 pages, (© 2001, Society of Petroleum Engineers Inc.).
Helio Santos, Fabio Rosa, and Christian Leuchtenberg, Drilling with Aerated Fluid from a Floating Unit, Part 1: Planning, Equipment, Tests, and Rig Modifiations, SPE/IADC 67748, 8 pages, (© 2001 SPE/IADC Drilling Conference).
E. Y. Nakagawa, H. Santos, J. C. Cunha and S. Shayegi, Planning of Deepwater Drilling Operations with Aerated Fluids, SPE 54283, 7 pages, (© 1999, Society of Petroleum Engineers).
E. Y. Nakagawa, H.M.R. Santos and J.C. Cunha, Implementing the Light-Weight Fluids Drilling Technology in Deepwater Scenarios, 1999 LSU/MMS Well Control Workship Mar. 24-25, 1999, 12 pages.
Press Release: "Stewart & Stevenson Introduces First Dual Gradient Riser," Stewart & Stevenson, http://www.ssss.com/ssss/20000831.asp, 2 pages (Aug. 31, 2000).
Williams Tool Company Inc., "Williams Tool Company Introduces the . . . Virtual Riser™,"4 unnumbered pages, (© 1998 Williams Tool Company, Inc.).
"PETEX Publications," Petroleum Extension Service, University of Texas at Austin, 12 pages, (last modified Dec. 6, 2002).
"BG in the Caspian region," SPE Review, Issue 164, 3 unnumbered pages, (May 2003).
"Field Cases as of Mar. 3, 2003," Impact Fluid Solutions, 6 pages, (Mar. 3, 2003).
"Determine the Safe Application of Underbalanced Drilling Techniques in Marine Environments—Technical Proposal," Maurer Technology, Inc., Cover Page and pp. 2-13, (Jun. 17, 2002).
Colbert, John W, "John W. Colbert, P.E. Vice President Engineering Biographical Data," Signa Engineering Corp., 2 unnumbered pages, (undated).
"Technical Training Courses," Parker Drilling Co., http://www.parkerdrilling.com/news/tech.html, 5 pages, (last visited, Sep. 5, 2003).
"Drilling equipment: Improvements from data recording to slim hole," Drilling Contractor, pp. 30-32, (Mar./Apr. 2000).
"Drilling conference promises to be informative," Drilling Contractor, p. 10, (Jan./Feb. 2002).
"Underbalanced and Air Drilling," OGCI, Inc., http://www.ogci.com/course_info.asp?courseID=410, 2 pages (2003).
"2003 SPE Calendar," Society of Petroleum Engineers, Google cache of http://www.spe.org/spe/cda/views/events/eventMaster/0,1470,1648_2194_632303,00.html; for "mud cap drilling," 2 pages, (2001).
"Oilfield Glossary: reverse-circulating valve," Schlumberger Limited, 1 page (2003).
Murphy, Ross D. and Thompson, Paul B., "A drilling contractor's view of underbalanced drilling," World Oil Magazine, vol. 223, No. 5, 9 pages, (May 2002).
"Weatherford UnderBalanced Services: General Underbalance Presentation to the DTI," 71 unnumbered pages, © 2002.
Rach, Nina M., "Underbalanced, near-balanced drilling are possible offshore," Oil & Gas Journal, Color Copies, pp. 39-44, (Dec. 1, 2003).
Forrest, Neil; Bailey, Tom; Hannegan, Don; "Subsea Equipment for Deep Water Drilling Using Dual Gradient Mud System," SPE/IADC 67707, pp. 1-8, (© 2001, SPE/IADC Drilling Conference).
Hannegan, D.M.; Bourgoyne Jr., A.T.; "Deepwater Drilling with Lightweight Fluids—Essential Equipment Required," SPE/IADC 67708, pp. 1-6, (© 2001, SPE/IADC Drilling Conference).
Hannegan, Don M., "Underbalanced Operations Continue Offshore Movement," SPE 68491, pp. 1-3, (© 2001, Society of Petroleum Engineers, Inc.).
Hannegan, D. and Divine, R., "Underbalanced Drilling—Perceptions and Realities of Today's Technology in Offshore Applications," IADC/SPE 74448, pp. 1-9, (© 2002, IADC/SPE Drilling Conference).

Hannegan, Don M. and Wanzer, Glen; "Well Control Considerations—Offshore Applications of Underbalanced Drilling Technology," SPE/IADC 79854, pp. 1-14, (© 2003, SPE/IADC Drilling Conference).
Bybee, Karen, "Offshore Applications of Underbalanced-Drilling Technology," Journal of Petroleum Technology, Cover Page and pp. 51-52, (Jan. 2004).
Bourgoyne, Darryl A.; Bourgoyne, Adam T.; Hannegan, Don; "A Subsea Rotating Control Head for Riserless Drilling Applications," IADC International Deep Water Well Control Conference, pp. 1-14, (Aug. 26-27, 1998) (see document T).
Lage, Antonio C.V.M; Santos, Helio; Silva, Paulo R.C.; "Drilling With Aerated Drilling Fluid From a Floating Unit Part 2: Drilling the Well," Society of Petroleum Engineers, SPE 71361, pp. 1-11, (Sep. 30-Oct. 3, 2001) (see document BBB).
Furlow, William; "Shell's seafloor pump, solids removal key to ultra-deep, dual-gradient drilling (Skid ready for commercialization)," Offshore World Trends and Technology for Offshore Oil and Gas Operations, Cover page, table of contents, pp. 54, 2 unnumbered pages, and 106, (Jun. 2001).
Rowden, Michael V.; "Advances in riserless drilling pushing the deepwater surface string envelope (Alternative to seawater, CaCl2 sweeps)," Offshore World Trends and Technology for Offshore Oil and Gas Operations, Cover page, table of contents, pp. 56, 58, and 106, (Jun. 2001).
Boyle, John; "Multi Purpose Intervention Vessel Presentation," M.O.S.T. Multi Operational Service Tankers, Weatherford International, Jan. 2004, 43 pages, (© 2003).
GB Search Report, International Application No. GB 0324939.8, 1 page (Jan. 21, 2004).
MicroPatent® list of patents citing U.S. Patent No. 3,476,195, printed on Jan. 24, 2003.
PCT Search Report, International Application No. PCT/EP2004/052167, 4 pages (Date of Completion Nov. 25, 2004).
PCT Written Opinion of the International Searching Authority, International Application No. PCT/EP2004/052167, 6 pages.
Supplementary European Search Report No. EP 99908371, 3 pages (Date of Completion Oct. 22, 2004).
*General Catalog*, 1970-1971, Vetco Offshore, Inc., Subsea Systems; cover page, company page and numbered pp. 4800, 4816-4818; 6 pages total, in particular see numbered p. 4816 for "patented" Vetco H-4 connectors.
*General Catalog*, 1972-73, Vetco Offshore, Inc., Subsea Systems; cover page, company page and numbered pp. 4498, 4509-4510; 5 pages total.
*General Catalog*, 1974-75, Vetco Offshore, Inc., cover page, company page and numbered pp. 5160, 5178-5179; 5 pages total.
*General Catalog*, 1976-1977, Vetco Offshore, Inc., Subsea Drilling and Completion Systems; cover page and numbered pp. 5862-5863, 5885; 4 pages total.
*General Catalog*, 1982-1983, Vetco; cover page and numbered pp. 8454-8455, 8479; 4 pages total.
*Shaffer, A Varco Company: Pressure Control While Drilling System*, http://www.tulsaequip.com; printed Jun. 21, 2004; 2 pages.
*Performance Drilling by Precision Drilling. A Smart Equation*, Precision Drilling; © 2002 Precision Drilling Corporation; 12 pages, in particular see 9th page for "Northland's patented RBOP . . . ".
*RPM System 3000™ Rotating Blowout Preventer: Setting a New Standard in Well Control*, Weatherford, Underbalanced Systems; © 2002-2005 Weatherford; Brochure #333.01, 4 pages.
*Managed Pressure Drilling in Marine Environments*, Don Hannegan, P.E.; Drilling Engineering Association Workshop, Moody Gardens, Galveston, Jun. 22-23, 2004; © 2004 Weatherford; 28 pages.
Hold™ 2500 RCD Rotating Control Device web page and brochure, http://www.smith.com/hold2500; printed Oct. 27, 2004; 5 pages.
Rehm, Bill, "Practical Underbalanced Drilling and Workover," Petroleum Extension Service, The University of Texas at Austin Continuing & Extended Education, cover page, title page, copyright page and pp. 6-1 to 6-9, 7-1 to 7-9 (2002).
"Pressured Mud Cap Drilling from A Semi-Submersible Drilling Rig", J.H. Terwogt, SPE, L.B. Makiaho and N. van Beelen, SPE, Shell Malaysia Exploration and Production; B.J. Gedge, SPE, and J. Jenkins, Weatherford Drilling and Well Services (6 pages total); © 2005 (This paper was prepared for presentation at the SPE/IADC Drilling Conference held in Amsterdam, The Netherlands, Feb. 23-25, 2005).
Tangedahl, M.J., et al, "Rotating Preventers: Technology for Better Well Control", World Oil, Gulf Publishing Company, Houston, TX, US, vol. 213, No. 10, Oct. 1992, numbered pp. 63-64 and 66 (3 pages).
European Search Report for EP 05 27 0083, Application No. 05270083.8-2315, European Patent Office, Mar. 2, 2006 (5 pages).
Netherlands Search Report for NL No. 1026044, dated Dec. 14, 2005 (3 pages).
U.S. Appl. No. 60/079,641, filed Mar. 27, 1998.
U.S. Appl. No. 60/122,530, filed Mar. 2, 1999.
Int'l. Search Report for PCT/GB 00/00731 corresponding to U.S. Patent No. 6,470,975 (Jun. 16, 2000) (2 pages).
GB0324939.8 Examination Report corresponding to U.S. Patent No. 6,470,975 (Mar. 21, 2006) (6 pages).
GB0324939.8 Examination Report corresponding to U.S. Patent No. 6,470,975 Jan. 22, 2004) (3 pages).
2003/0106712 Family Lookup Report (Jun. 15, 2006) (5 pages).
6,450,975 Family Lookup Report (Jun. 15, 2006) (5 pages).
AU S/N 28183/00 Examination Report corresponding to U.S. Patent No. 6,470,975 (1 page) (Sep. 9, 2002).
NO S/N 20013953 Examination Report corresponding to U.S. Patent No. 6,470,975 w/one page of English translation (3 pages) (Apr. 29, 2003).
Nessa; D.O. & Tangedahl, M.L. & Saponja, J.: Part 1: "Offshore underbalanced drilling system could revive field developments", World Oil, vol. 218 No. 7, Cover Page, 3, 61-64 and 66 (Jul. 1997); and Part 2: "Making this valuable reservoir drilling/completion technique work on a conventional offshore drilling platform."—World Oil, vol. 218 No. 10, Cover Page, 3, 83, 84, 86 and 88 (Oct. 1997) (see 5A, 5G above and 5I below).
Int'l Search Report for PCT/GB 00/00731 corresponding to U.S. Patent No. 6,470,975 (4 pages) (Jun. 27, 2000).
Int'l. Preliminary Examination Report for PCT/GB 00/00731 corresponding to U.S. Patent No. 6,470,975 (7 pages) (Dec. 14, 2000).
NL Examination Report for WO 00/52299 corresponding to this U.S. S/N 10/281,534 (3 pages) (Dec. 19, 2003).
AU S/N 28181/00 Examination Report corresponding to U.S. Patent No. 6,263,982 (1 page) (Sep. 6, 2002).
EU Examination Report for WO 00/906522.8-2315 corresponding to U.S. Patent No. 6,263,982 (4 pages) (Nov. 29, 2004).
NO S/N 20013952 Examination Report w/two pages of English translation corresponding to U.S. Patent No. 6,263,982 (4 pages) (Jul. 22, 2005).
PCT/GB00/00726 Int'l. Preliminary Examination Report corresponding to U.S. Patent No. 6,263,982 (10 pages) (Jun. 26, 2001).
PCT/GB00/00726 Written Opinion corresponding to U.S. Patent No. 6,263,982 (7 pages) (Dec. 18, 2000).
PCT/GB00/00726 International Search Report corresponding to U.S. Patent No. 6,263,982 (3 pages) (Mar. 2, 1999).
AU S/N 27822/99 Examination Report corresponding to U.S. Patent No. 6,138,774 (1 page) (Oct. 15, 2001).
EU 99908371.0-1266-US9903888 European Search Report corresponding to U.S. Patent No. 6,138,774 (3 pages) (Nov. 2, 2004).
NO S/N 20003950 Examination Report w/one page of English translation corresponding to U.S. Patent No. 6,138,774 (3 pages) (Nov. 1, 2004).
PCT/US990/03888 Notice of Transmittal of International Search Report corresponding to U.S. Patent No. 6,138,774 (6 pages) (Aug. 4, 1999).
PCT/US99/03888 Written Opinion corresponding to U.S. Patent No. 6,138,744 (5 pages) (Dec. 21, 1999).
PCT/US99/03888 Notice of Transmittal of International Preliminary Examination Report corresponding to U.S. Patent No. 6,138,774 (15 pages) (Jun. 12, 2000).

EU Examination Report for 05270083.8-2315 corresponding to US 2006/0108119 A1 published May 25, 2006 (11 pages) (May 10, 2006).

Tangedahl, M.J., et al. "Rotating Preventers: Technology for Better Well Control", World Oil, Gulf Publishing Company, Houston, TX, US, vol. 213, No. 10, (Oct. 1, 1992), numbered pp. 63-64 and 66 (3 pages) XP 000288328 ISSN: 0043-8790 (see YYYY, 5X above).

US Appl. No. 60/079,641, filed Mar. 27, 1998 with inventors Charles P. Peterman, et al. that is indicated as Related U.S. Application Data on face of above US 6,230,824 B1. In particular, see numbered pp. 19 and 20 and Figs. 1 to 4b.

UK Search (dated Feb. 19, 2007 and Examination Report (dated Feb. 20, 2007) for GB0701330.3 corresponding to U.S. Patent No. 7,159,669 (5 pages).

* cited by examiner

FIG. 8
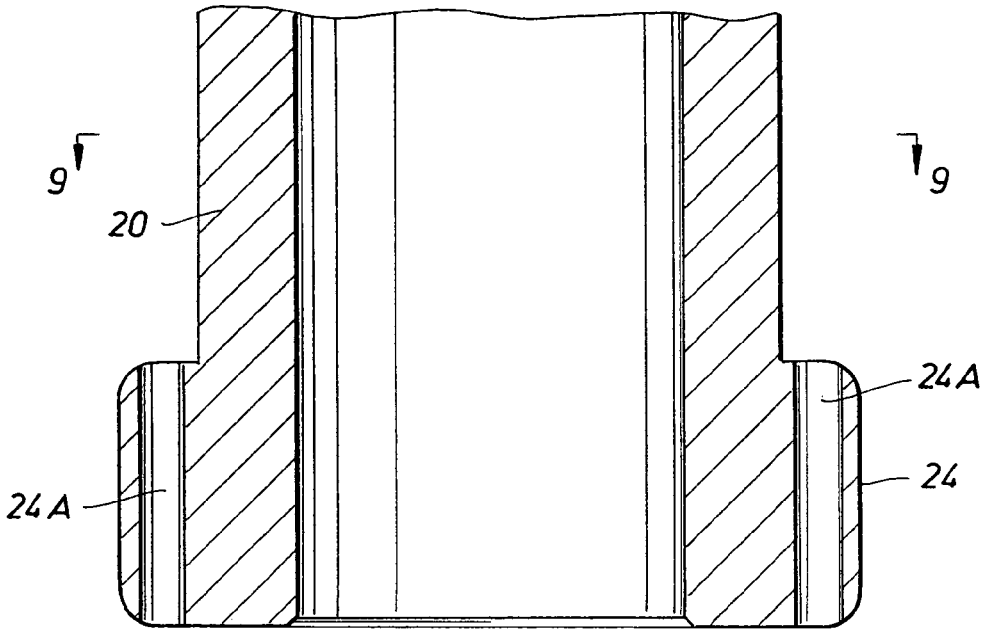
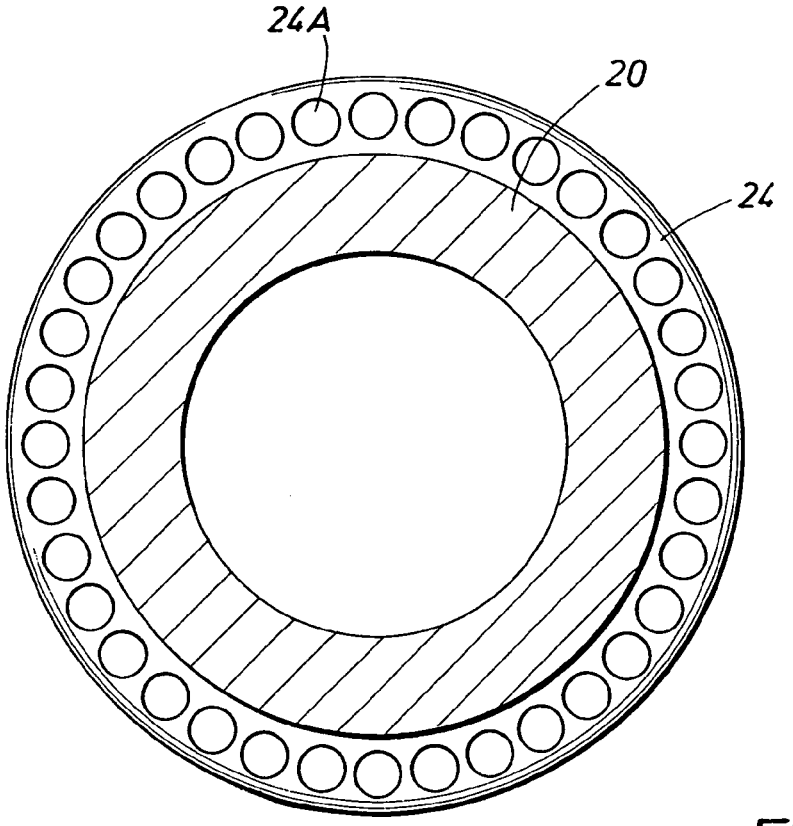
FIG. 9

INTERNAL RISER ROTATING CONTROL HEAD

CROSS-REFERENCE TO RELATED APPLICATIONS

This application is a divisional of U.S. application Ser. No. 10/281,534, entitled "Internal Riser Rotating Control Head," filed Oct. 28, 2002, which issued as U.S. Pat. No. 7,159,669, which is a continuation-in-part of U.S. application Ser. No. 09/516,368, entitled "Internal Riser Rotating Control Head," filed Mar. 1, 2000, which issued as U.S. Pat. No. 6,470,975, on Oct. 29, 2002, and which claims the benefit of and priority-to U.S. Provisional Application Ser. No. 60/122,530, filed Mar. 2, 1999, entitled "Concepts for the Application of Rotating Control Head Technology to Deepwater Drilling Operations," all of which are hereby incorporated by reference in their entirety for all purposes.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates to drilling subsea. In particular, the present invention relates to a system and method for sealingly positioning a rotating control head in a subsea housing.

2. Description of the Related Art

Marine risers extending from a wellhead fixed on the floor of an ocean have been used to circulate drilling fluid back to a structure or rig. The riser must be large enough in internal diameter to accommodate the largest bit and pipe that will be used in drilling a borehole into the floor of the ocean. Conventional risers now have internal diameters of 19½ inches, though other diameters can be used.

An example of a marine riser and some of the associated drilling components, such as shown in FIG. 1, is proposed in U.S. Pat. No. 4,626,135, assigned on its face to the Hydril Company, which is incorporated herein by reference for all purposes. Since the riser R is fixedly connected between a floating structure or rig S and the wellhead W, as proposed in the '135 Hydril patent, a conventional slip or telescopic joint SJ, comprising an outer barrel OB and an inner barrel IB with a pressure seal therebetween, is used to compensate for the relative vertical movement or heave between the floating rig and the fixed riser. A diverter D has been connected between the top inner barrel IB of the slip joint SJ and the floating structure or rig S to control gas accumulations in the marine riser R or low pressure formation gas from venting to the rig floor F. A ball joint BJ above the diverter D compensates for other relative movement (horizontal and rotational) or pitch and roll of the floating structure S and the fixed riser R.

The diverter D can use a rigid diverter line DL extending radially outwardly from the side of the diverter housing to communicate drilling fluid or mud from the riser R to a choke manifold CM, shale shaker SS or other drilling fluid receiving device. Above the diverter D is the rigid flowline RF, shown in FIG. 1, configured to communicate with the mud pit MP. If the drilling fluid is open to atmospheric pressure at the bell-nipple in the rig floor F, the desired drilling fluid receiving device must be limited by an equal height or level on the structure S or, if desired, pumped by a pump to a higher level. While the shale shaker SS and mud pits MP are shown schematically in FIG. 1, if a bell-nipple were at the rig floor F level and the mud return system was under minimal operating pressure, these fluid receiving devices may have to be located at a level below the rig floor F for proper operation. Since the choke manifold CM and separator MB are used when the well is circulated under pressure, they do not need to be below the bell nipple.

As also shown in FIG. 1, a conventional flexible choke line CL has been configured to communicate with choke manifold CM. The drilling fluid then can flow from the choke manifold CM to a mud-gas buster or separator MB and a flare line (not shown). The drilling fluid can then be discharged to a shale shaker SS, and mud pits MP. In addition to a choke line CL and kill line KL, a booster line BL can be used.

In the past, when drilling in deepwater with a marine riser, the riser has not been pressurized by mechanical devices during normal operations. The only pressure induced by the rig operator and contained by the riser is that generated by the density of the drilling mud held in the riser (hydrostatic pressure). During some operations, gas can unintentionally enter the riser from the wellbore. If this happens, the gas will move up the riser and expand. As the gas expands, it will displace mud, and the riser will "unload." This unloading process can be quite violent and can pose a significant fire risk when gas reaches the surface of the floating structure via the bell-nipple at the rig floor F. As discussed above, the riser diverter D, as shown in FIG. 1, is intended to convey this mud and gas away from the rig floor F when activated. However, diverters are not used during normal drilling operations and are generally only activated when indications of gas in the riser are observed. The '135 Hydril patent has proposed a gas handler annular blowout preventer GH, such as shown in FIG. 1, to be installed in the riser R below the riser slip joint SJ. Like the conventional diverter D, the gas handler annular blowout preventer GH is activated only when needed, but instead of simply providing a safe flow path for mud and gas away from the rig floor F, the gas handler annular blowout provider GH can be used to hold limited pressure on the riser R and control the riser unloading process. An auxiliary choke line ACL is used to circulate mud from the riser R via the gas handler annular blowout preventer GH to a choke manifold CM on the rig.

Recently, the advantages of using underbalanced drilling, particularly in mature geological deepwater environments, have become known. Deepwater is considered to be between 3,000 to 7,500 feet deep and ultra deepwater is considered to be 7,500 to 10,000 feet deep. Rotating control heads, such as disclosed in U.S. Pat. No. 5,662,181, have provided a dependable seal between a rotating pipe and the riser while drilling operations are being conducted. U.S. Pat. No. 6,138,774, entitled "Method and Apparatus for Drilling a Borehole into a Subsea Abnormal Pore Pressure Environment," proposes the use of a rotating control head for overbalanced drilling of a borehole through subsea geological formations. That is, the fluid pressure inside of the borehole is maintained equal to or greater than the pore pressure in the surrounding geological formations using a fluid that is of insufficient density to generate a borehole pressure greater than the surrounding geological formation's pore pressures without pressurization of the borehole fluid. U.S. Pat. No. 6,263,982 proposes an underbalanced drilling concept of using a rotating control head to seal a marine riser while drilling in the floor of an ocean using a rotatable pipe from a floating structure. U.S. Pat. Nos. 5,662,181; 6,138,774; and 6,263,982, which are assigned to the assignee of the present invention, are incorporated herein by reference for all purposes. Additionally, provisional application Ser. No. 60/122,350, filed Mar. 2, 1999, entitled "Concepts for the Application of Rotating Control Head Technology to Deepwater Drilling Operations" is incorporated herein by reference for all purposes.

It has also been known in the past to use a dual density mud system to control formations exposed in the open borehole. See Feasibility Study of a Dual Density Mud System for Deepwater Drilling Operations by Clovis A. Lopes and Adam T. Bourgoyne, Jr., © 1997 Offshore Technology Conference. As a high density mud is circulated from the ocean floor back to the rig, gas is proposed in this May of 1997 paper to be injected into the mud column at or near the ocean floor to lower the mud density. However, hydrostatic control of abnormal formation pressure is proposed to be maintained by a weighted mud system that is not gas-cut below the seafloor. Such a dual density mud system is proposed to reduce drilling costs by reducing the number of casing strings required to drill the well and by reducing the diameter requirements of the marine riser and subsea blowout preventers. This dual density mud system is similar to a mud nitrification system, where nitrogen is used to lower mud density, in that formation fluid is not necessarily produced during the drilling process.

U.S. Pat. No. 4,813,495 proposes an alternative to the conventional drilling method and apparatus of FIG. 1 by using a subsea rotating control head in conjunction with a subsea pump that returns the drilling fluid to a drilling vessel. Since the drilling fluid is returned to the drilling vessel, a fluid with additives may economically be used for continuous drilling operations. ('495 patent, col. 6, ln. 15 to col. 7, ln. 24) Therefore, the '495 patent moves the base line for measuring pressure gradient from the sea surface to the mudline of the sea floor ('495 patent, col. 1, lns. 31-34). This change in positioning of the base line removes the weight of the drilling fluid or hydrostatic pressure contained in a conventional riser from the formation. This objective is achieved by taking the fluid or mud returns at the mudline and pumping them to the surface rather than requiring the mud returns to be forced upward through the riser by the downward pressure of the mud column ('495 patent, col. 1, lns. 35-40).

U.S. Pat. No. 4,836,289 proposes a method and apparatus for performing wire line operations in a well comprising a wire line lubricator assembly, which includes a centrally-bored tubular mandrel. A lower tubular extension is attached to the mandrel for extension into an annular blowout preventer. The annular blowout preventer is stated to remain open at all times during wire line operations, except for the testing of the lubricator assembly or upon encountering excessive well pressures. ('289 patent, col. 7, lns. 53-62) The lower end of the lower tubular extension is provided with an enlarged centralizing portion, the external diameter of which is greater than the external diameter of the lower tubular extension, but less than the internal diameter of the bore of the bell nipple flange member. The wireline operation system of the '289 patent does not teach, suggest or provide any motivation for use a rotating control head, much less teach, suggest, or provide any motivation for sealing an annular blowout preventer with the lower tubular extension while drilling.

In cases where reasonable amounts of gas and small amounts of oil and water are produced while drilling underbalanced for a small portion of the well, it would be desirable to use conventional rig equipment, as shown in FIG. 1, in combination with a rotating control head, to control the pressure applied to the well while drilling. Therefore, a system and method for sealing with a subsea housing including, but not limited to, a blowout preventer while drilling in deepwater or ultra deepwater that would allow a quick rig-up and release using conventional pressure containment equipment would be desirable. In particular, a system that provides sealing of the riser at any predetermined location, or, alternatively, is capable of sealing the blowout preventer while rotating the pipe, where the seal could be relatively quickly installed, and quickly removed, would be desirable.

Conventional rotating control head assemblies have been sealed with a subsea housing using active sealing mechanisms in the subsea housing. Additionally, conventional rotating control head assemblies, such as proposed by U.S. Pat. No. 6,230,824, assigned on its face to the Hydril Company, have used powered latching mechanisms in the subsea housing to position the rotating control head. A system and method that would eliminate the need for powered mechanisms in the subsea housing would be desirable because the subsea housing can remain bolted in place in the marine riser for many months, allowing moving parts in the subsea housing to corrode or be damaged.

Additionally, the use of a rotating control head assembly in a dual-density drilling operation can incur problems caused by excess pressure in either one of the two fluids. The ability to relieve excess pressure in either fluid would provide safety and environmental improvements. For example, if a return line to a subsea mud pump plugs while mud is being pumped into the borehole, an overpressure situation could cause a blowout of the borehole. Because dual-density drilling can involve varying pressure differentials, an adjustable overpressure relief technique has been desired.

Another problem with conventional drilling techniques is that moving of a rotating control head within the marine riser by tripping in hole (TIH) or pulling out of hole (POOH) can cause undesirable surging or swabbing effects, respectively, within the well. Further, in the case of problems within the well, a desirable mechanism should provide a "fail safe" feature to allow removal the rotating control head upon application of a predetermined force.

BRIEF SUMMARY OF THE INVENTION

A system and method are disclosed for drilling in the floor of an ocean using a rotatable pipe. The system uses a rotating control head with a bearing assembly and a holding member for removably positioning the bearing assembly in a subsea housing. The bearing assembly is sealed with the subsea housing by a seal, providing a barrier between two different fluid densities. The holding member resists movement of the bearing assembly relative to the subsea housing. The bearing assembly can be connected with the subsea housing above or below the seal.

In one embodiment, the holding member rotationally engages and disengages a passive internal formation of the subsea housing. In another embodiment, the holding member engages the internal formation without regard to the rotational position of the holding member. The holding member is configured to release at predetermined force.

In one embodiment, a pressure relief assembly allows relieving excess pressure within the borehole. In a further embodiment, a pressure relief assembly allows relieving excess pressure within the subsea housing outside the holding member assembly above the seal.

In one embodiment, the internal formation is disposed between two spaced apart side openings in the subsea housing.

In one embodiment, a holding member assembly provides an internal housing concentric with an extendible portion. When the extendible portion extends, an upper portion of the internal housing moves toward a lower portion of the internal housing to extrude an elastomer disposed between the upper and lower portions to seal the holding member assembly with the subsea housing. The extendible portion is dogged to the upper portion or the lower portion of the internal housing depending on the position of the extendible portion.

In one embodiment, a running tool is used for moving the rotating control head assembly with the subsea housing and is also used to remotely engage the holding member with the subsea housing.

In one embodiment, a pressure compensation assembly pressurizes lubricants in the bearing assembly at a predetermined pressure amount in excess of the higher of the subsea housing pressure above the seal or below the seal.

BRIEF DESCRIPTION OF THE SEVERAL VIEWS OF THE DRAWINGS

A better understanding of the present invention can be obtained when the following detailed description of the disclosed embodiments is considered in conjunction with the following drawings, in which:

FIG. 8 is an enlarged detail section view of the holding member of FIGS. 4 and 6;

FIG. 9 is section view taken along line 9-9 of FIG. 8;

DETAILED DESCRIPTION OF THE INVENTION

Figure 2:
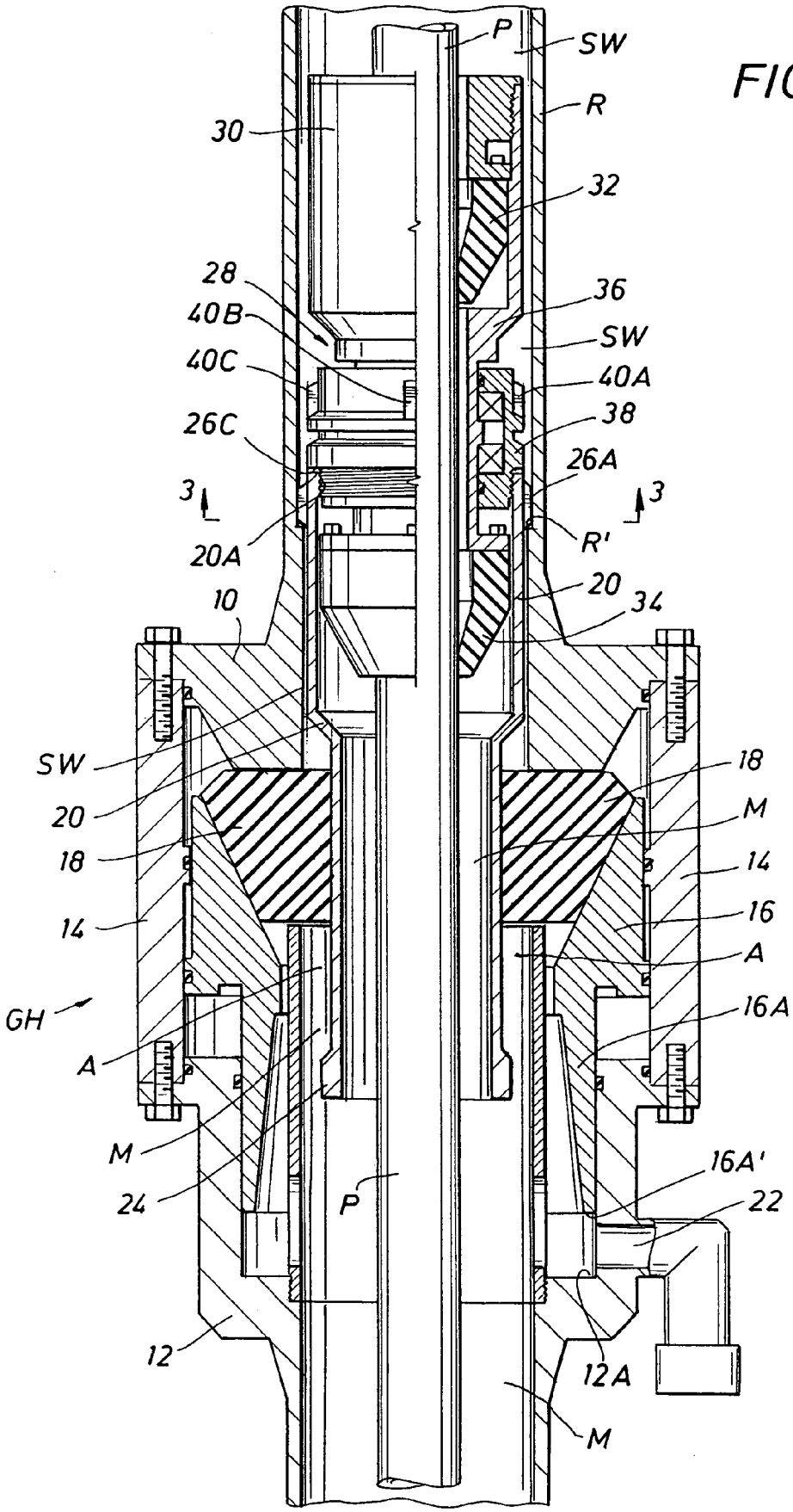
FIG. 2 is an elevation view of a blowout preventer in a sealed position to position an internal housing and bearing assembly of the present invention in the riser.

Turning to FIG. 2, the riser or upper tubular R is shown positioned above a gas handler annular blowout preventer, generally designated as GH. While a "HYDRIL" GH 21-2000 gas handler BOP or a "HYDRIL" GL series annular blowout handler could be used, ram type blowout preventers, such as Cameron U BOP, Cameron UII BOP or a Cameron T blowout preventer, available from Cooper Cameron Corporation of Houston, Tex., could be used. Cooper Cameron Corporation also provides a Cameron DL annular BOP. The gas handler annular blowout preventer GH includes an upper head 10 and a lower body 12 with an outer body or first or subsea housing 14 therebetween. A piston 16 having a lower wall 16A moves relative to the first housing 14 between a sealed position, as shown in FIG. 2, and an open position, where the piston moves downwardly until the end 16A' engages the shoulder 12A. In this open position, the annular packing unit or seal 18 is disengaged from the internal housing 20 of the present invention while the wall 16A blocks the gas handler discharge outlet 22. Preferably, the seal 18 has a height of 12 inches. While annular and ram type blowout preventers, with or without a gas handler discharge outlet, are disclosed, any seal to retractably seal about an internal housing to seal between a first housing and the internal housing is contemplated as covered by the present invention. The best type of retractable seal, with or without a gas handler outlet, will depend on the project and the equipment used in that project.

Figure 3:
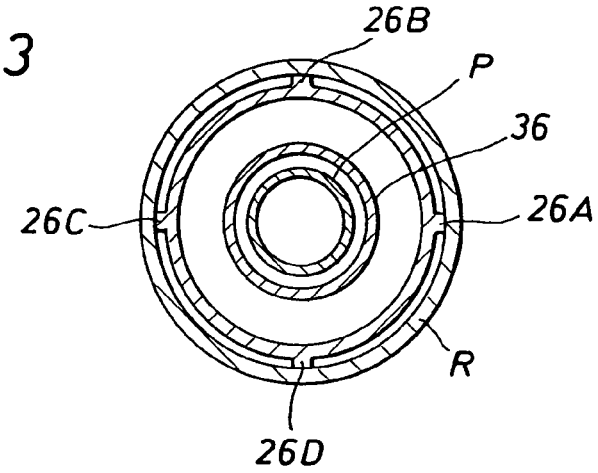
FIG. 3 is a section view taken along line 3-3 of FIG. 2.
Figure 10:
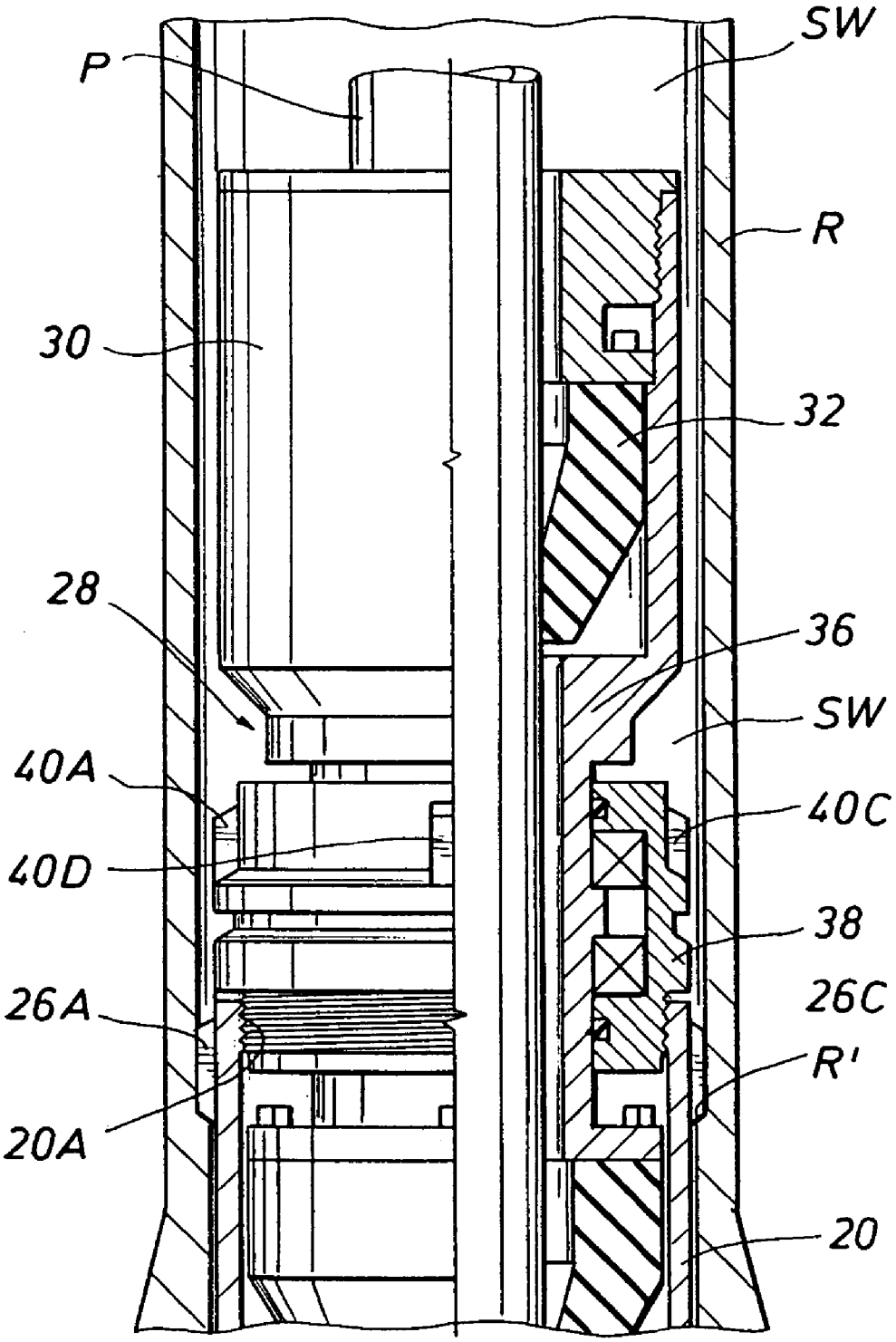
FIG. 10 is a reverse view of a portion of FIG. 2.

The internal housing 20 includes a continuous radially outwardly extending holding member 24 proximate to one end of the internal housing 20, as will be discussed below in detail. When the seal 18 is in the open position, it also provides clearance with the holding member 24. As best shown in FIGS. 8 and 9, the holding member 24 is preferably fluted with a plurality of bores or openings, like bore 24A, to reduce hydraulic surging and/or swabbing of the internal housing 20. The other end of the internal housing 20 preferably includes inwardly facing right-hand Acme threads 20A. As best shown in FIGS. 2, 3 and 10, the internal housing includes four equidistantly spaced lugs 26A, 26B, 26C, and 26D.

Figure 7:
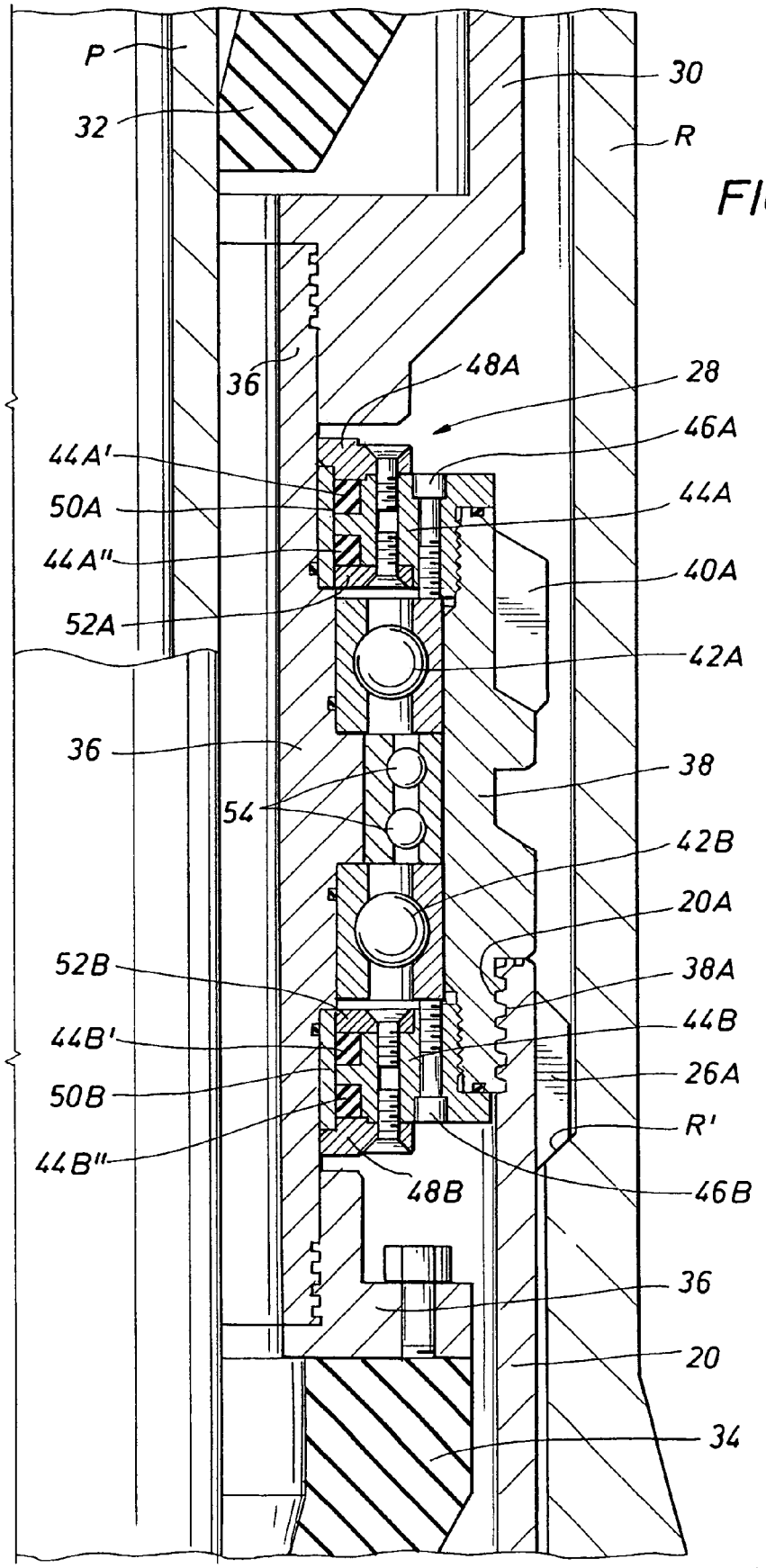
FIG. 7 is an enlarged section view of the bearing assembly of FIG. 4 illustrating a typical lug on the outer member of the bearing assembly and a typical lug on the internal housing engaging a shoulder of the riser.

As best shown in FIGS. 2 and 7, the bearing assembly, generally designated 28, is similar to the Weatherford-Williams Model 7875 rotating control head, now available from Weatherford International, Inc. of Houston, Tex. Alternatively, Weatherford-Williams Models 7000, 7100, IP-1000, 7800, 8000/9000 and 9200 rotating control heads, now available from Weatherford International, Inc., could be used. Preferably, a rotating control head with two spaced-apart seals is used to provide redundant sealing. The major components of the bearing assembly 28 are described in U.S. Pat. No. 5,662,181, now owned by Weatherford/Lamb, Inc. The '181 patent is incorporated herein by reference for all purposes. Generally, the bearing assembly 28 includes a top rubber pot 30 that is sized to receive a top stripper rubber or inner member seal 32. Preferably, a bottom stripper rubber or inner member seal 34 is connected with the top seal 32 by the inner member 36 of the bearing assembly 28. The outer member 38 of the bearing assembly 28 is rotatably connected with the inner member 36, as best shown in FIG. 7, as will be discussed below in detail.

The outer member 38 includes four equidistantly spaced lugs. A typical lug 40A is shown in FIGS. 2, 7, and 10, and lug 40C is shown in FIGS. 2 and 10. Lug 40B is shown in FIG. 2. Lug 40D is shown in FIG. 10. As best shown in FIG. 7, the outer member 38 also includes outwardly-facing right-hand Acme threads 38A corresponding to the inwardly-facing right-hand Acme threads 20A of the internal housing 20 to provide a threaded connection between the bearing assembly 28 and the internal housing 20.

Three purposes are served by the two sets of lugs 40A, 40B, 40C, and 40D on the bearing assembly 28 and lugs 26A, 26B, 26C and 26D on the internal housing 20. First, both sets of lugs serve as guide/wear shoes when lowering and retrieving the threadedly connected bearing assembly 28 and internal housing 20, both sets of lugs also serve as a tool backup for screwing the bearing assembly 28 and housing 20 on and off, lastly, as best shown in FIGS. 2 and 7, the lugs 26A, 26B, 26C and 26D on the internal housing 20 engage a shoulder R' on the upper tubular or riser R to block further downward movement of the internal housing 20, and, therefore, the bearing assembly 28, through the bore of the blowout preventer GH. The Model 7875 bearing assembly 28 preferably has an 8¾" internal diameter bore and will accept tool joints of up to 8½" to 8⅝", and has an outer diameter of 17" to mitigate surging problems in a 19½" internal diameter marine riser R. The internal diameter below the shoulder R' is preferably 18¾". The outer diameter of lugs 40A, 40B, 40C and 40D and lugs 26A, 26B, 26C and 26D are preferably sized at 19" to facilitate their function as guide/wear shoes when lowering and retrieving the bearing assembly 28 and the internal housing 20 in a 19½" internal diameter marine riser R.

Returning again to FIGS. 2 and 7, first, a rotatable pipe P can be received through the bearing assembly 28 so that both inner member seals 32 and 34 sealably engage the bearing assembly 28 with the rotatable pipe P. Secondly, the annulus A between the first housing 14 and the riser R and the internal housing 20 is sealed using seal 18 of the annular blowout preventer GH. These two sealings provide a desired barrier or seal in the riser R both when the pipe P is at rest and while rotating. In particular, as shown in FIG. 2, seawater or a fluid of one density SW could be maintained above the seal 18 in the riser R, and mud M, pressurized or not, could be maintained below the seal 18.

Figure 5:
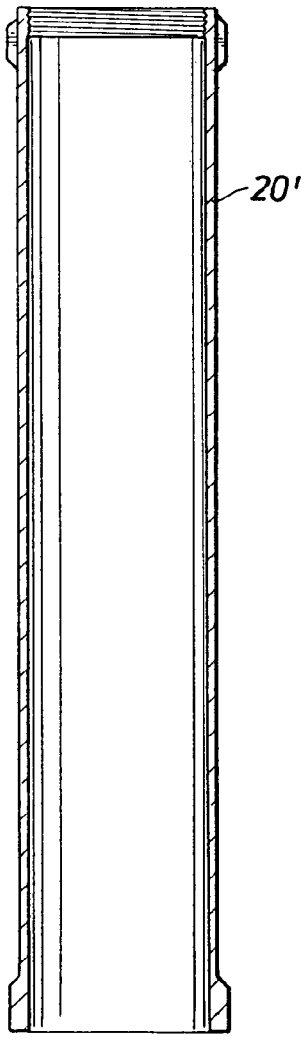
FIG. 5 is an elevation view of an embodiment of the internal housing.
Figure 6:
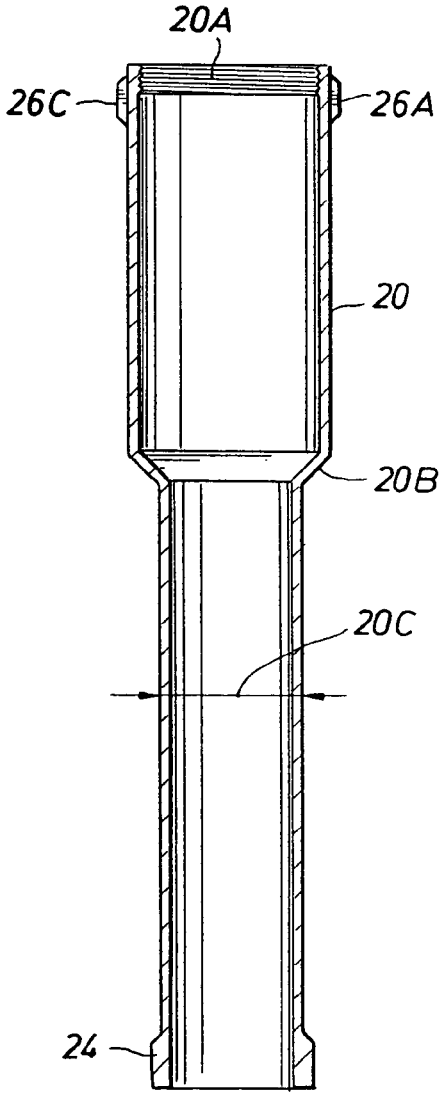
FIG. 6 is an elevation view of the embodiment of the step down internal housing of FIG. 4.

Turning now to FIG. 5, a cylindrical internal housing 20' could be used instead of the step-down internal housing 20 having a step down 20B to a reduced diameter 20C of 14", as best shown in FIGS. 2 and 6. Both of these internal housings 20 and 20' can be of different lengths and sizes to accommodate different blowout preventers selected or available for use. Preferably, the blowout preventer GH, as shown in FIG. 2, could be positioned in a predetermined elevation between the wellhead W and the rig floor F. In particular, it is contemplated that an optimized elevation of the blowout preventer could be calculated, so that the separation of the mud M, pressurized or not, from seawater or gas-cut mud SW would provide a desired initial hydrostatic pressure in the open borehole, such as the borehole B, shown in FIG. 4. This initial pressure could then be adjusted by pressurizing or gas-cutting the mud M.

Figure 4:
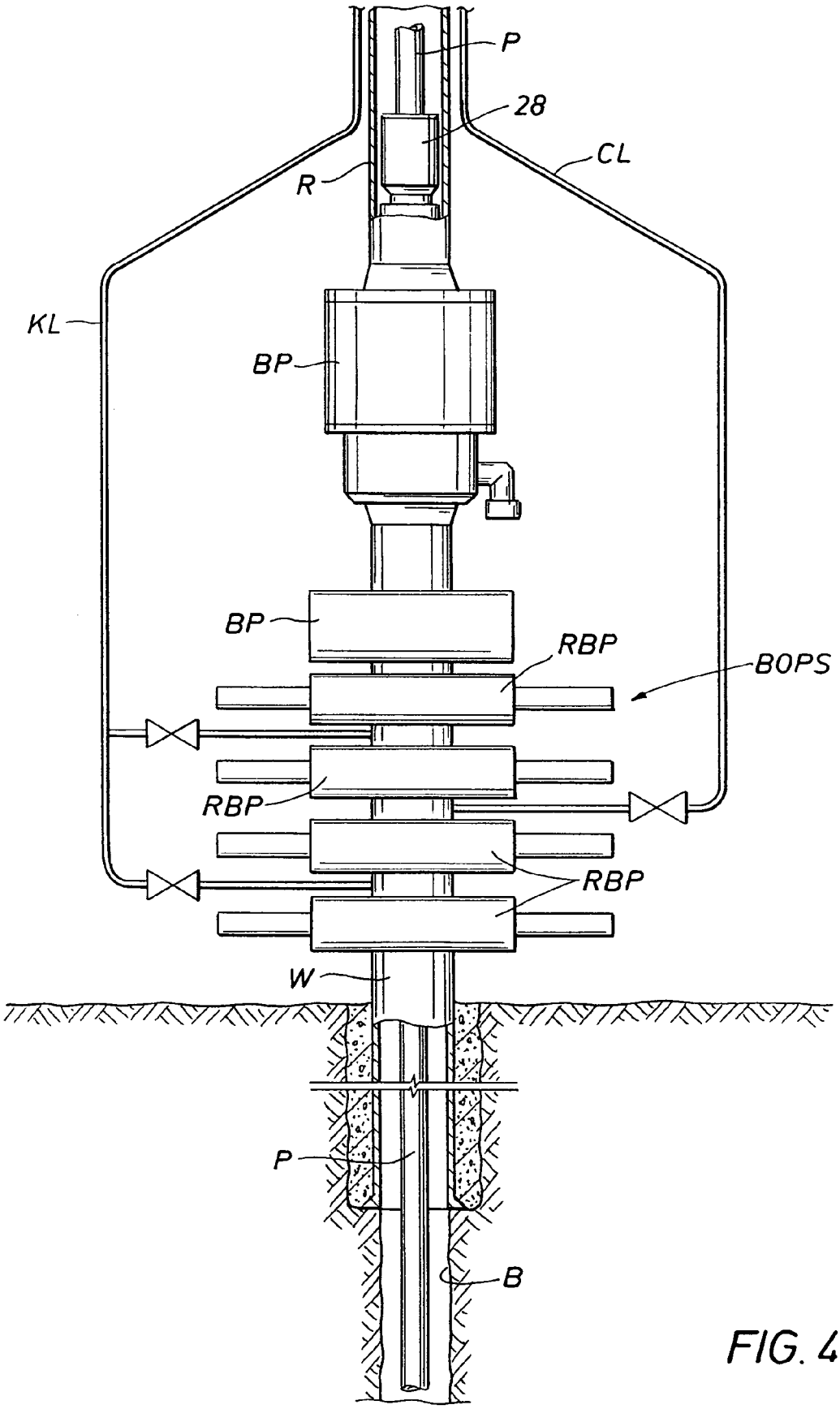
FIG. 4 is an enlarged elevation view of a blowout preventer stack positioned above a wellhead, similar to the lower portion of FIG. 1, but with an internal housing and bearing assembly positioned in a blowout preventer communicating with the top of the blowout preventer stack and a rotatable pipe extending through the bearing assembly and internal housing of the present invention and into an open borehole.

Turning now to FIG. 4, the blowout preventer stack, generally designated BOPS, is in fluid communication with the choke line CL and the kill line KL connected between the desired ram blowout preventers RBP in the blowout preventer stack BOPS, as is known by those skilled in the art. In the embodiment shown in FIG. 4, two annular blowout preventers BP are positioned above the blowout preventer stack BOPS between a lower tubular or wellhead W and the upper tubular or riser R. Similar to the embodiment shown in FIG. 2, the threadedly connected internal housing 20 and bearing assembly 28 are positioned inside the riser R by moving the annular seal 18 of the top annular blowout preventer BP to the sealed position. As shown in FIG. 4, the annular blowout preventer BP does not include a gas handler discharge outlet 22, as shown in FIG. 2. While an annular blowout preventer with a gas handler outlet could be used, fluids could be communicated without an outlet below the seal 18, to adjust the fluid pressure in the borehole B, by using either the choke line CL and/or the kill line KL.

Turning now to FIG. 7, a detail view of the seals and bearings for the Model 7875 Weatherford-Williams rotating control head, now sold by Weatherford International, Inc., of Houston, Tex., is shown. The inner member or barrel 36 is rotatably connected to the outer member or barrel 38 and preferably includes 9000 series tapered radial bearings 42A and 42B positioned between a top packing box 44A and a bottom packing box 44B. Bearing load screws, similar to screws 46A and 46B, are used to fasten the top plate 48A and bottom plate 48B, respectively, to the outer barrel 38. Top packing box 44A includes packing seals 44A' and 44A" and bottom packing box 44B includes packing seals 44B' and 44B" positioned adjacent respective wear sleeves 50A and 50B. A top retainer plate 52A and a bottom retainer plate 52B are provided between the respective bearing 42A and 42B and packing box 44A and 44B. Also, two thrust bearings 54 are provided between the radial bearings 42A and 42B.

As can now be seen, the internal housing 20 and bearing assembly 28 of the present invention provide a barrier in a subsea housing 14 while drilling that allows a quick rig up and release using a conventional upper tubular or riser R. In particular, the barrier can be provided in the riser R while rotating pipe P, where the barrier can relatively quickly be installed or tripped relative to the riser R, so that the riser could be used with underbalanced drilling, a dual density system, or any other drilling technique that could use pressure containment.

In particular, the threadedly assembled internal housing 20 and the bearing assembly 28 could be run down the riser R on a standard drill collar or stabilizer (not shown) until the lugs 26A, 26B, 26C and 26D of the assembled internal housing 20 and bearing assembly 28 are blocked from further movement upon engagement with the shoulder R' of riser R. The fixed preferably radially continuous holding member 24 at the lower end of the internal housing 20 would be sized relative to the blowout preventer so that the holding member 24 is positioned below the seal 18 of the blowout preventer. The annular or ram type blowout preventer, with or without a gas handler discharge outlet 22, would then be moved to the sealed position around the internal housing 20 so that a seal is provided in the annulus A between the internal housing 20 and the subsea housing 14 or riser R. As discussed above, in the sealed position the gas handler discharge outlet 22 would then be opened so that mud M below the seal 18 can be controlled while drilling with the rotatable pipe P sealed by the preferred internal seals 32 and 34 of the bearing assembly 28. As also discussed above, if a blowout preventer without a gas handler discharge outlet 22 were used, the choke line CL, kill line KL or both could be used to communicate fluid, with the desired pressure and density, below the seal 18 of the blowout preventer to control the mud pressure while drilling.

Because the present invention does not require any significant riser or blowout preventer modifications, normal rig operations would not have to be significantly interrupted to use the present invention. During normal drilling and tripping operations, the assembled internal housing 20 and bearing assembly 28 could remain installed and would only have to be pulled when large diameter drill string components were tripped in and out of the riser R. During short periods when the present invention had to be removed, for example, when picking up drill collars or a bit, the blowout preventer stack BOPS could be closed as a precaution with the diverter D and the gas handler blowout preventer GH as further backup in the event that gas entered the riser R.

Figure 1:
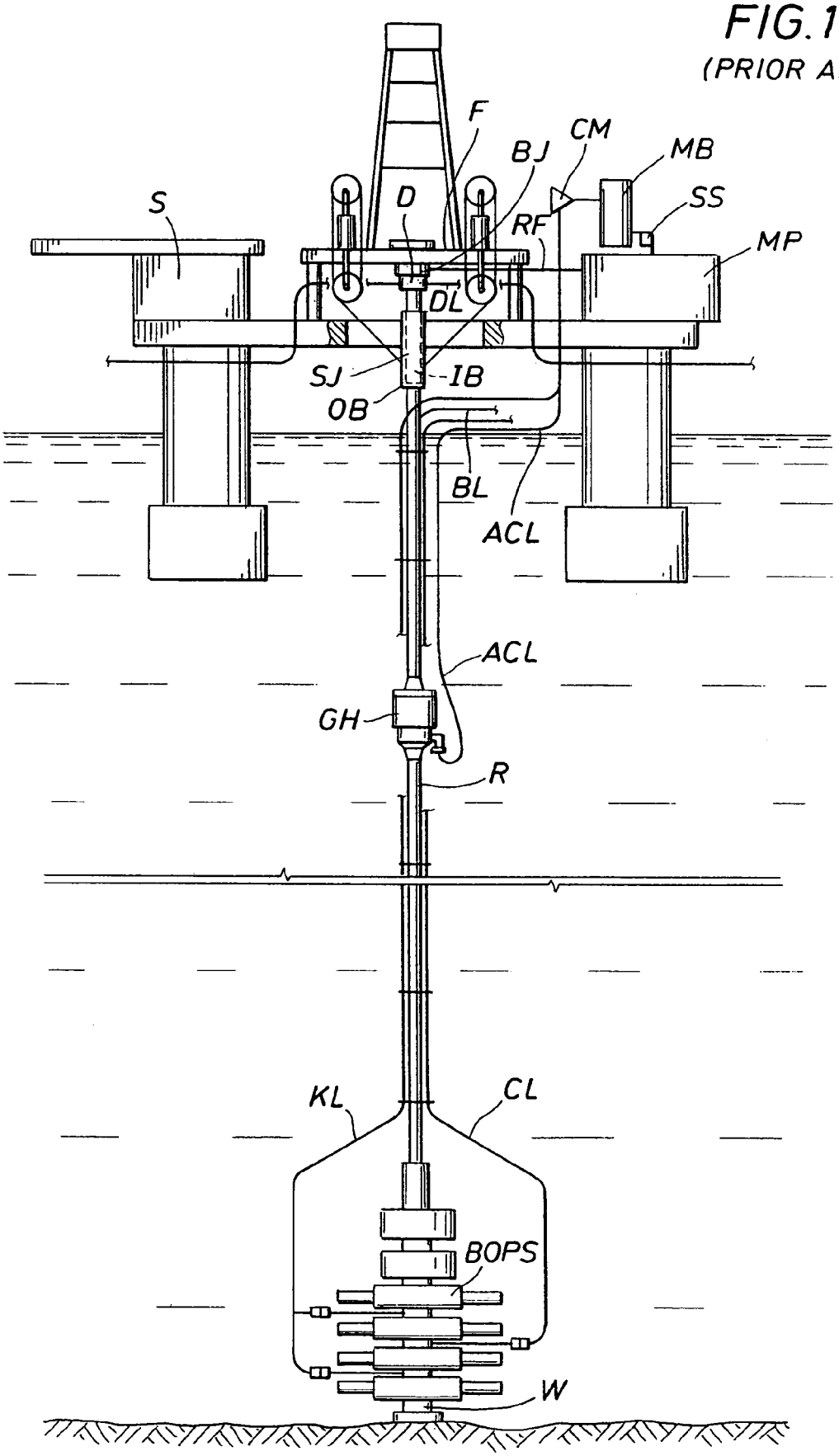
FIG. 1 (PRIOR ART)
FIG. 1 is an elevation view of a prior art floating rig mud return system, shown in broken view, with the lower portion illustrating the conventional subsea blowout preventer stack attached to a wellhead and the upper portion illustrating the conventional floating rig, where a riser having a conventional blowout preventer is connected to the floating rig.

As best shown in FIGS. 1, 2 and 4, if the gas handler discharge outlet 22 were connected to the rig S choke manifold CM, the mud returns could be routed through the existing rig choke manifold CM and gas handling system. The existing choke manifold CM or an auxiliary choke manifold (not shown) could be used to throttle mud returns and maintain the desired pressure in the riser below the seal 18 and, therefore, the borehole B.

As can now also be seen, the present invention along with a blowout preventer could be used to prevent a riser from venting mud or gas onto the rig floor F of the rig S. Therefore, the present invention, properly configured, provides a riser gas control function similar to a diverter D or gas handler blowout preventer GH, as shown in FIG. 1, with the added advantage that the system could be activated and in use at all times—even while drilling.

Because of the deeper depths now being drilled offshore, some even in ultra deep water, tremendous volumes of gas are required to reduce the density of a heavy mud column in a large diameter marine riser R. Instead of injecting gas into the riser R, as described in the Background of the Invention, a blowout preventer can be positioned in a predetermined location in the riser R to provide the desired initial column of mud, pressurized or not, for the open borehole B since the present invention now provides a barrier between the one fluid, such as seawater, above the seal 18 of the subsea housing 14, and mud M, below the seal 18. Instead of injecting gas into the riser above the seal 18, gas is injected below the seal 18 via either the choke line CL or the kill line KL, so less gas is required to lower the density of the mud column in the other remaining line, used as a mud return line.

Figure 11:
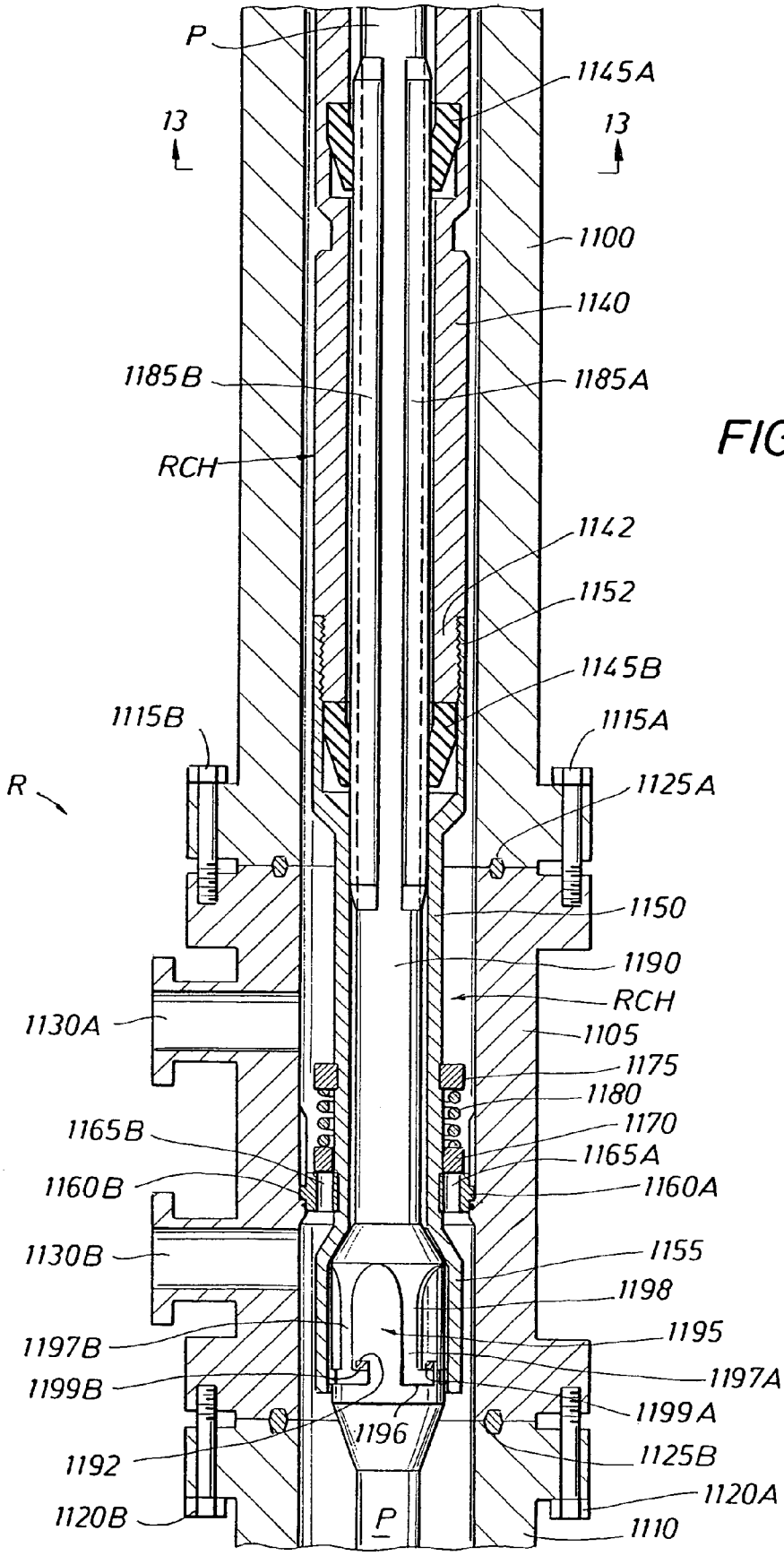
FIG. 11 is an elevation view of one embodiment of a system for positioning a rotating control head in a marine riser with a running tool attached to a holding member assembly.

Turning now to FIG. 11, an elevation view of one embodiment for positioning a rotating control head in a marine riser R is shown. As shown in FIG. 11, the marine riser R is comprised of three sections, an upper tubular 1100, a subsea housing 1105, and a lower body 1110. The lower body 1110 can be an apparatus for attaching at a borehole, such as a wellhead W, or lower tubular similar to the upper tubular 1100, at the desire of the driller. The subsea housing 1105 is typically connected to the upper tubular by a plurality of equidistantly spaced bolts, of which exemplary bolts 1115A and 1115B are shown. In one embodiment, four bolts are used. Further, the upper tubular 1100 and the subsea housing 1105 are typically sealed with an O-ring 1125A of a suitable substance.

Likewise, the subsea housing 1105 is typically connected to the lower body 1110 using a plurality of equidistantly spaced bolts, of which exemplary bolts 1120A and 1120B are shown. In one embodiment, four bolts are used. Further, the subsea housing 1105 and the lower body 1110 are typically sealed with an O-ring 1125B of a suitable substance. However, the technique for connecting and sealing the subsea housing 1105 to the upper tubular 1100 and the lower body 1110 are not material to the disclosure and any suitable connection or sealing technique known to those of ordinary skill in the art can be used.

The subsea housing 1105 typically has at least one opening 1130A above the surface that the rotating control head assembly RCH is sealed to the subsea housing 1105, and at least one opening 1130B below the sealing surface. By sealing the rotating control head between the opening 1130A and the opening 1130B, circulation of fluid on one side of the sealing surface can be accomplished independent of circulation of fluid on the other side of the sealing surface which is advantageous in a dual-density drilling configuration. Although two spaced-apart openings in the subsea housing 1105 are shown in FIG. 11, other openings and placement of openings can be used.

In a disclosed embodiment, the rotating control head assembly RCH is constructed from a bearing assembly 1140 and a holding member assembly 1150. The internal structure of the bearing assembly 1140 can be as shown in FIGS. 2, 7, and 10, although other bearing assembly 1140 configurations, including those discussed below in detail, can be used.

As shown in FIG. 11, the bearing assembly 1140 has an interior passage for extending rotatable pipe P therethrough and uses two stripper rubbers 1145A and 1145B for sealingly engaging the rotatable pipe P. Stripper rubber seals as shown in FIG. 11 are examples of passive seals, in that they are stretch-fit and cone shape vector forces augment a closing force of the seal around the rotatable pipe P. In addition to passive seals, active seals can be used. Active seals typically require a remote-to-the-tool source of hydraulic or other energy to open or close the seal. An active seal can be deactivated to reduce or eliminate sealing forces with the rotatable pipe P. Additionally, when deactivated, an active seal allows annulus fluid continuity up to the top of the rotating control head assembly RCH. One example of an active seal is an inflatable seal. The Shaffer Type 79 Rotating Blowout Preventer from Varco International, Inc., the RPM SYSTEM 3000™ from TechCorp Industries International Inc., and the Seal-Tech Rotating Blowout Preventer from Seal-Tech are three examples of rotating blowout preventers that use a hydraulically operated active seal. Co-pending U.S. patent application Ser. No. 09/911,295, filed Jul. 23, 2001, entitled "Method and System for Return of Drilling Fluid from a Sealed Marine Riser to a Floating Drilling Rig While Drilling," and assigned to the assignee of this application, discloses active seals and is incorporated in its entirety herein by reference for all purposes. U.S. Pat. Nos. 3,621,912, 5,022,472, 5,178,215, 5,224,557, 5,277,249, 5,279,365, and 6,450,262B1 also disclose active seals and are incorporated in their entirety herein by reference for all purposes.

Figure 35:
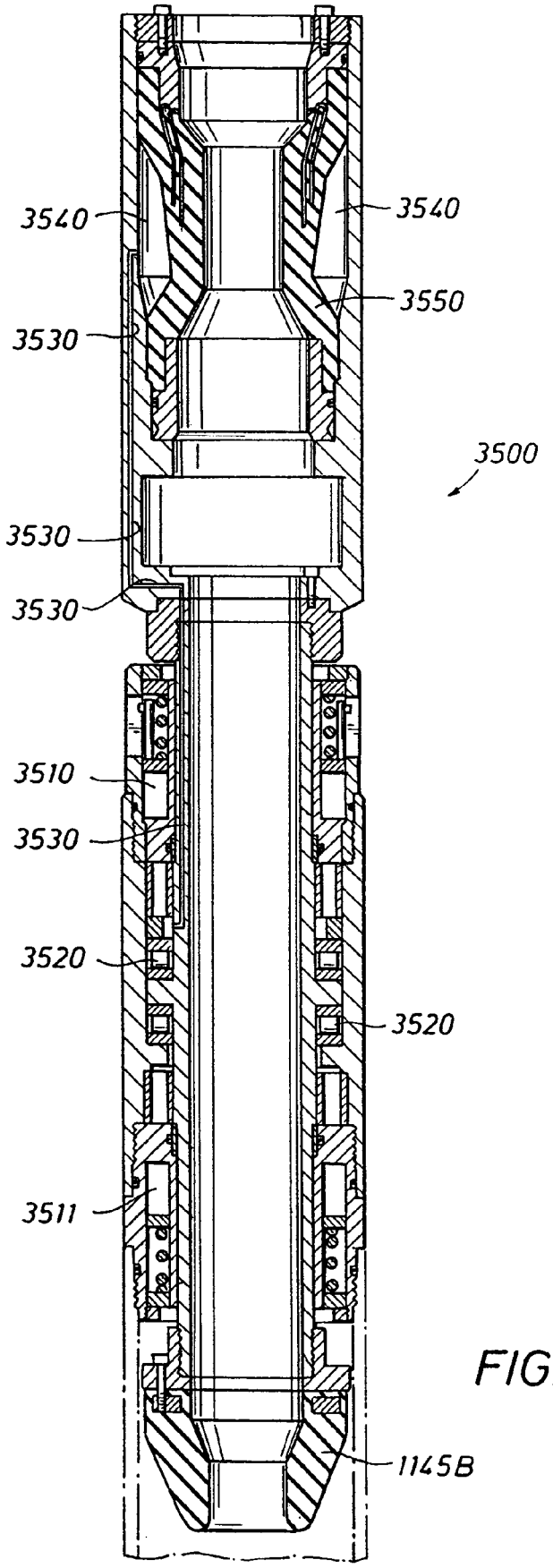
FIG. 35 is an elevation view of an alternative embodiment of a bearing assembly.

FIG. 35 is an elevation view of a bearing assembly 3500 with one embodiment of an active seal. The bearing assembly 3500 can be placed on the rotatable pipe, such as pipe P in FIG. 11, on a rig floor. The lower passive seal 1145B holds the bearing assembly 3500 on the rotatable pipe while the bearing assembly 3500 is being lowered into the marine riser R. As the bearing assembly 3500 is lowered deeper into the water or TIH, the pressure in the accumulators 3510 and 3511 increase. Lubricant, such as oil, is transferred from the accumulators 3510 and 3511 through the bearings 3520, and through a communication port 3530 into an annular chamber 3540 behind the active seal 3550. As the pressure behind the active seal 3550 increases, the active seal 3550 moves radially onto the rotatable pipe creating a seal. As the rotatable pipe is pulled through the active seal 3550, tool joints will enter the active seal 3550 creating a piston pump effect, due to the increased volume of the tool joint. As a result, the lubricant behind the active seal 3550 in the annular chamber 3540 is forced back though the communication port 3530 into the bearings 3520 and finally into the accumulators 3510 and 3511. After use, the bearing assembly 3500 can be retrieved or POOH though the marine riser R. As the water depth decreases, the amount of pressure exerted by the accumulators 3510 and 3511 on the active seal 3550 decreases, until there is no pressure exerted by the active seal 3550 at the surface. In another embodiment, additional hydraulic connections can be used to provide increased pressure in the accumulators 3510 and 3511. It is also contemplated that a remote operated vehicle (ROV) could be used to activate and deactivate the active seal 3550.

Other types of active seals are also contemplated for use. A combination of active and passive seals can also be used.

The bearing assembly 1140 is connected to the holding member assembly 1150 in FIG. 11 by threading section 1142 of the bearing assembly 1140 to section 1152 of the holding member assembly 1150, similar to the threading discussed above. However, any convenient technique for connecting the holding member assembly to the bearing member assembly known to those of ordinary skill in the art can be used.

As shown in FIG. 11, a running tool 1190 is used for tripping the rotating control head assembly RCH into and out of the marine riser R. A bell-shaped lower portion 1155 of the holding member assembly 1150 is shaped to receive a bell-shaped portion 1195 of the running tool 1190. During insertion or extraction of the rotating control head assembly RCH, the running tool 1190 and the holding member assembly 1150 are latched together using a passive latching technique. A plurality of passive latching members is formed in the bell-shaped lower portion 1155 of the holding member assembly 1150. Two of these passive latching members are shown in FIG. 11 as lugs 1199A and 1199B. In one embodiment, four passive latching members are used. However, any desired number of passive latching members can be used, spaced around the circumference of the holding member bell-shaped section 1155.

Corresponding to the passive latching members, the running tool 1190 bell-shaped portion 1195 uses a plurality of passive formations to engage with and latch with the passive latching members. Two such passive formations 1197A and 1197B are shown in FIG. 11, latched with passive latching members 1199A and 1199B, respectively. In one embodiment, four such passive formations are used. Each of the passive formations is a generally J-shaped indentation in the bell-shaped portion 1195. A vertical portion 1198 of each of the passive formations mates with one of the passive latching members when the running tool 1190 is vertically inserted from beneath the holding member assembly 1150. Rotation of the holding member assembly 1150 may be required to properly align the passive latching members with the passive formations. Conventionally, the rotatable pipe P of a drill string is rotated clockwise for drilling. Upon full insertion of the running tool 1190 into the holding member assembly 1150, the running tool 1190 is rotated clockwise, to move the passive latching members into the horizontal section 1196 of the passive formations. The passive latching member 1199A is further secured in a vertical section 1192, which requires an additional vertical movement for engaging and disengaging the running tool 1190 with the bell-shaped portion 1155 of the holding member assembly 1150.

After latching, the running tool 1190 can be connected to the rotatable pipe P of the drill string (not shown) for insertion of the rotating control head assembly RCH into the marine riser R. Upon positioning of the holding member assembly 1150, as described below, the running tool 1190 can be rotated in a counterclockwise direction to disengage the running tool 1190, which can then be moved downwardly with the rotatable pipe P of the drill string, as is shown in FIG. 12.

When the running tool 1190 has positioned the holding member assembly 1150, a drill operator will note that "weight on bit" has decreased significantly. The drill operator will also be aware of where the running tool 1190 is relative to the subsea housing by number of feet of drill pipe P in the drill string that has been lowered downhole. In this embodiment, the drill operator can rotate the running tool 1190 counterclockwise upon recognizing the running tool 1190 and rotating control head assembly RCH are latched in place, as discussed above, to disengage the running tool 1190 from the holding member assembly 1150, then continue downward movement of the running tool 1190.

Figure 12:
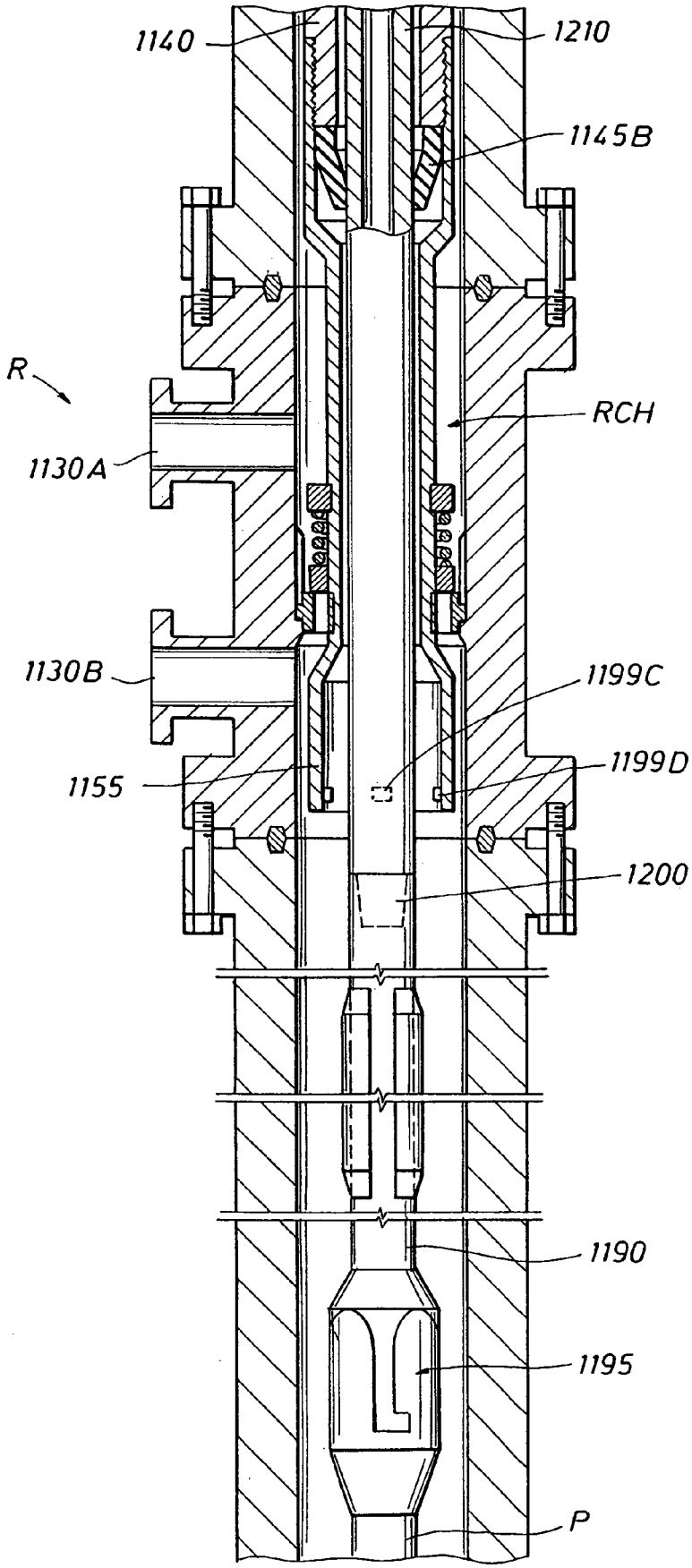
FIG. 12 is an elevation view of the embodiment of FIG. 11, showing the running tool extending below the holding member assembly after latching an internal housing with a subsea housing.

FIG. 12 shows the running tool 1190 extended below the holding member assembly 1150 when latched to the subsea housing 1105, as will be discussed below in detail. Additionally shown are passive latching members 1199C (in phantom) and 1199D. One skilled in the art will recognize that the number of passive latching members can vary.

Because the running tool 1190 has been extended downwardly in FIG. 12, the stripper rubber 1145B is shown in a sealed position, sealing the bearing assembly 1140 to a section of rotatable pipe 1210, which is connected to the running tool 1190 at a connection point 1200, shown as a threaded connection in phantom. One skilled in the art will recognize other connection techniques can be used.

FIGS. 11, 12, 19, 20B, 21B, 22B, and 23B assume that the drilling procedure rotates the drill string in a clockwise direction. If the drilling procedure rotates the drill string in a counterclockwise direction, then the orientation of the J-shaped passive formations 1197A and 1197B can be reversed.

Figure 16:
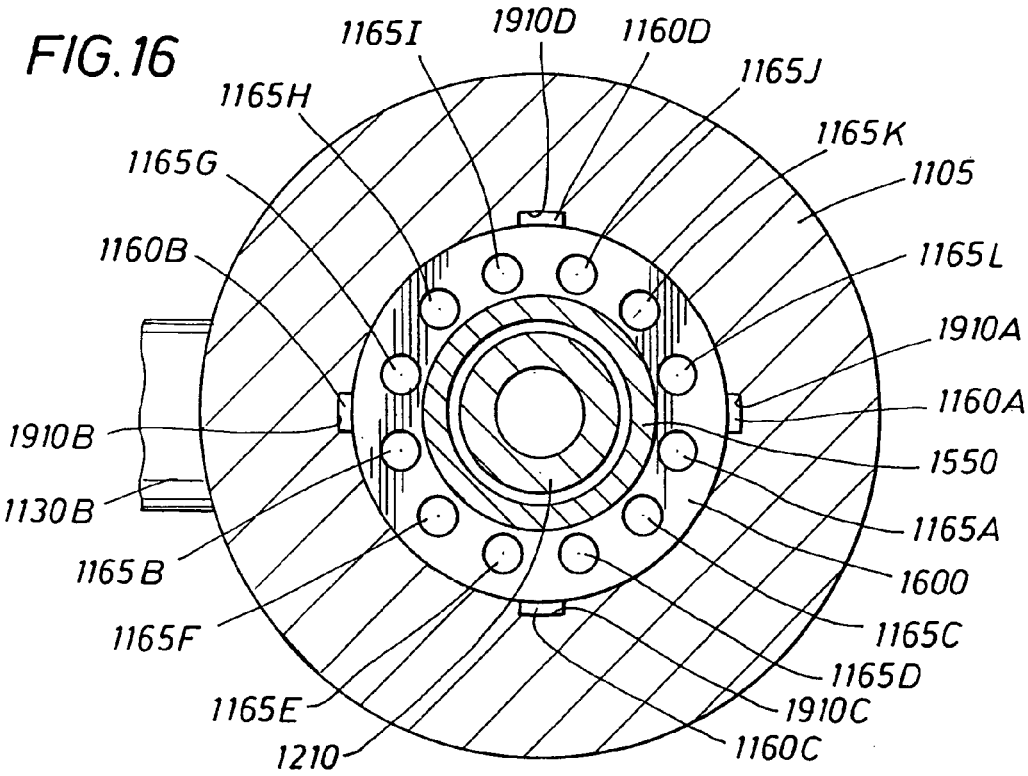
FIG. 16 is a section view taken along line 16-16 of FIG. 15.
Figure 19:
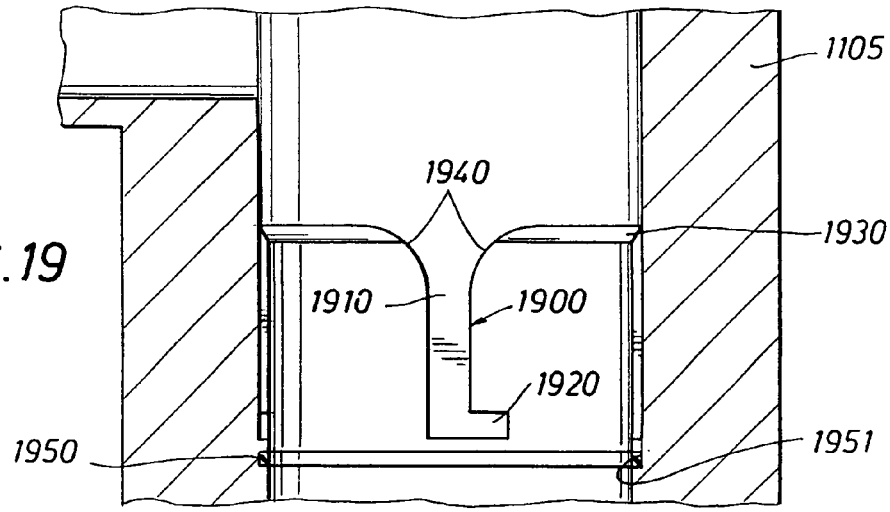
FIG. 19 is a detail elevation view of the subsea housing of FIGS. 11, 12, and 15-18 showing a passive latching formation of the subsea housing for engaging with the passive latching member of the internal housing.

Additionally, as best shown in FIGS. 16 and 19, a passive latching technique allows latching the holding member assembly 1150 to the subsea housing 1105. A plurality of passive holding members of the holding member assembly 1150 engage with a plurality of passive internal formations of the subsea housing 1105, not visible in detail in FIG. 11. Two such passive holding members 1160A and 1160B are shown in FIG. 11. In one embodiment, as shown in FIG. 16 four such passive holding members 1160A, 1160B, 1160C, and 1160D and passive internal formations are used.

FIG. 19 is a detail elevation view of a portion of an inner surface of the subsea housing 1105 showing a typical passive internal formation 1900 providing a profile, in the form of a J-shaped indentation in a reduced diameter section 1930 of the subsea housing 1105. Identical passive internal formations are equidistantly spaced around the inner surface of the holding member assembly 1150. Each of the passive holding members of the holding member assembly 1150 engages a vertical section 1910 of the passive internal formation 1900, possibly requiring rotation to properly align with the vertical section 1910. A curved upper end 1940 of the vertical section 1910 allows easier alignment of the passive holding members with the passive internal formation 1900. Upon reaching the bottom of the vertical section 1910, rotation of the running tool 1190 rotates the holding member assembly 1150, causing each of the passive holding members to enter a horizontal section 1920 of the passive internal formation 1900, latching the holding member assembly 1150 to the subsea housing 1105. When extraction of the rotating control head assembly RCH is desired, rotation of the running tool 1190 will cause the passive holding members to align with the vertical section 1910, allowing upward movement and disengagement of the holding member assembly 1150 from the subsea housing 1105. A seal 1950, typically in the form of an O-ring, positioned in an interior groove 1951 of the housing 1105 seals the passive holding members 1160A, 1160B, 1160C, and 1160 D of the holding member assembly 1150 with the subsea housing 1105.

A pressure relief mechanism attached to the passive holding members 1160A, 1160B, 1160C, and 1160D allows release of borehole pressure if the borehole pressure exceeds the fluid pressure in the upper tubular 1100 by a predetermined pressure. A plurality of bores or openings 1165A, 1165B, 1165C, 1165D, 1165E, 1165F, 1165G, 1165H, 1165I, 1165J, 1165K, and 1165L, two of which are shown in FIG. 11 as 1165A and 1165B are normally closed by a spring-loaded valve 1170. In one embodiment, a bottom plate 1170 is biased against the bores by a coil spring 1180, secured in place by an upper member 1175. The spring 1180 is calibrated to allow the bottom plate 1170 to open the bores 1165A, 1165B, 1165C, 1165D, 1165E, 1165F, 1165C; 1165H, 11651, 1165J, 1165K, and 1165L at the predetermined pressure. The bores also provide for alleviation of surging during insertion of the rotating control head assembly RCH.

Swabbing during removal of the rotating control head assembly can be alleviated by using a plurality of spreader members on the outer surface of the running tool 1190, two of which are shown in FIG. 11 as spreader members 1185A and 1185A. These spreader members spread the stripper rubbers 1145A and 1145B. Also, the stripper rubbers can "burp" during removal of the rotating control head assembly, as described in more detail with respect to FIGS. 13 and 14.

Figure 13:
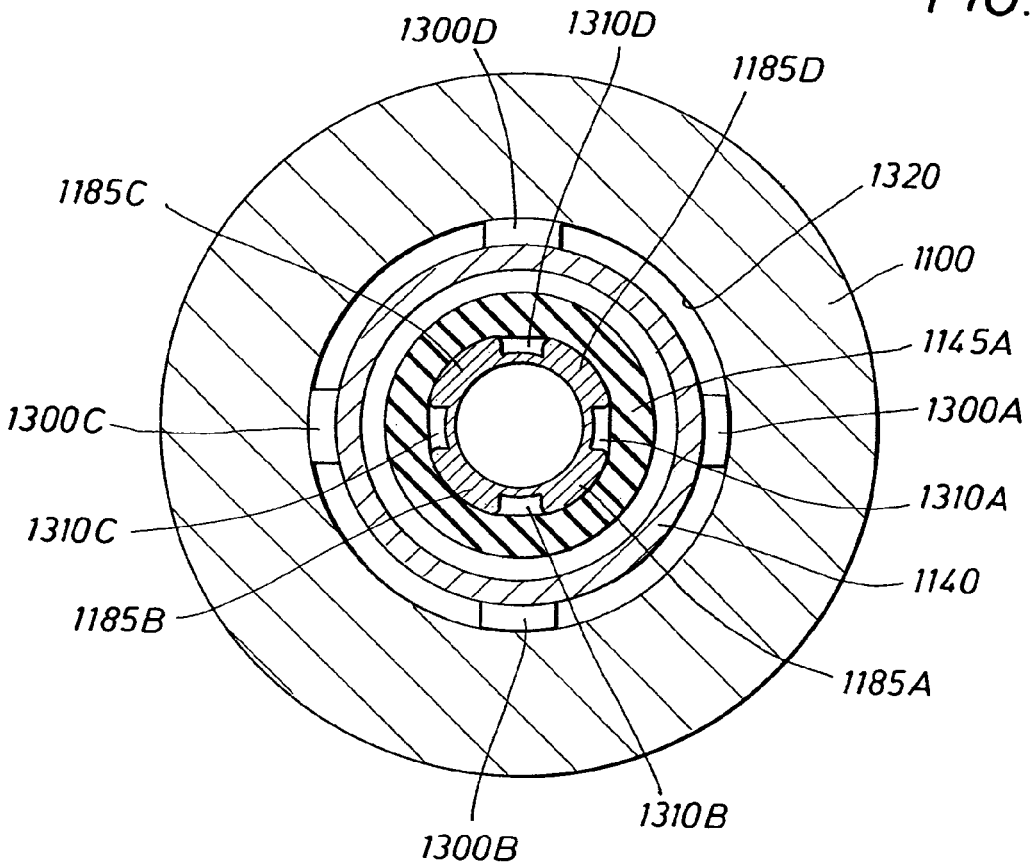
FIG. 13 is a section view taken along line 13-13 of FIG. 11.

Turning to FIG. 13, spreader members 1185C and 1185D, not visible in FIG. 11, are shown.

Also shown in FIG. 13, guide members 1300A, 1300B, 1300C, and 1300D are attached to an outer surface of the bearing assembly 1140, for centrally positioning the bearing assembly 1140 away from an inner surface 1320 of the upper tubular 1100. Guide members 1300A and 1300C are shown in elevation view in FIG. 14. As described above, the spreader members 1185 spread the stripper rubbers, allowing fluid passage through openings 1310A, 1310B, 1310C, and 1310D, which reduces surging and swabbing during insertion and removal of the rotating control head assembly RCH.

Figure 14:
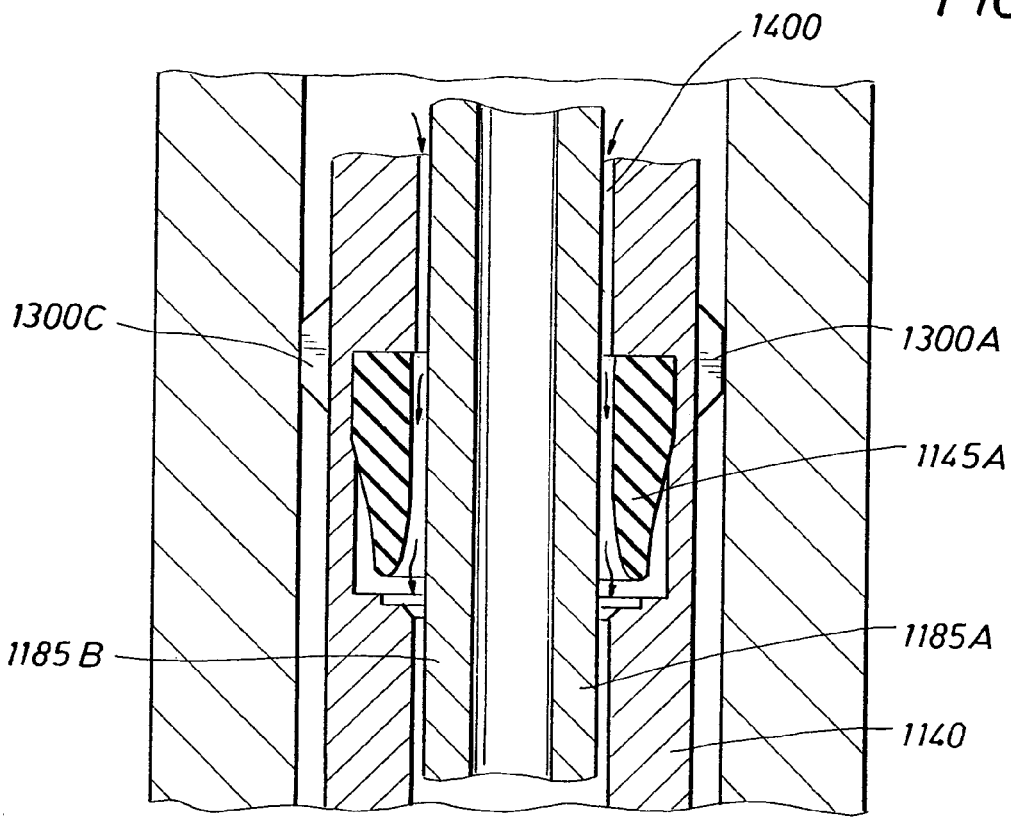
FIG. 14 is an enlarged elevation view of a lower stripper rubber of the rotating control head in a "burping" position.

Turning to FIG. 14, an elevation view shows "burping" of the stripper rubber 1145A, allowing additional fluid communication for reducing swabbing. A fluid passage 1400 allows fluid communication through the bearing assembly 1140. When sufficient fluid pressure builds, the stripper rubber 1145A, whether or not already spread by the spreader members 1185A and 1185B, can spread to "burp" fluid past the stripper rubber 1145A, reducing fluid pressure. A similar "burping" can occur with stripper rubber 1145B.

Figure 15:
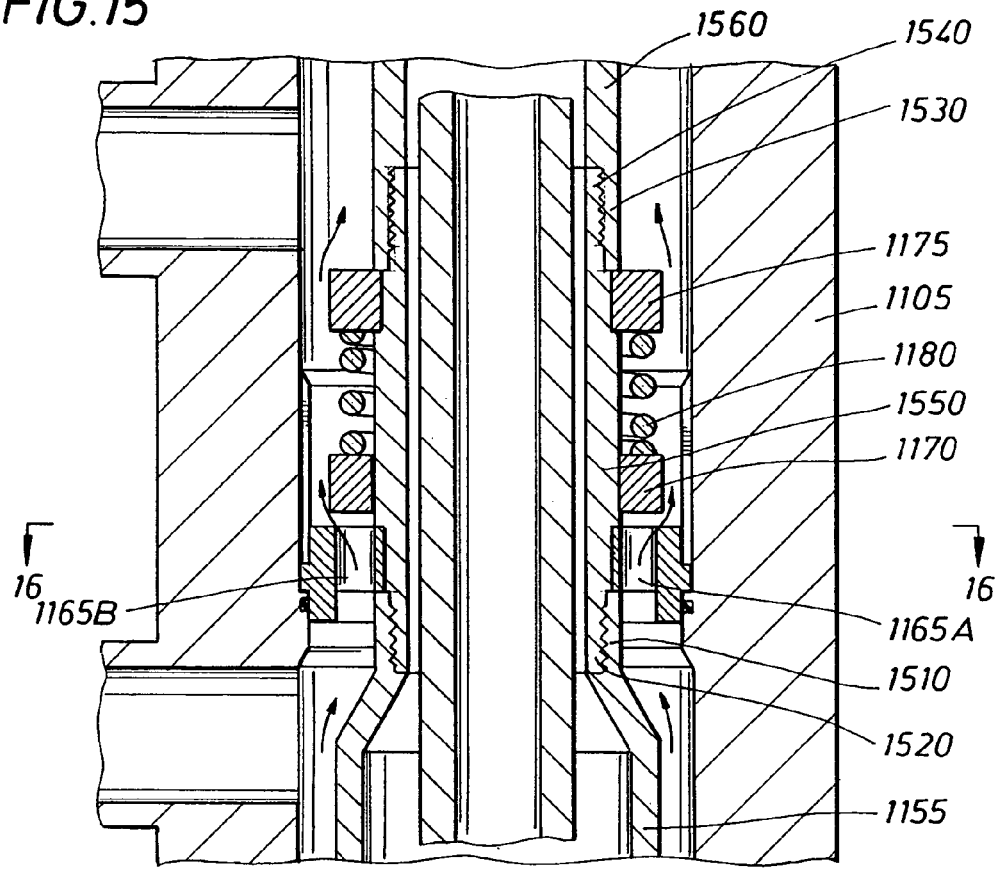
FIG. 15 is an enlarged elevation view of a pressure relief assembly of the embodiment of FIG. 11 in an open position.

Turning now to FIGS. 15, a detail elevation view of a pressure relief assembly, according to the embodiment of FIG. 11, is shown in an open position.

As shown in FIG. 15, a latching/pressure relief section 1550 is threadedly connected at location 1520 to a threaded section 1510 of the bell-shaped lower portion 1155 of the holding member assembly. Likewise, the latching/pressure relief section 1550 is threadedly connected at location 1540 to an upper portion 1560 of the holding member assembly 1150 at a threaded section 1530. Other attachment techniques can be used. The section 1550 can also be integrally formed with either or both of sections 1560 and 1155 as desired.

The bottom plate 1170 in FIG. 15 is shown opened for pressure relief away from the openings 1165A and 1165B, compressing the coil spring 1180 against annular upper member 1175. This allows fluid communication upwards from the borehole B to the upper tubular side of the subsea housing 1105, as shown by the arrows. Once the borehole pressure is reduced so the borehole pressure no longer exceeds the fluid pressure by the predetermined amount calibrated by the coil spring 1180, the spring 1180 will urge the annular bottom plate 1170 against the openings, closing the pressure relief assembly, as shown below in FIG. 17. Bottom plate 1170 is typically an annular plate concentrically and movably mounted on the latching/pressure relief section 1550. As noted above, the openings and the bottom plate 1170 also assist in reducing surging effects during insertion of the rotating control head assembly RCH.

FIG. 16 shows all the openings 1165A, 1165B, 1165C, 1165D, 1165E, 1165F, 1165G, 1165H, 1165I, 1165J, 1165K, and 1165L are visible in this section view, showing that the openings are equidistantly spaced around member 1600 into which are formed the passive holding members 1160A, 1160B, 1160C, and 1160D. Additionally, vertical sections 1910A, 1910B, 1910C, and 1910D of passive internal formations 1900 are shown equidistantly spaced around the subsea housing 1105 to receive the passive holding members. One skilled in the art will recognize that the number of openings 1165A-1165L is exemplary and illustrative and other numbers of openings could be used.

Figure 17:
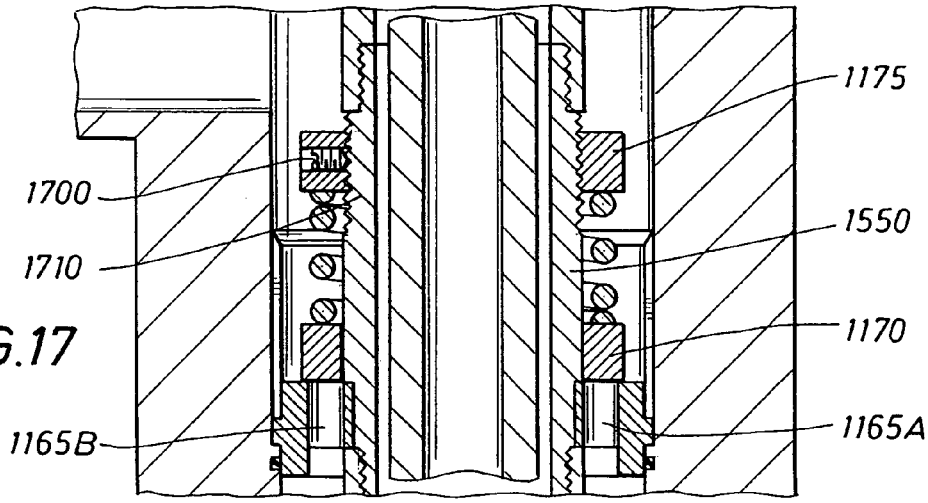
FIG. 17 is an elevation view of the pressure relief assembly of FIG. 15 in a closed position.

Turning to FIG. 17, a detail elevation view of the latching/pressure relief section 1550 of FIG. 15 is shown, with the bottom plate 1170 closing the openings 1165A to 1165L.

An alternative threaded section 1710 of the latching/pressure relief section 1550 is shown for threadedly connecting the upper member 1175 to the latching/pressure relief section 1550, allowing adjustable positioning of the upper member 1175. This adjustable positioning of threaded member 1175 allows adjustment of the pressure relief pressure. A setscrew 1700 can also be used to fix the position of the upper member 1175.

Figure 18:
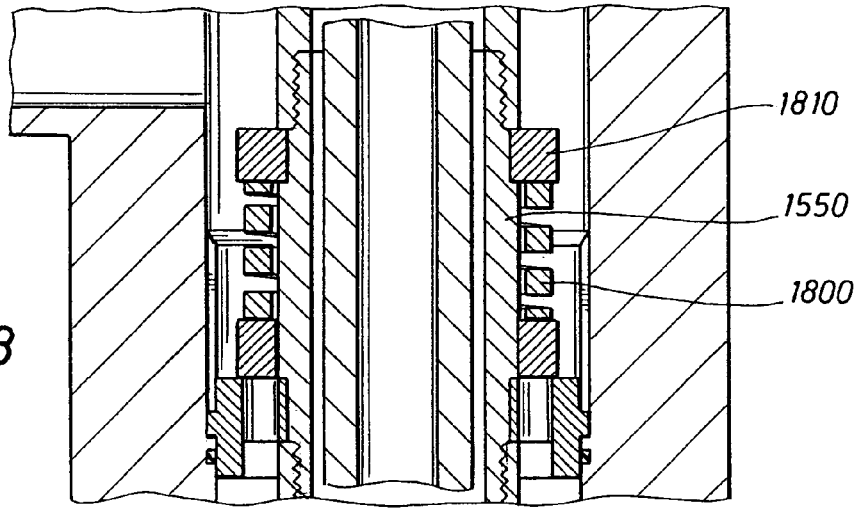
FIG. 18 is an elevation view of another embodiment of the pressure relief assembly in the closed position.

FIG. 18 shows another alternative embodiment of the latching/pressure relief section 1550, identical to that shown in FIG. 17, except that a different coil spring 1800 and a different upper member 1810 are shown. Spring 1800 can be a spring of a different tension than the spring 1180 of FIG. 11, allowing pressure relief at a different borehole pressure. Upper member 1810 attaches to section 1550 in a non-threaded manner, such as a snap ring, but otherwise functions identically to upper member 1175 of FIG. 17.

One skilled in the art will recognize that other techniques for attaching the upper member 1175 can be used. Further the springs 1180 of FIGS. 17 and 18 are exemplary and illustrative only and other types and configurations of springs 1180 can be used, allowing configuration of the pressure relief to a desired pressure.

Figure 20A:
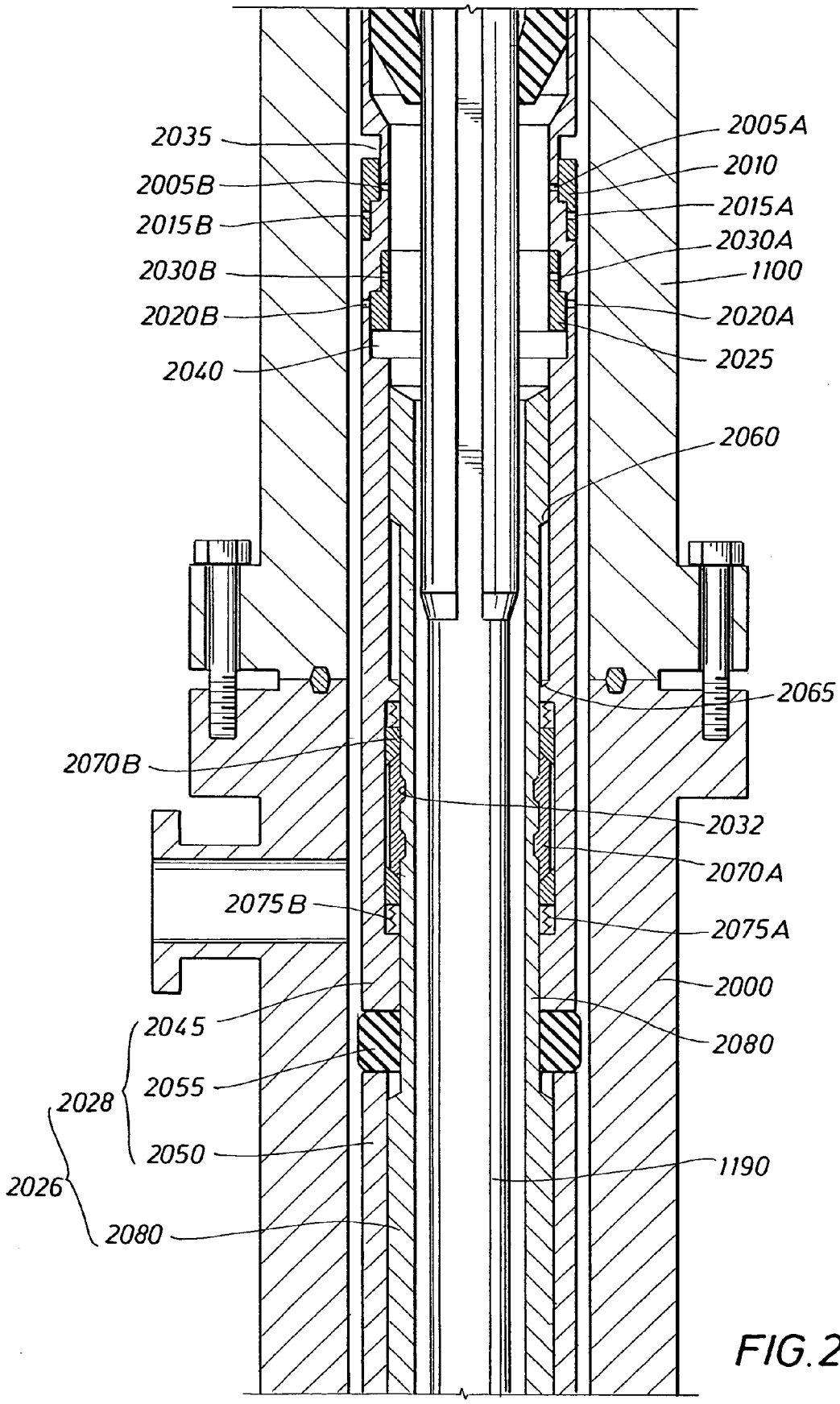
FIG. 20A is an elevation view of an upper section of another embodiment of a system for positioning a rotating control head in a marine riser showing a bi-directional pressure relief assembly in a closed position and an upper dog member in an engaged position.
Figure 20B:
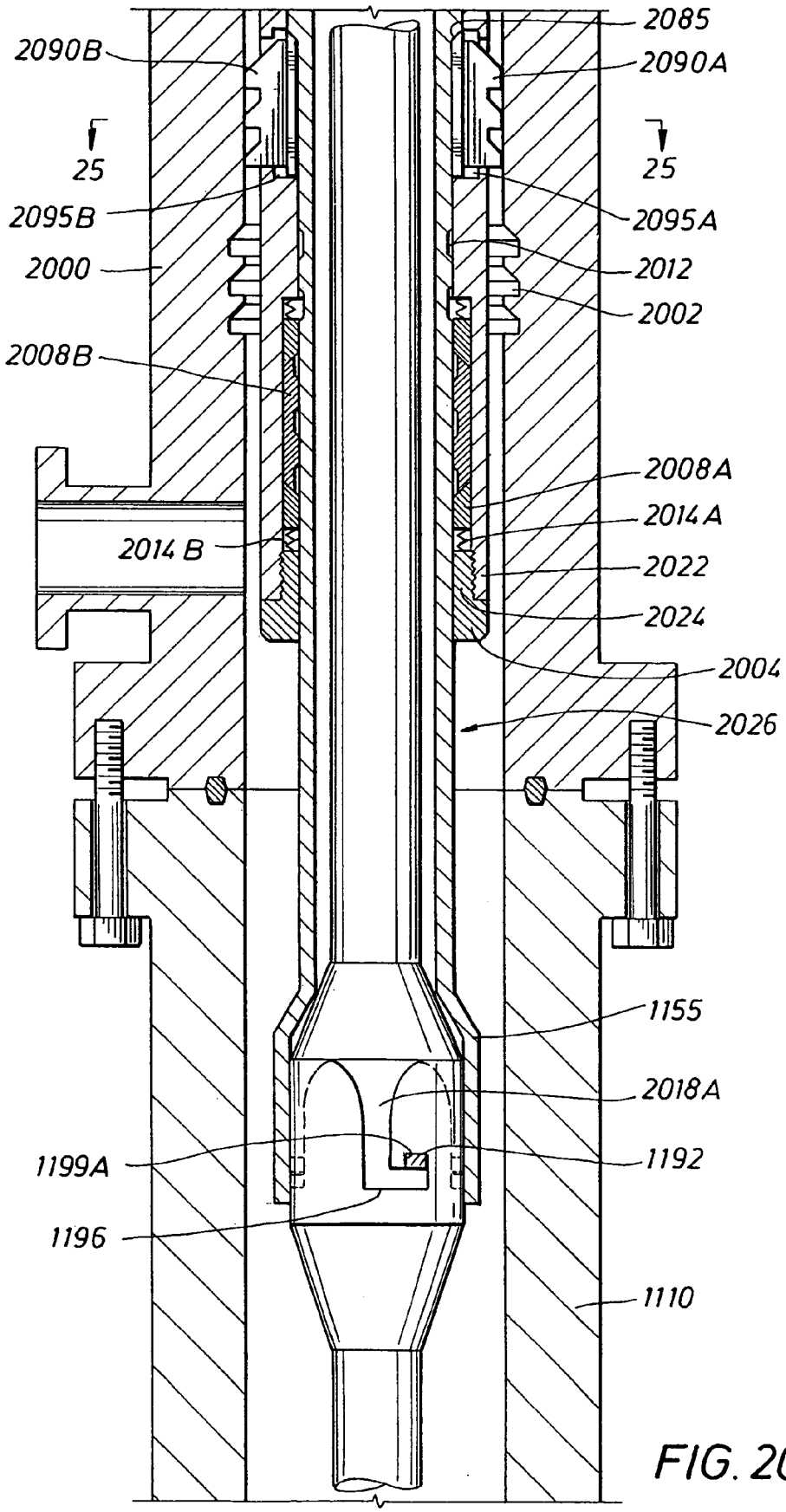
FIG. 20B is an elevation view of a lower section of the embodiment of FIG. 20A, showing a running tool for positioning the rotating control head and showing the holding member of the internal housing and a latching profile in the subsea housing, with a lower dog member in a disengaged position.

Turning to FIGS. 20A and 20B, an elevation view of an another embodiment is shown, with FIG. 20A showing an upper section of the embodiment and FIG. 20B showing a lower section of the embodiment for clarity of the drawings.

In this embodiment, a subsea housing 2000 is bolted to an upper tubular 1100 and a lower body 1110 similar to the connection of the subsea housing 1105 in FIG. 11. However, in the embodiment of FIGS. 20A and 20B, a different technique for latching and sealing a holding member assembly 2026 is shown. The holding member assembly 2026 is connected to a bearing assembly similarly to how the holding member assembly 1150 is connected to the bearing assembly 1140 in FIG. 11, although the connection technique is not visible in FIGS. 20A-20B. A running tool 1190 is used for insertion and removal of the rotating control head assembly RCH, as in FIG. 11. The passive latching formations, with passive formation 2018A most visible in FIG. 20B, allow the passive latching member 1199A to be further secured in a vertical section 1192, which requires an additional vertical movement for engaging and disengaging the running tool 1190 with the bell-shaped portion 1155 of the holding member assembly, generally designated 2026.

As best shown in FIG. 20A, the holding member assembly 2026 is comprised of an internal housing 2028, with an upper portion 2045, a lower portion 2050, and an elastomer 2055; and an extendible portion 2080.

Figure 22A:
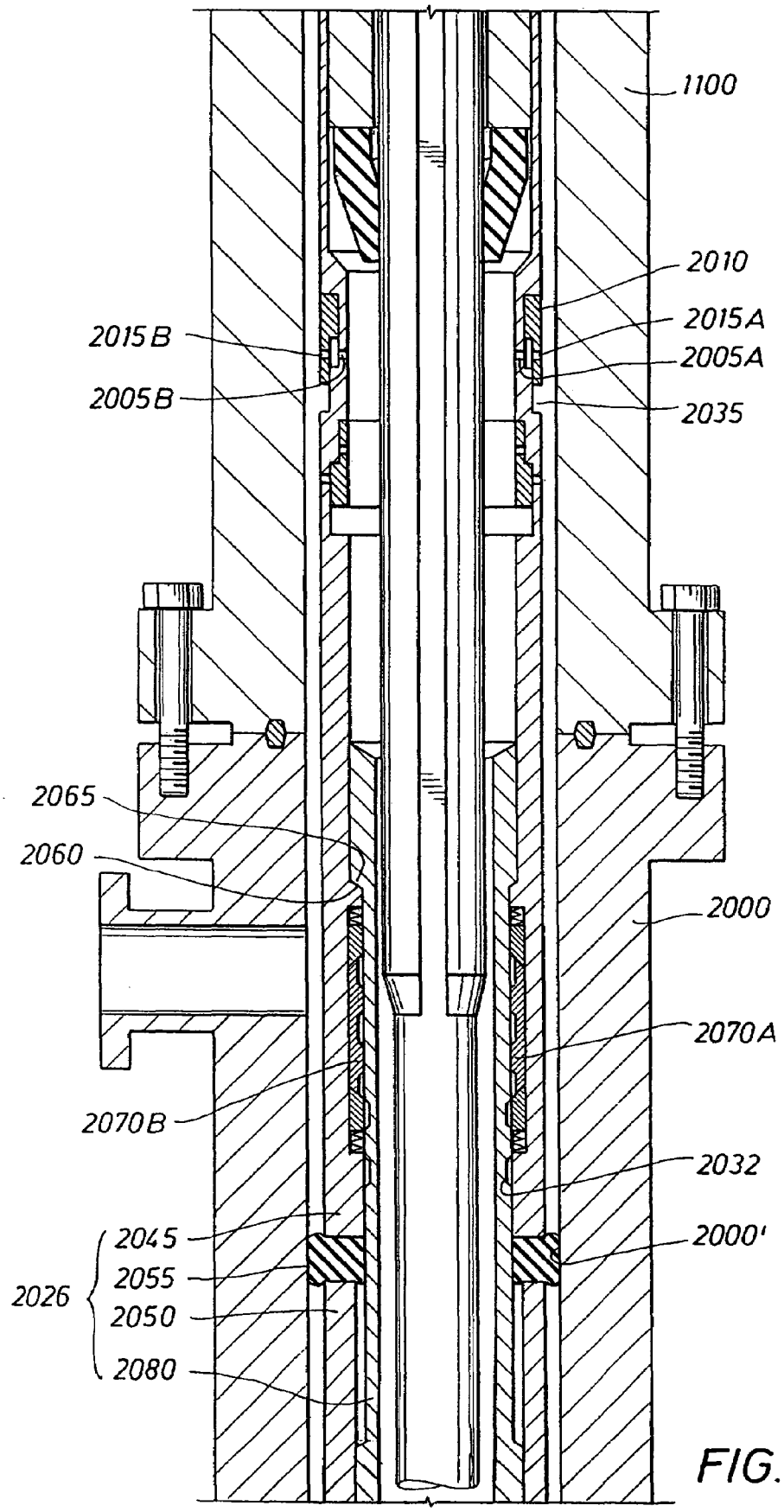
FIG. 22A is an elevation view of an upper section of the embodiment of FIGS. 20 and 21 with the bi-directional pressure relief assembly in a second open position, an elastomer member sealing the holding member assembly with the subsea housing, an extendible portion of the holding member assembly extended in a first position, and an upper dog member in a disengaged position.

The upper portion 2045 is connected to the bearing assembly 1140. The lower portion 2050 and the upper portion 2045 are pulled together by the extension of the extendible portion 2080, compressing the elastomer 2055 and causing the elastomer 2055 to extrude radially outwardly, sealing the holding member assembly 2026 to a sealing surface 2000', as best shown in FIG. 22A, the subsea housing 2000. Upon retracting the extendible portion 2080, the upper portion 2045 and the lower portion 2050 decompress the elastomer 2055 to release the seal with the sealing surface 2000' of the subsea housing 2000.

A bi-directional pressure relief assembly or mechanism is incorporated into the upper portion 2045. A plurality of passages are equidistantly spaced around the circumference of the upper portion 2045. FIG. 20A shows two of these passages, identified as 2005A and 2005B. Four such passages are typically used; however, any desired member of passages can be used.

An outer annular slidable member 2010 moves vertically in an annular recess 2035. A plurality of passages in the slidable member 2010 of an equal number to the number of upper portion passages allow fluid communication between the interior of the holding member assembly 2026 and the subsea riser when the upper portion passages communicate with the slidable member passages. Upper portion passages 2005A-2005B and slidable member passages 2015A-2015B are shown in FIG. 20A.

Similarly, opposite direction pressure relief is obtained via a plurality of passages through the upper portion 2045 and a plurality of passages through an interior slidable annular member 2025 in recess 2040. Four such corresponding passages are typically used; however, any desired number of passages can be used. Upper portion passages 2020A-2020B and slidable member passages 2030A-2030B are shown in FIG. 20A. When vertical movement of member 2025 communicates the passages, fluid communication allows equalization of pressure similar to that allowed by vertical movement of member 2010 when pressure inside the holding member assembly 2026 exceeds pressure in the upper tubular 1100. FIG. 20A is shown with all of the passages in a closed position. Operation of the bi-directional pressure relief assembly is described below.

Figure 25:
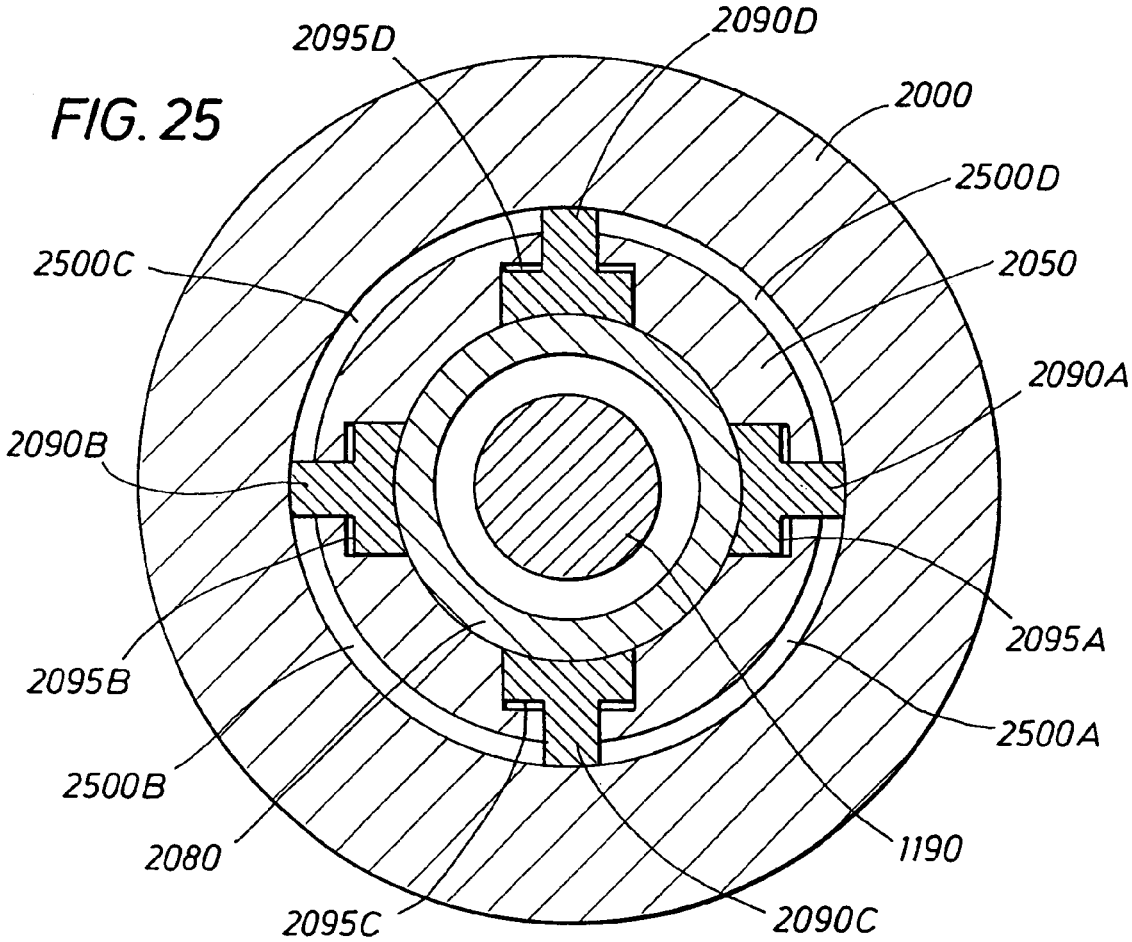
FIG. 25 is a section view taken along line 25-25 of FIG. 23B.

Turning to FIG. 20B, latching of the holding member assembly 2026 is performed by a plurality of holding members, spaced equidistantly around the circumference of the lower portion 2050 of the internal housing 2028 of the holding member assembly 2026. Two exemplary passive holding members 2090A and 2090B are shown in FIG. 20B. As best shown in FIG. 25, preferably, four equidistant spaced holding members 2090A, 2090B, 2090C, and 2090D are used, but any desired number can be used. When the holding members are engaged with the subsea housing, as described below, movement of the rotating control head assembly RCH to the subsea housing 2000 is resisted.

Returning to FIG. 20B, a passive internal formation 2002, providing a profile, is annularly formed in an inner surface of the subsea housing 2000. As best shown in FIG. 25, the shape of the passive internal formation 2002 is complementary to that of the holding members 2090A to 2090D, allowing solid latching when fully aligned when urged outwardly by surface 2085 of the extendible portion 2080 of the holding member assembly 2026. However, because an annular passive internal formation 2002 is used, rotation of the holding member assembly 2026 is not required before engagement of the holding members 2090A to 2090D with the passive latching formation 2002.

Figure 27:
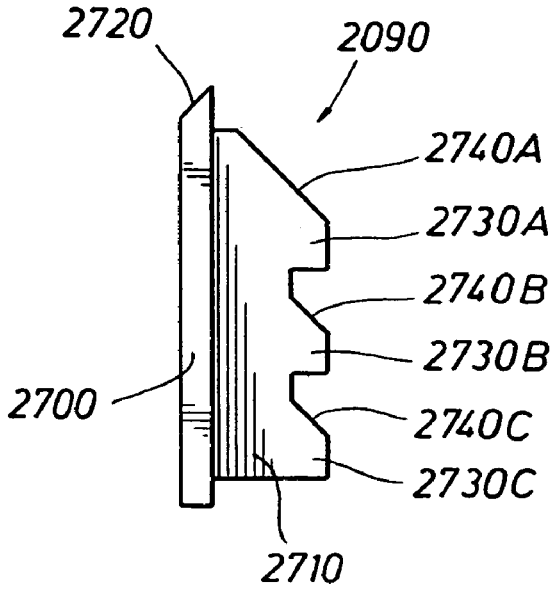
FIG. 27 is a detail elevation view of a holding member of the embodiment of FIGS. 20B-26B.

Each of the holding members 2090A to 2090D, are a generally trapezoid shaped structure, shown in detail elevation view in FIG. 27. An inner portion 2700 of the exemplary member 2090 is a trapezoid with an upper edge 2720, slanted upwardly in an outward direction as shown. Exerting force in a downhole direction by the surface 2085 of extendible portion 2080 on the upper edge 2700 will urge the members 2090A to 2090D outwardly, to latch with the passive latching formation 2002. An outer portion 2710 attached to the inner portion 2700 is generally a trapezoid, with a plurality of trapezoidal extensions or protuberances 2730A, 2730B and 2730C, each of which has an upper edge 2740A, 2740B, and 2740C which slopes downwardly and outwardly. The upper edge 2740A generally extends across the upper edge of the outer portion 2710. In addition to corresponding to the shape of the passive internal formation 2002, the slope of the edges 2740A, 2740B, and 2740C urge the passive holding member inwardly when the passive holding member 2090 is pulled or pushed upwardly against the matching surfaces of the passive internal formation 2002.

Figure 21A:
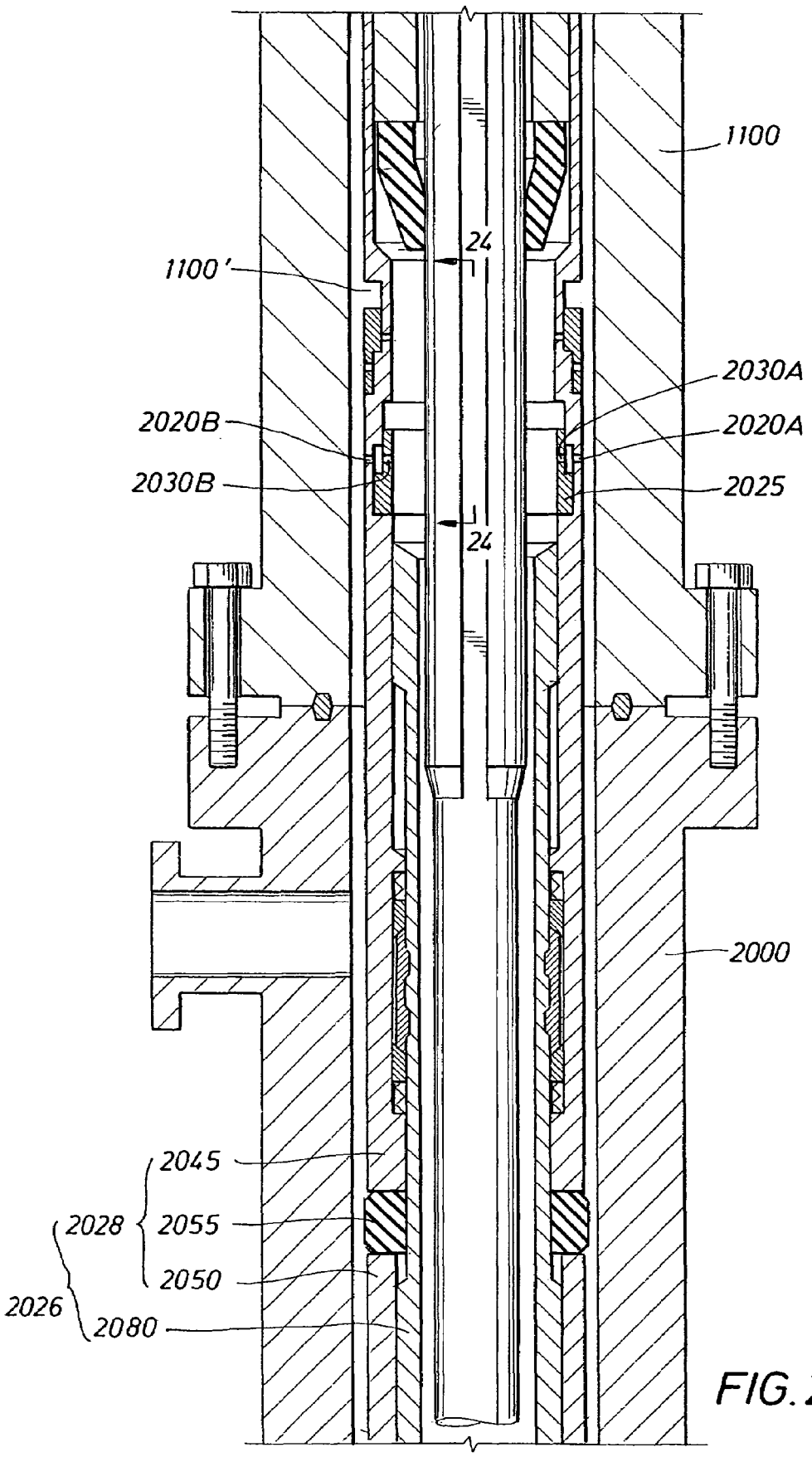
FIG. 21A is an elevation view of an upper section of the embodiment of FIG. 20 showing a lower stripper rubber of the rotating control head spread by a spreader member of the running tool and showing the pressure relief assembly of FIG. 20A in a first open position.
Figure 21B:
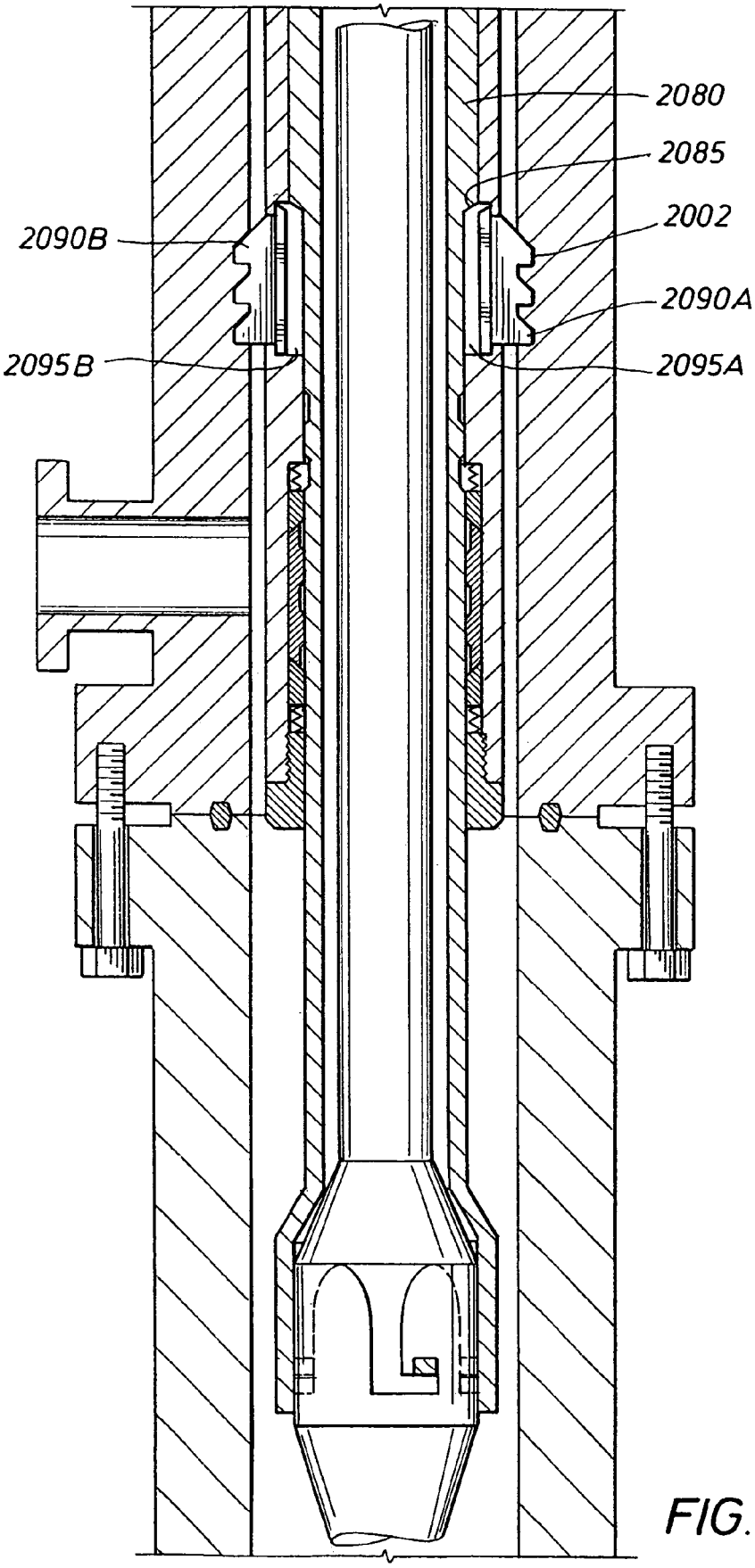
FIG. 21B is an elevation view of a lower section of the embodiment of FIG. 21A showing the holding member assembly in an engaged position.

Reviewing FIGS. 20B, 21B, and 25 during insertion of the rotating control head assembly RCH, the holding members or chambers 2090A, 2090B, 2090C, and 2090D are recessed into a corresponding number of recesses or chambers 2095A, 2095B, 2095C, and 2095D in the lower portion 2050, with the extensions 2730A, 2730B, 2730C and 2730D serving as guide members to centrally position the holding member assembly 2026 in the upper tubular 1100.

Turning to FIG. 20A, an upper dog member recess 2032 is annularly formed around the circumference of the extendible portion 2080, and on initial insertion is mated with a plurality of upper dog members that are mounted in recesses or chambers of the upper portion 2045. Dog members 2070A and 2070B and their corresponding recesses 2075A and 2075B are shown in FIG. 20A. In one embodiment, four dog members and corresponding recesses are used; however, other numbers of dog members and recesses can be used. Because an annular upper dog member recess 2032 is used, rotation of the holding member assembly 2026 is not required before engagement of the upper dog members with the upper dog member recess 2032. When engaged, the upper dog members allow the extendible portion 2080 to stay in alignment with the upper portion 2045 and carry the rotating control head assembly RCH until the holding members 2090A, 2090B, 2090C, and 2090D engage the passive latching formation 2002.

Turning to FIG. 20B, a similar plurality of lower dog members, recessed in an equal number of recesses or chambers are configured in the lower portion 2050, and an annular lower dog recess 2012 is formed in extendible portion 2080. The lower dog members are in a disengaged position in FIG. 20B. Lower dog members 2008A-2008B and recesses 2014A-2014B are shown in FIG. 20B. Four lower dog members are typically used; however, any convenient number of lower dog members can be used.

Although the upper dog members and lower dog members are shown in FIGS. 20A and 20B as disposed in the upper portion 2045 and lower portion 2050, respectively, while upper dog recesses 2032 and lower dog recesses 2014 are shown in FIGS. 20A and 20B as disposed in the extendible portion 2080, the upper dog members and the lower dog members can be disposed in extendible member 2080 with upper dog recesses and lower dog recesses disposed in upper portion 2045 and lower portion 2050, respectively.

Figure 28:
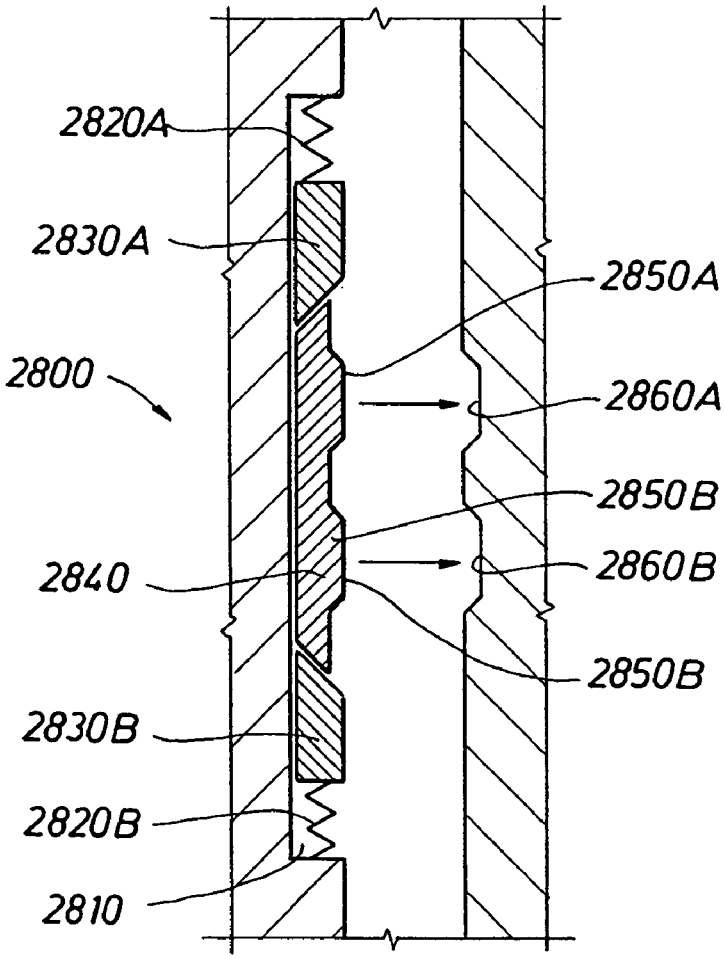
FIG. 28 is a detail elevation view of an exemplary dog member.

FIG. 28 is a detail elevation view of an exemplary dog member and dog member recess. Each dog member is positioned in a recess or chamber 2810 with a spring-loaded dog assembly 2800. The spring-loaded dog assembly 2800 is comprised of an upper spring 2820A and a lower spring 2820B, attached to an upper urging block 2830A and a lower urging block 2830B, respectively. The urging blocks are shaped so that pressure from the springs on the urging blocks urges a central block 2840 outwardly (relative to the recess 2810). The central block 2840 is generally a trapezoid, with a plurality of trapezoidal extensions 2850A and 2850B for mating with corresponding dog recesses 2860A and 2860B. One skilled in the art will recognize that the number of extensions and recesses shown in FIG. 28, corresponding to the lower and upper dog members and the lower and upper dog recesses, are exemplary and illustrative only, and other numbers of extensions and recesses can be used.

Extensions and recesses are trapezoidal shaped to allow bidirectional disengagement through vector forces, when the dog member 2800 is urged upwardly or downwardly relative to the recesses, retracting into the recess or chamber 2810 when disengaged, without fracturing the central block 2840 or any of the extensions 2850A or 2850B, which would leave unwanted debris in the borehole B upon fracturing. The springs 2820A and 2820B can be chosen to configure any desired amount of force necessary to cause retraction. In one embodiment, the springs 2820 are configured for a 100 kips force.

Returning to FIG. 20A, the upper dog members are engaged in recesses 2032, while the lower dog members are disengaged with recesses 2012.

Turning to FIG. 20B, an end portion 2004 with a threaded section 2024 can be threaded into a threaded section 2022 of the lower portion 2050 to allow access to the recess or chamber of the dog member.

Turning now to FIGS. 21A-21B, the embodiment of FIGS. 20A-20B is shown with the holding members 2090A, 2090B, 2090C, and 2090D engaged with the passive internal formation 2002, latching the holding member assembly 2026 to the subsea housing 2000. Downward pressure at location 2085 of the extendible portion 2080 has urged the holding members 2090A, 2090B, 2090C, and 2090D outwardly when aligned with the recesses of the passive internal formation 2002.

As shown in FIG. 21A, one portion of the bi-directional pressure relief assembly is in an open position, with passages 2030A, 2020A, 2030B, and 2020B communicating when sliding member 2025 moves downwardly into annular area 2040 (see FIG. 20A) to allow fluid communication between the inside of the holding member assembly 2026 and the annulus 1100, (see FIG. 21A) of the upper tubular 1100.

Turning to FIG. 22A, one portion of the pressure relief assembly is in an open position, with passages 2005A, 2015A, 2005B, and 2015B communicating when sliding member 2010 moves upwardly in recess 2035.

Figure 22B:
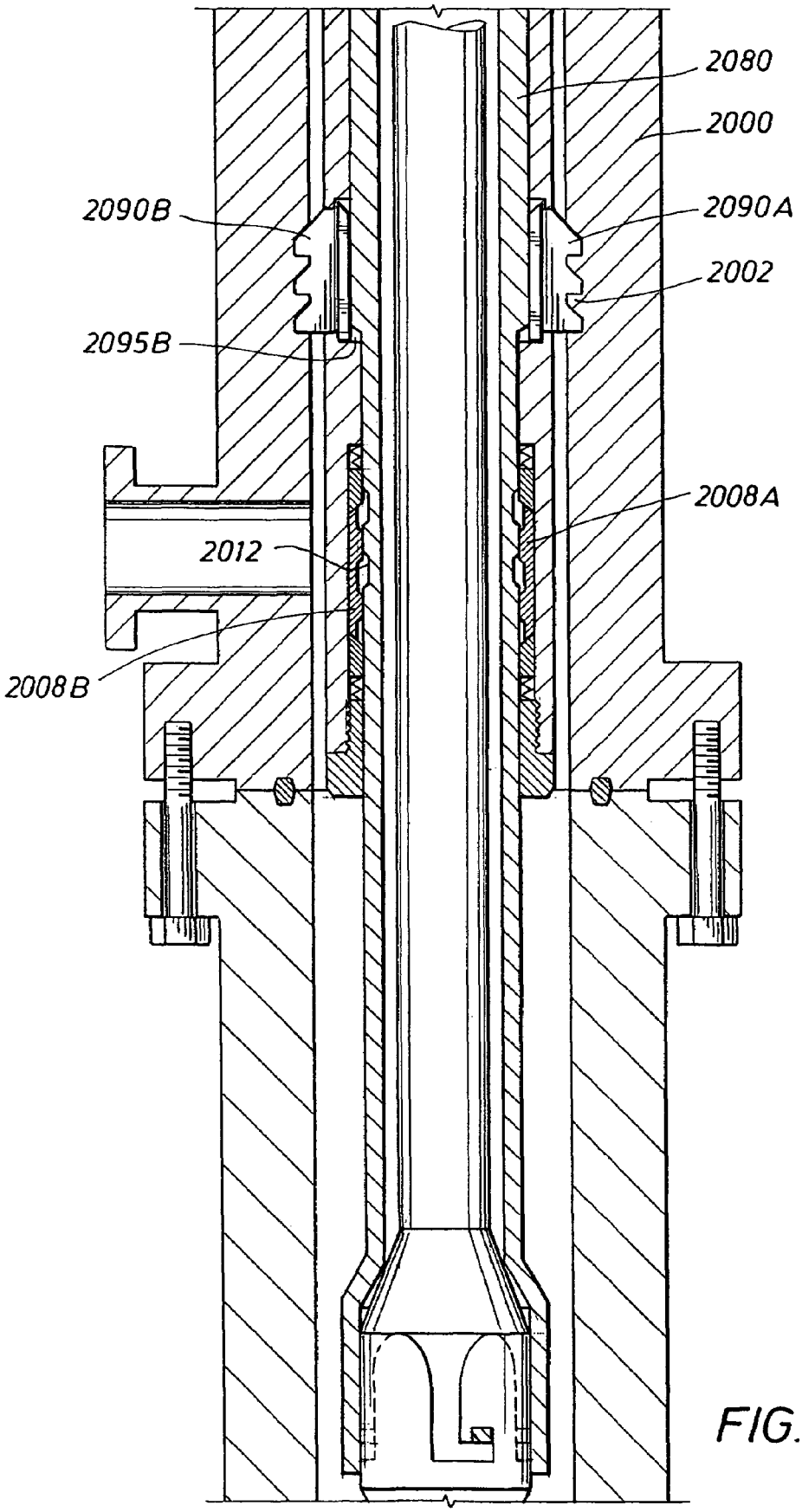
FIG. 22B is an elevation view of a lower section of the embodiment of FIG. 22A, with the extendible portion of the holding member assembly engaged with the subsea housing.

The extendible portion 2080 is extended into an intermediate position in FIGS. 22A and 22B. The dog members 2070A and 2070B have disengaged from dog recesses 2032, allowing movement of the extendible portion 2080 relative to the upper portion 2045. A shoulder 2060 on the extendible portion 2080 is landed on a landing shoulder 2065 of the upper portion 2045, so that extension of the extendible portion 2080 downwardly pulls the upper portion 2045 toward the lower portion 2050, which is fixed in place by the holding members 2090A, 2090B, 2090C, and 2090D engaging with the passive internal formation 2002 of the subsea housing 2000. This compresses the elastomer 2055, causing it to extrude radially outwardly, sealing the holding member assembly 2026 with the sealing surface 2000' of the subsea housing 2000.

As shown in FIG. 22B, at this intermediate position the lower dog members 2008A and 2008B are also disengaged from the lower dog recesses 2012.

Figure 23A:
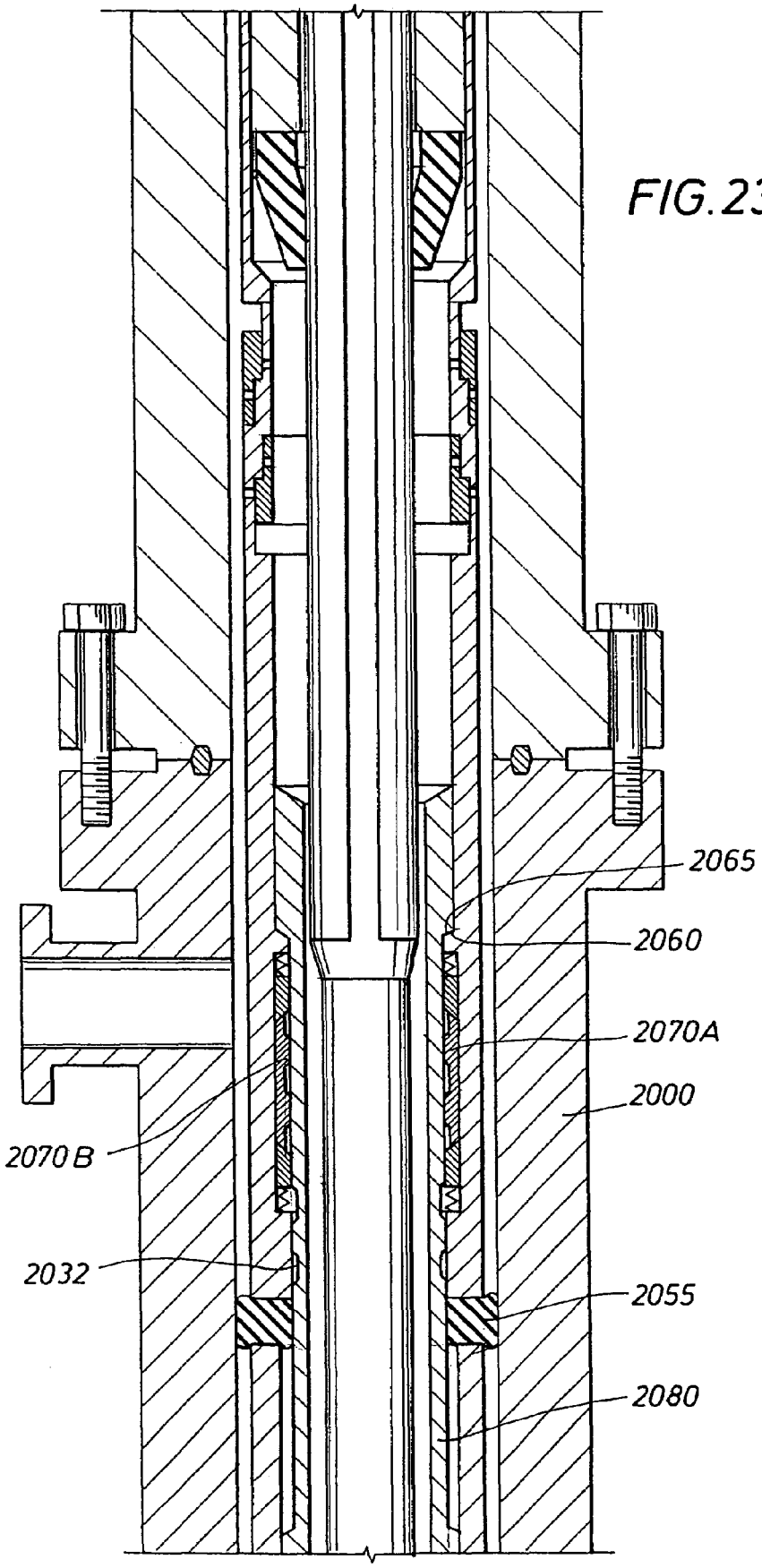
FIG. 23A is an elevation view of the upper section of the embodiment of FIGS. 20, 21 and 22 showing an upper portion of the bi-directional pressure relief assembly in a closed position and the running tool extended further downwardly.
Figure 23B:
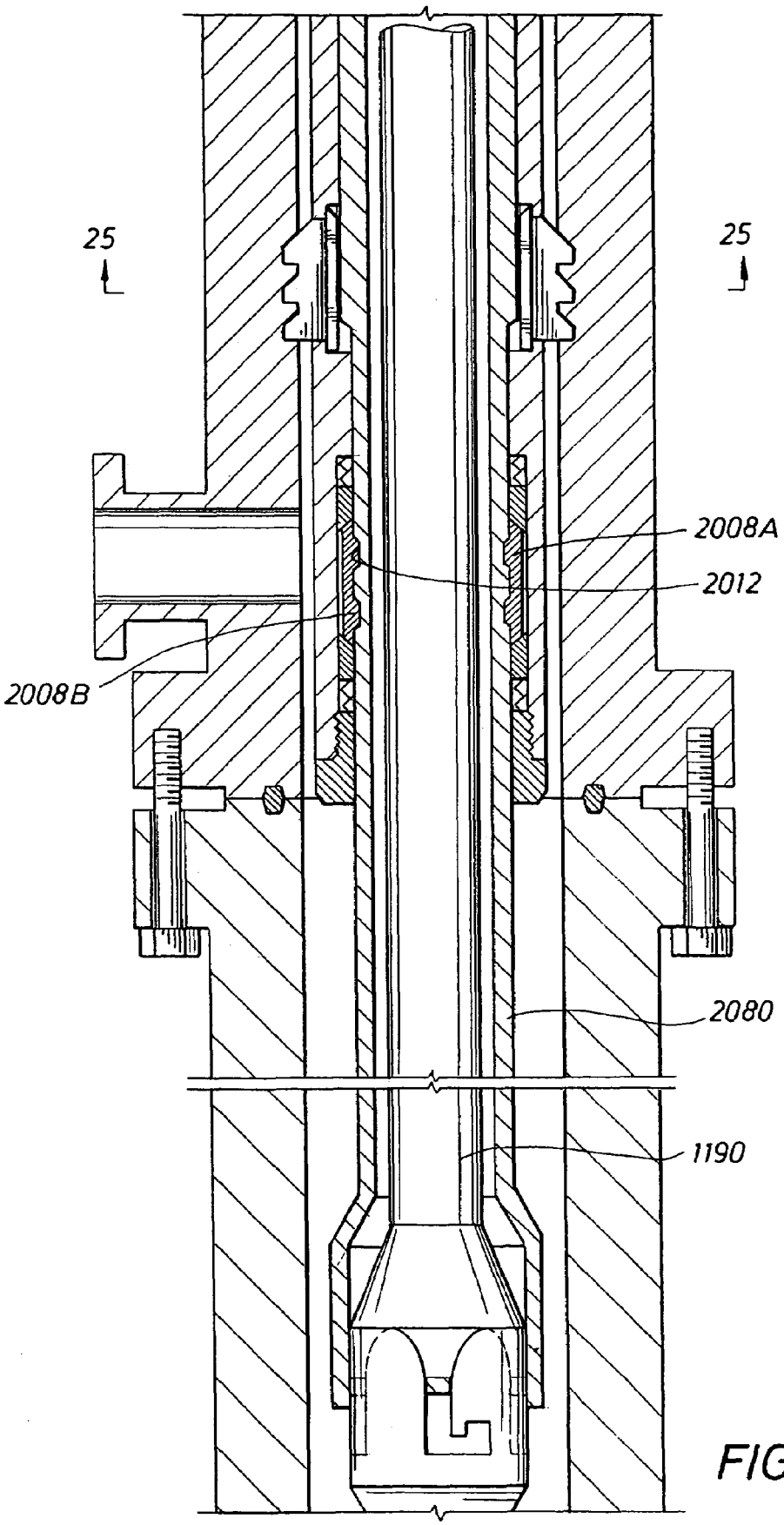
FIG. 23B is an elevation view of the lower section of the embodiment of FIG. 23A with the lower dog member in an engaged position and the running tool disengaged from the extendible member of the internal housing for moving toward the borehole.

Turning now to FIGS. 23A and 23B, the extendible portion 2080 is in the lower or fully extended position. As in FIG. 22A, the upper dog members 2070A and 2070B are disengaged from the upper dog recesses 2032, while shoulder 2060 is landed on shoulder 2065, causing the elastomer 2055 to be fully compressed, extruding outwardly to seal the holding member assembly 2026 with the sealing surface 2000, subsea housing 2000. Further, in FIG. 23B, the lower dog members 2008A and 2008B are engaged with the lower dog recesses 2012, blocking the extendible portion 2080 in the lower or fully-extended position.

This blocking of the extendible portion 2080 allows disengaging the running tool 1190, as shown in FIG. 23B, without the extendible portion 2080 retracting upwardly, which would decompress the elastomer 2055 and unseal the holding member assembly 2026 from the subsea housing 2000.

As stated above, to disengage the holding member assembly 2026, an operator will recognize a decreased "weight on bit" when the running tool is ready to be disengaged. As shown best in FIG. 22B and 23B, an operator momentarily reverses the rotation of the drill string, while pulling the running tool 1190 slightly upwards, to release the passive latching members 1199 from the position 1192 of the J-shaped passive formations 1199. The running tool 1190 can then be lowered, causing the passive latching members 1199 to exit through the vertical section 1198 of each formation 1197A and 1197B, as shown in FIG. 23B. The running tool 1190 can then be lowered and normal rotation resumed, allowing the running tool to move downward through the lower body 1110 toward the borehole.

Figure 24:
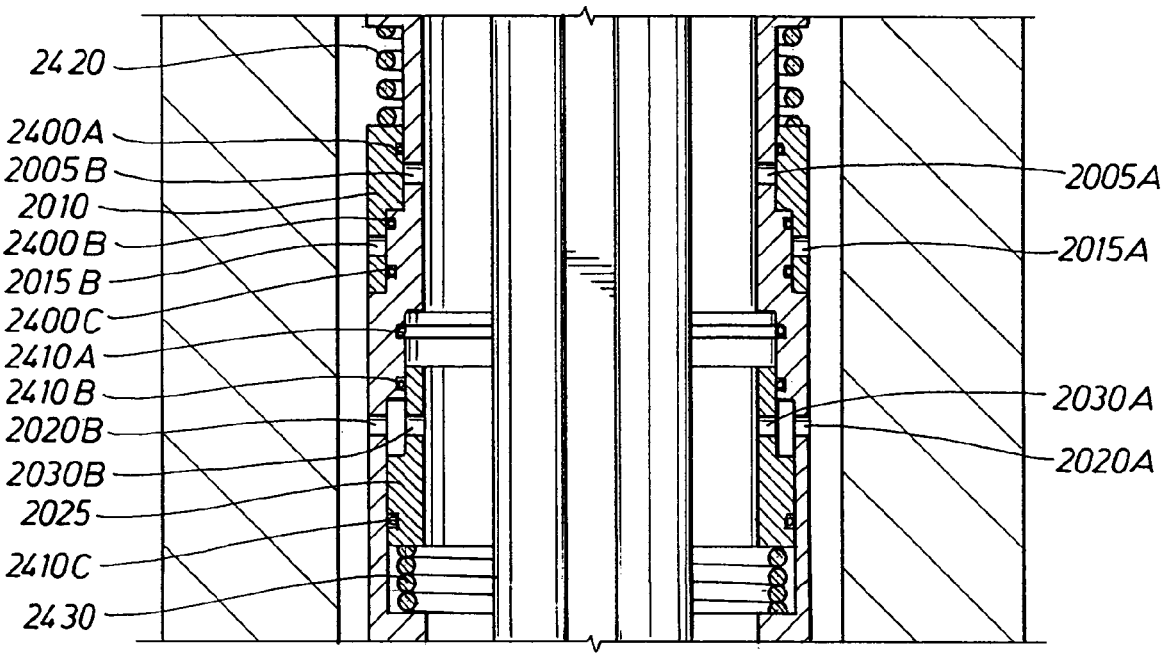
FIG. 24 is an enlarged elevation view of the bi-directional pressure relief assembly taken along line 24-24 of FIG. 21A.

Turning now to FIG. 24, a detail elevation view of the pressure relief assembly of FIGS. 20A, 21A, 22A, and 23A is shown, with the lower slidable member 2025 in a lower position, communicating the passages 2020 and 2030 for fluid communication while the upper slidable member 2010 is in a lower position, which ensures the passages 2015 and 2005 are not communicating, preventing fluid communication. Additionally, FIG. 24 shows a plurality of seals for sealing the upper slidable member 2010 to the upper portion 2045 of the holding member assembly 2026. Shown are seals 2400A, 2400B, and 2400C, typically O-rings of a suitable material. Also shown are seals for sealing the lower slidable member 2025 to the upper portion 2045, with exemplary seals 2410A, 2410B, and 2410C, typically O-rings of a similar material as used in seals 2400A, 2400B, and 2400C. Other numbers, positions, arrangements, and types of seals can be used. A coil spring 2420 biases the upper slidable member 2010 in a downward or closed position. Similarly, a coil spring 2430 biases the lower sliding member 2025 in an upward or closed position. When fluid pressure in the interior of the holding member assembly exceeds the fluid pressure in the subsea riser R by a predetermined amount, fluid will pass through the passage 2005, forcing the upper sliding member 2010 upwardly against the spring 2420, until the passages 2005 align with the passages 2015, allowing fluid communication and pressure relief. Likewise, when fluid pressure in the subsea riser R exceeds the fluid pressure in the holding member assembly by a predetermined amount, fluid will pass through the passage 2020, forcing the lower sliding member 2025 downwardly against the spring 2430, until the passages 2030 align with the passages 2020, allowing fluid communication and pressure relief. One skilled in the art will recognize that the springs 2420 and 2430 can be configured for any pressure release desired. In one embodiment, springs 2420 and 2430 are configured for a 100 PSI excess pressure release. One skilled in the art will also recognize that the spring 2420 can be configured for a different excess pressure release amount than the spring 2430.

Springs 2420 and 2430 bias slidable members 2010 and 2025, respectively, toward a closed position. When fluid pressure interior to the holding member assembly 2026 exceeds fluid pressure exterior to the holding member assembly 2026 by a predetermined amount, fluid will pass through the passages 2005, forcing the slidable member

2010 upward against the biasing spring 2420 until the passages 2015 are aligned with the passages 2005, allowing fluid communication between the interior of the holding member 2026 and the exterior of the holding member 2026. Once the excess pressure has been relieved, the slidable member 2010 will return to the closed position because of the spring 2420.

Similarly, the sliding member 2025 will be forced downwardly by excess fluid pressure exterior to the holding member assembly 2026, flowing through the passages 2020 until passages 2020 are aligned with the passages 2030. Once the excess pressure has been relieved, the slidable member 2025 will be urged upward to the closed position by the spring 2430.

As discussed above, FIG. 25 is a section view along line 25-25 of FIG. 23B, showing holding members 2090A, 2090B, 2090C, and 2090D engaged with passive internal formation 2002. FIG. 25 shows that there are gaps 2500A, 2500B, 2500C, and 2500D between the exterior of the lower portion 2050 of the holding member assembly 2026 and the interior of subsea housing 2000, allowing fluid communication past the holding members, to reduce or eliminate surging and swabbing during insertion and removal of the rotating control head assembly RCH.

Figure 26A:
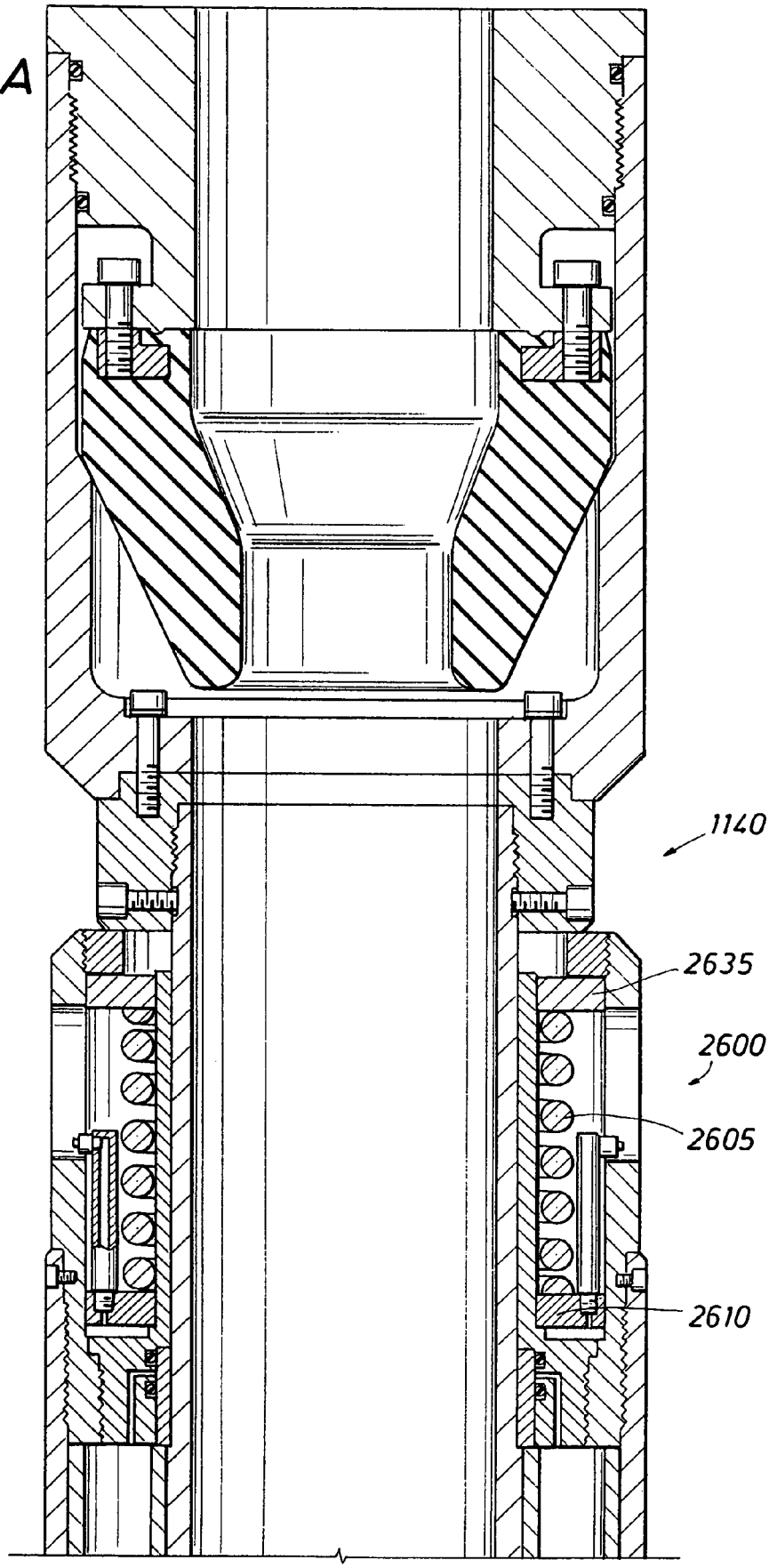
FIG. 26A is an elevation view of an upper section of a bearing assembly of a rotating control head according to one embodiment with an upper pressure compensation assembly.
Figure 26B:
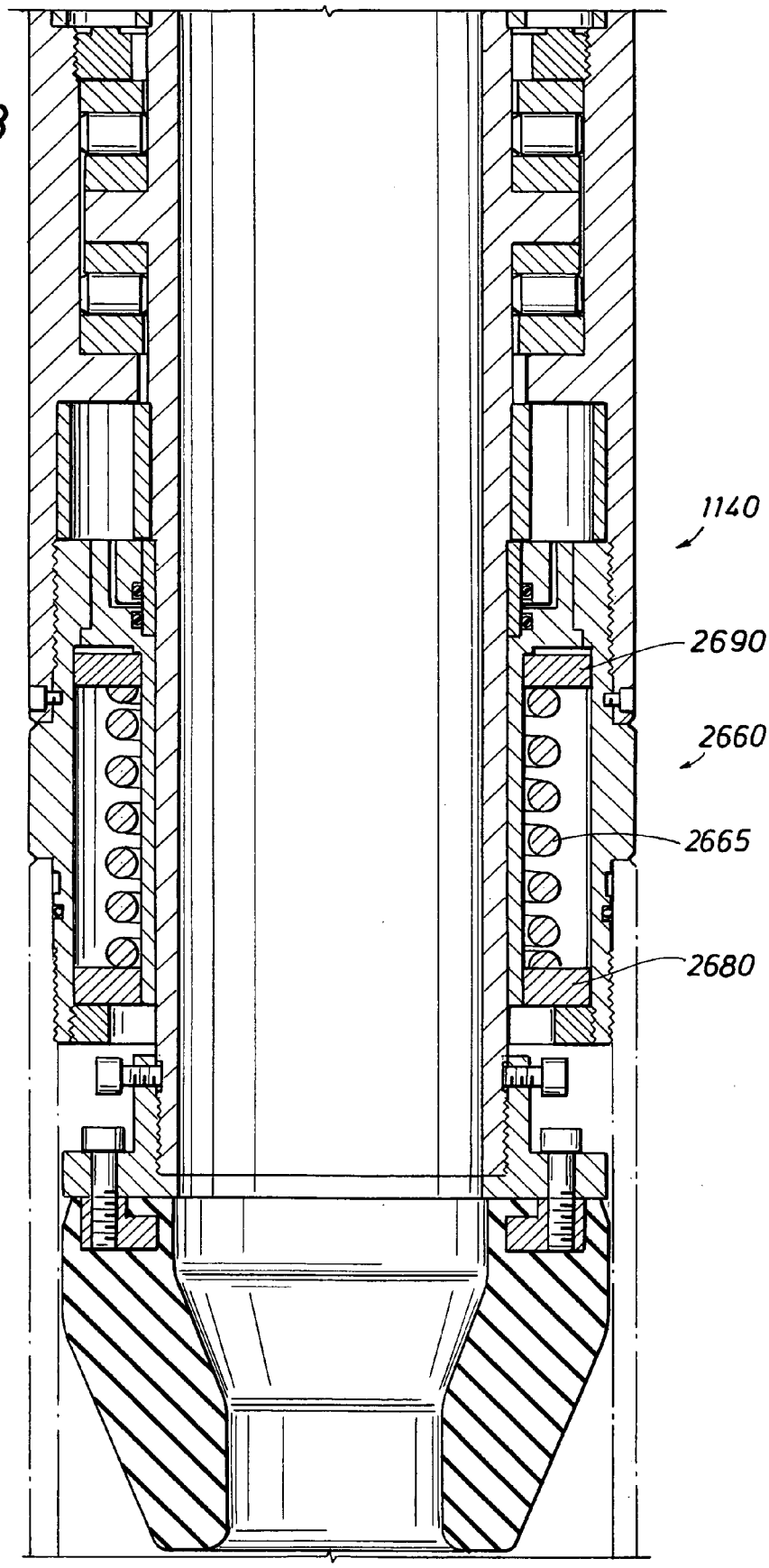
FIG. 26B is an elevation view of a lower section of the embodiment of FIG. 26A with a lower pressure compensation assembly.
Figure 26D:
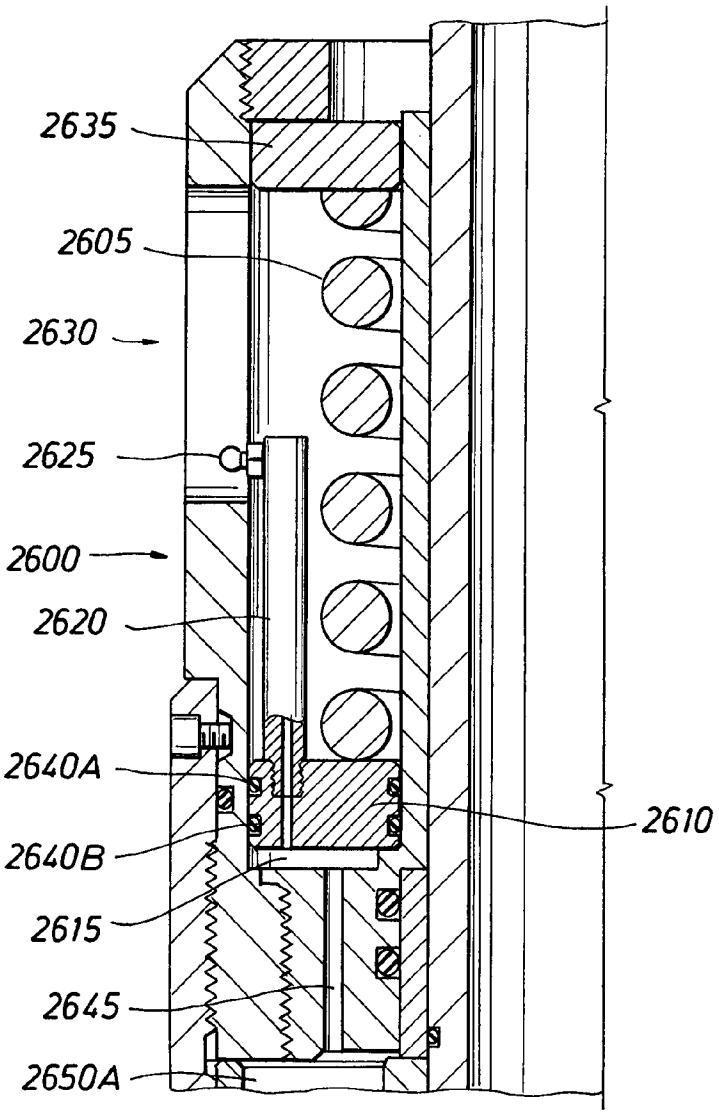
FIG. 26D is a detail view in a second orientation of the upper pressure compensation assembly of FIG. 26A.
Figure 26C:
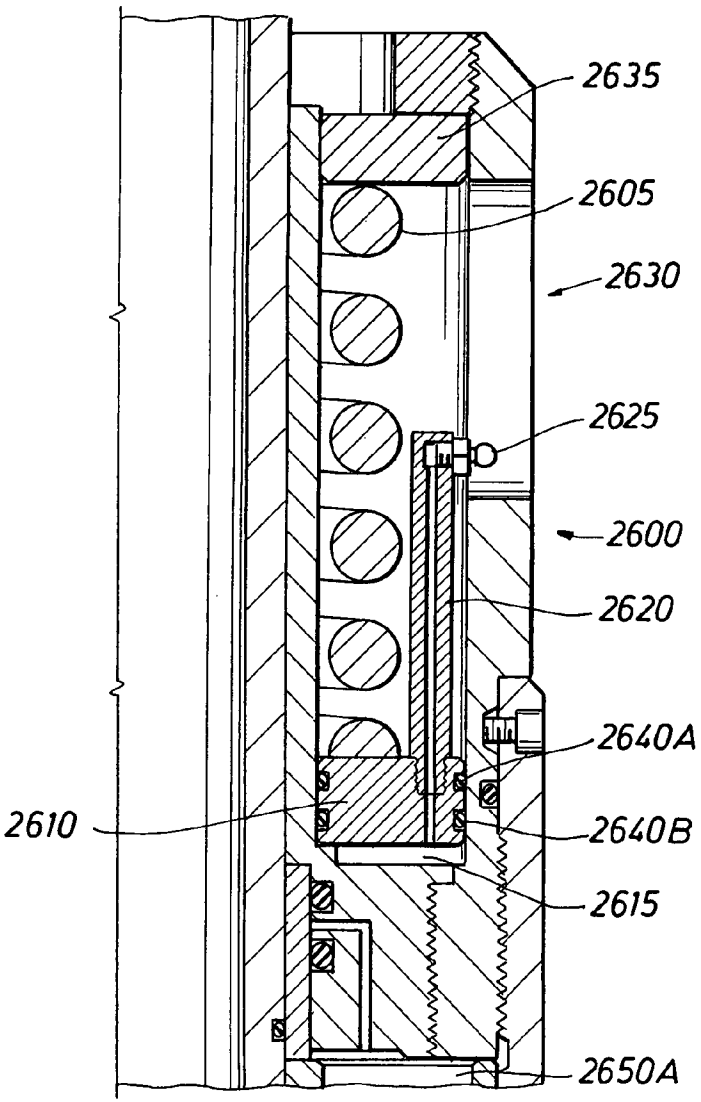
FIG. 26C is a detail elevation view of one orientation of the upper pressure compensation assembly of FIG. 26A.
Figure 26F:
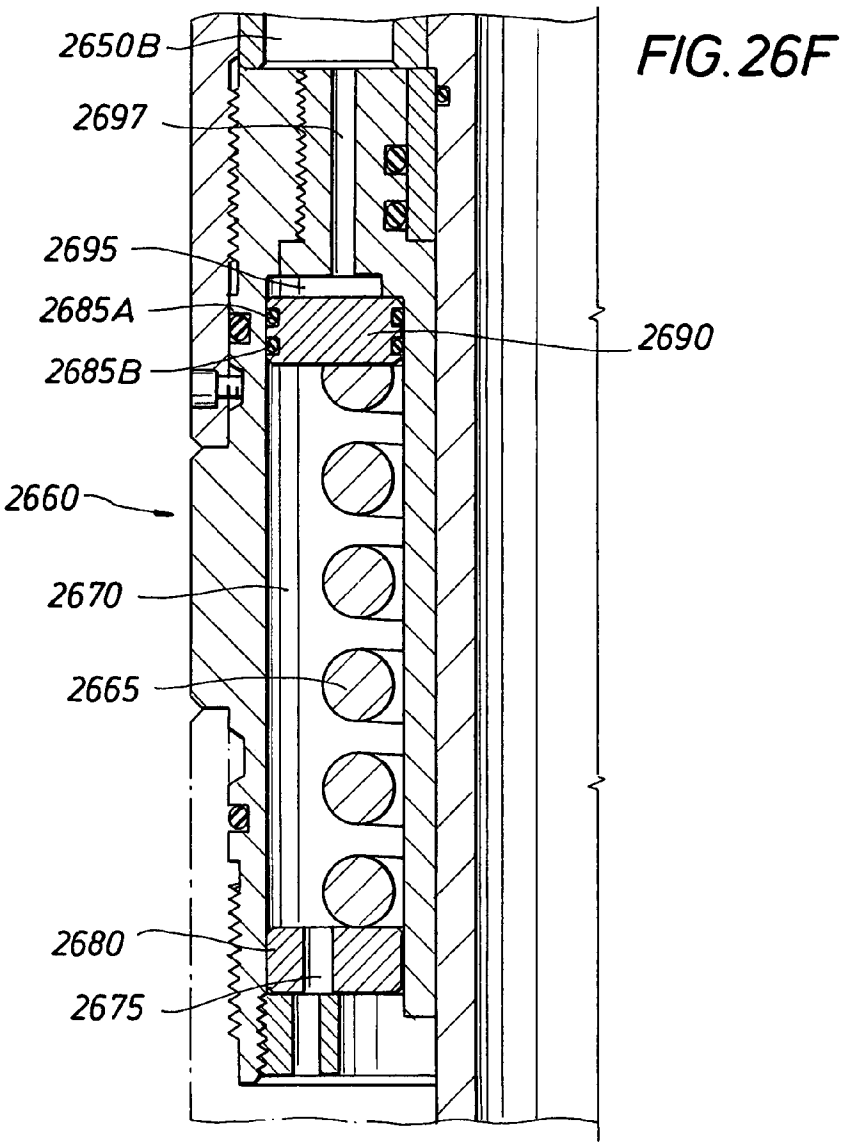
FIG. 26F is a detail view in a second orientation of the lower pressure compensation assembly of FIG. 26B.
Figure 26E:
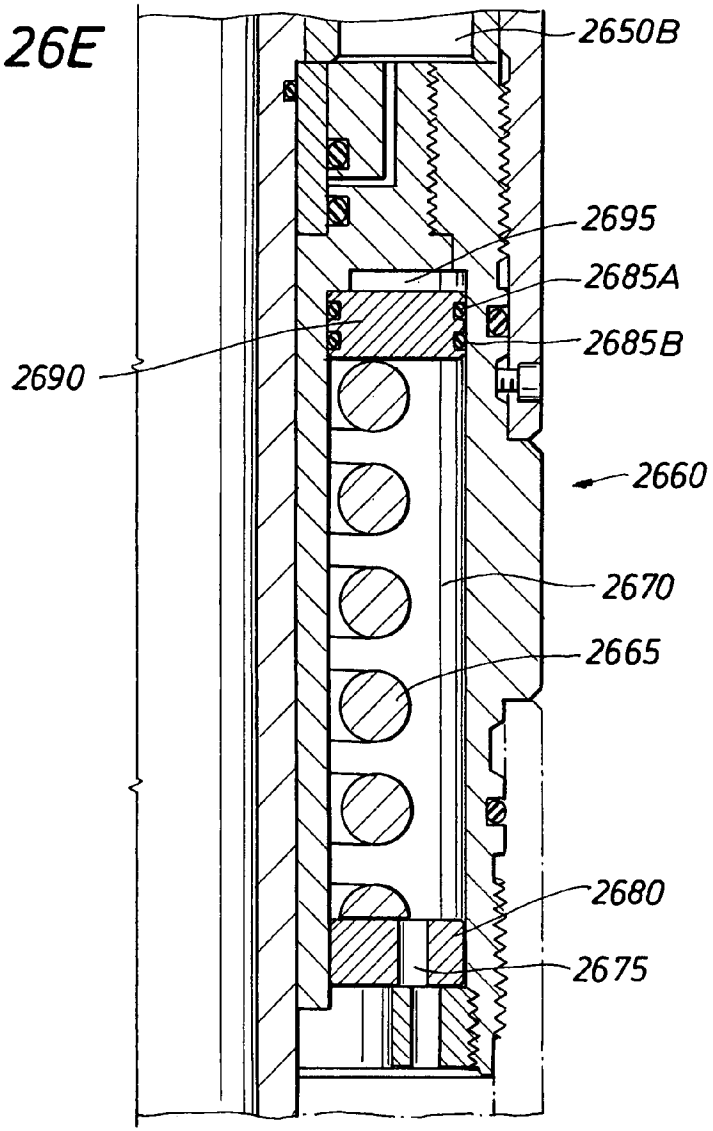
FIG. 26E is a detail elevation view of one orientation of the lower pressure compensation assembly of FIG. 26B.

FIGS. 26A and 26B are a detail elevation view of pressure compensation mechanisms 2600 and 2660 of the bearing assembly 1140 of the embodiments of FIGS. 11-25B. Pressure compensation mechanisms 2600 and 2660 allow for maintaining a desired lubricant pressure in the bearing assembly 1140 at a higher level than the fluid pressure within the subsea housing above or below the seal. FIGS. 26C and 26D are detailed elevation views of two orientations of the pressure compensation mechanism 2600. FIGS. 26E and 26F are detailed elevation views of lower pressure compensation mechanism 2660, again in two orientations.

A chamber 2615 is filled with oil or other hydraulic fluid. A barrier 2610, such as a piston, separates the oil from the sea water in the subsea riser. Pressure is exerted on the barrier 2610 by the sea water, causing the barrier 2610 to compress the oil in the chamber 2615. Further, a spring 2605, extending from block 2635, adds additional pressure on the barrier 2610, allowing calibration of the pressure at a predetermined level. Communication bores 2645 and 2697 allow fluid communication between the bearing chamber—for example, referenced by 2650A, 2650B in FIG. 26D and FIG. 26F, respectively—and the chambers 2615, 2695 pressurizing the bearing assembly 1140.

A corresponding spring 2665 in the lower pressure compensation mechanism 2660 operates on a lower barrier 2690, such as a lower piston, augmenting downhole pressure. The springs 2605 and 2665 are typically configured to provide a pressure 50 PSI above the surrounding sea water pressure. By using upper and lower pressure compensation mechanisms 2600 and 2660, the bearing pressure can be adjusted to ensure the bearing pressure is greater than the downhole pressure exerted on the lower barrier 2690.

In the upper mechanism 2600, shown in FIG. 26C, a nipple 2625 and pipe 2620 are used for providing oil to the chamber 2615. Access to the nipple 2625 is through an opening 2630 in the bearing assembly 1140. In one embodiment, the upper and lower pressure compensation mechanisms 2600 and 2660 provide 50 PSI additional pressure over the maximum of the seawater pressure in the subsea housing and the borehole pressure.

FIGS. 26E and 26F show the lower pressure compensation mechanism 2660 in elevation view. Passages 2675 through block 2680 allow downhole fluid to enter the chamber 2670 to urge the barrier 2690 upward, which is further urged upward by the spring 2665 as described above. Each of the barriers 2690 and 2610 are sealed using seals 2685A, 2685B and 2640A, 2640B. The upper and lower pressure compensation mechanisms 2600 and 2660 together ensure that the bearing pressure will always be at least as high as the higher of the sea water pressure being exerted on the upper pressure compensation mechanism 2600 and the downhole pressure being exerted on the lower pressure compensation mechanism 2660, plus the additional pressure caused by the springs 2605 and 2665. One advantage of the disclosed pressure compensation technique is that exterior hydraulic connections are not needed to adjust for changes in either the sea water pressure or the borehole pressure.

FIGS. 20A-23B illustrate an embodiment in which the bearing assembly 1140 is mounted above the holding member assembly 2026. In contrast, FIGS. 29A-34 illustrate an alternate embodiment, in which the bearing assembly 1140 is mounted below the holding member assembly 2026. Such a configuration may be advantageous because it provides less area for borehole cuttings to collect around the passive latching mechanism of the holding member assembly 2026 and reduces equipment in the riser above the seal of the holding member assembly 2026. In either configuration, sealing the holding member assembly between the openings 1130*a* and 1130*b* allows independent fluid circulation both above and below the seal.

As shown in FIGS. 29A, 30, 31, and 32A, the operation of the holding member assembly 2026 is identical in either the over slung or under slung configurations, latching the holding members 2090*a*-2090*d* into passive internal formation 2002, sealing the holding member assembly 2026 to the subsea housing 2000 by extruding elastomer 2055 while extending extendible portion 2080, and alternatively dogging the extendible member 2080 to upper or lower sections 2045 and 2050.

Figure 29A:
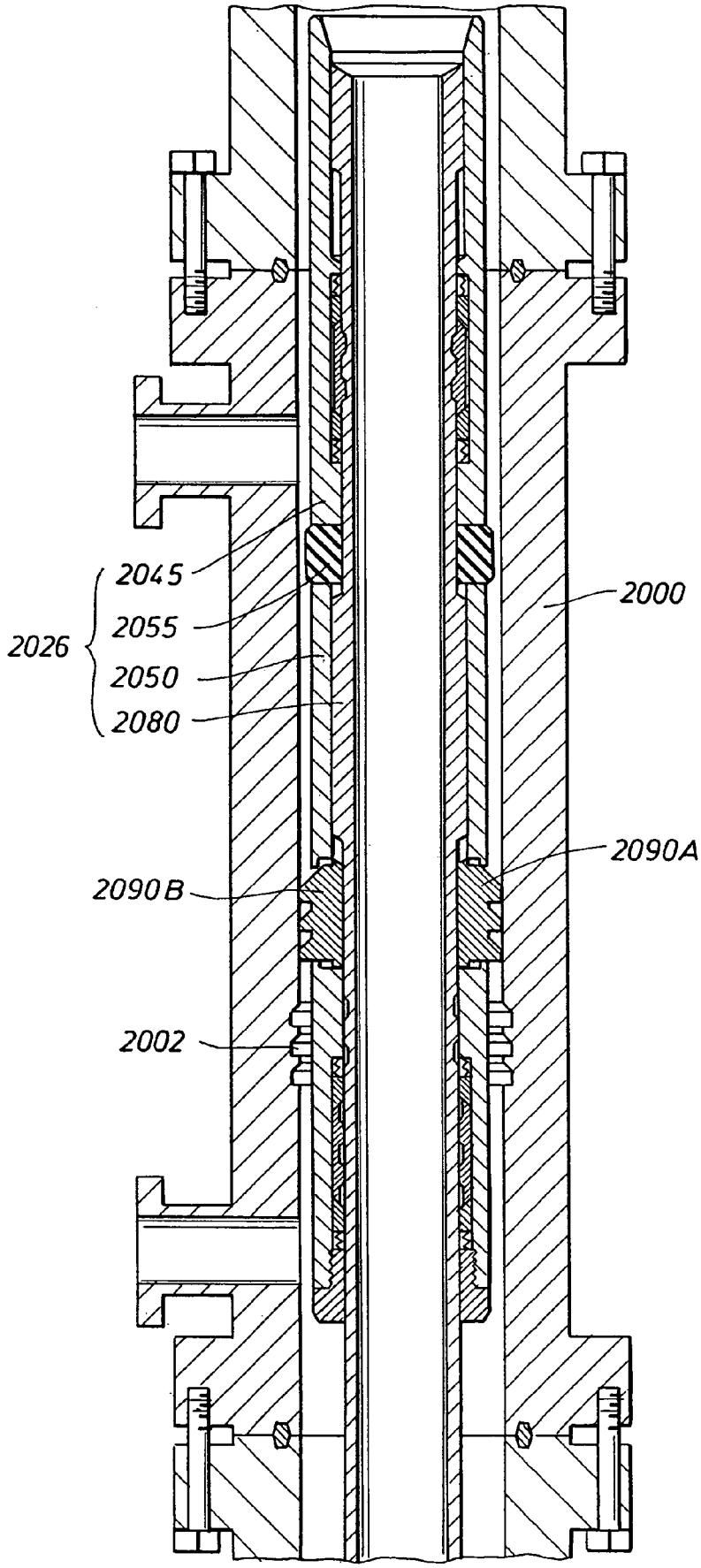
FIG. 29A is an elevation view of an upper section of another embodiment, with the bearing assembly positioned below the holding member assembly.
Figure 29B:
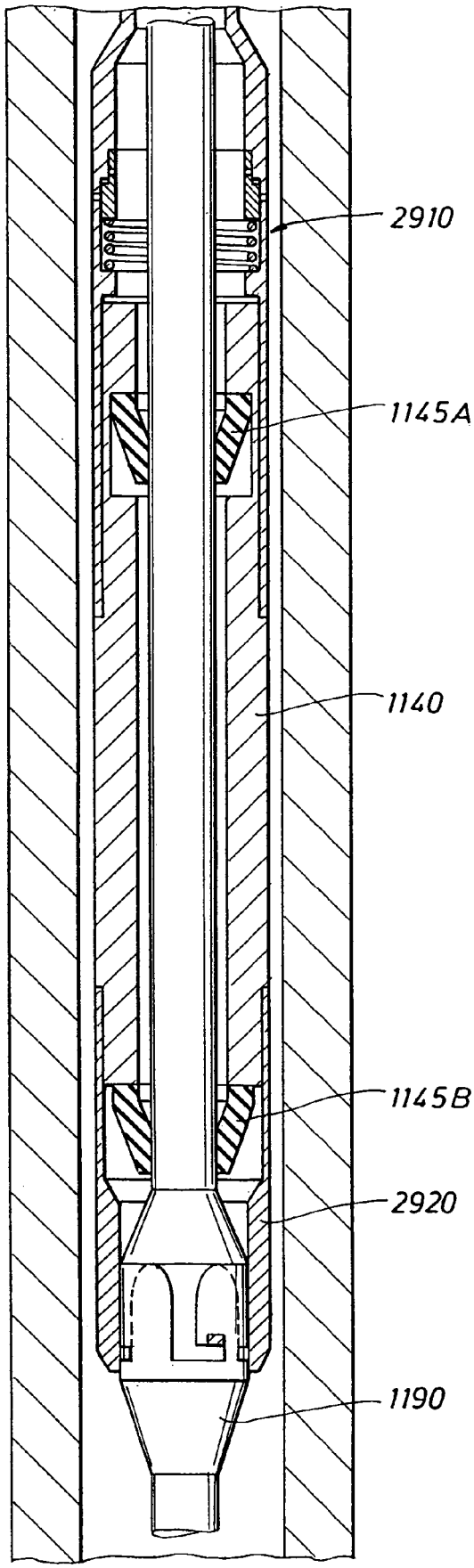
FIG. 29B is an elevation view of a lower section of the embodiment of FIG. 29A.
Figure 30:
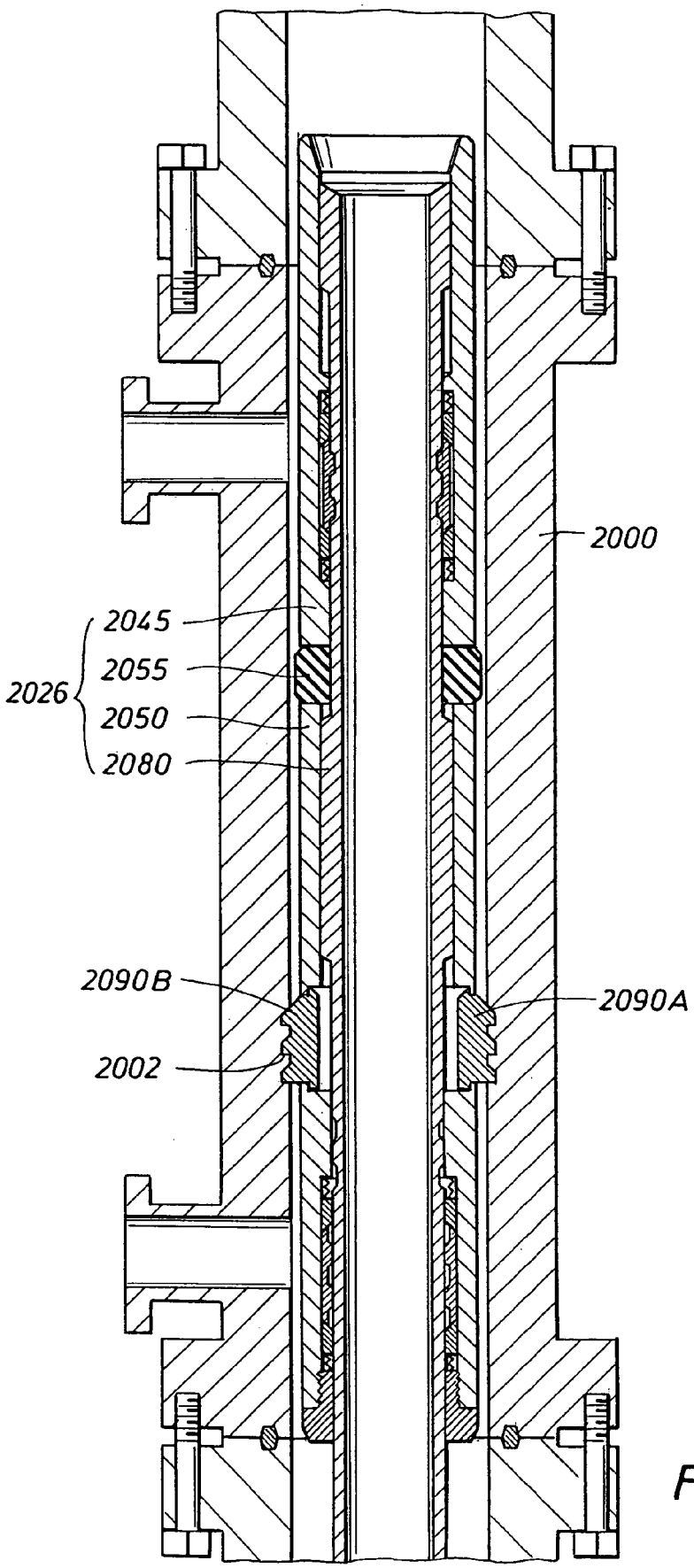
FIG. 30 is an elevation view of the upper section of the embodiment of FIGS. 29A-29B, with the holding member assembly engaged with the subsea housing.
Figure 31:
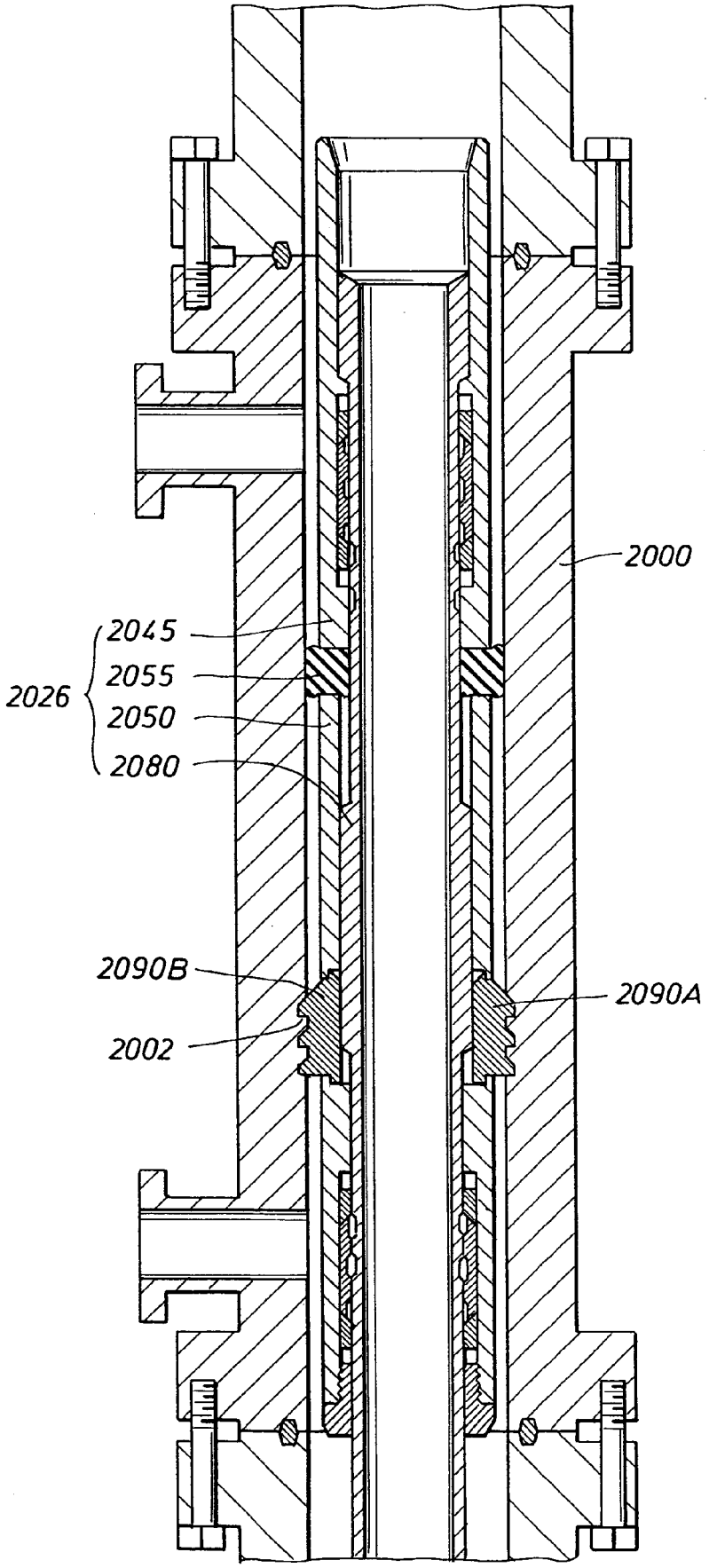
FIG. 31 is an elevation view of the upper section of the embodiment of FIGS. 29A-29B with the extendible member in a partially extended position.
Figure 32A:
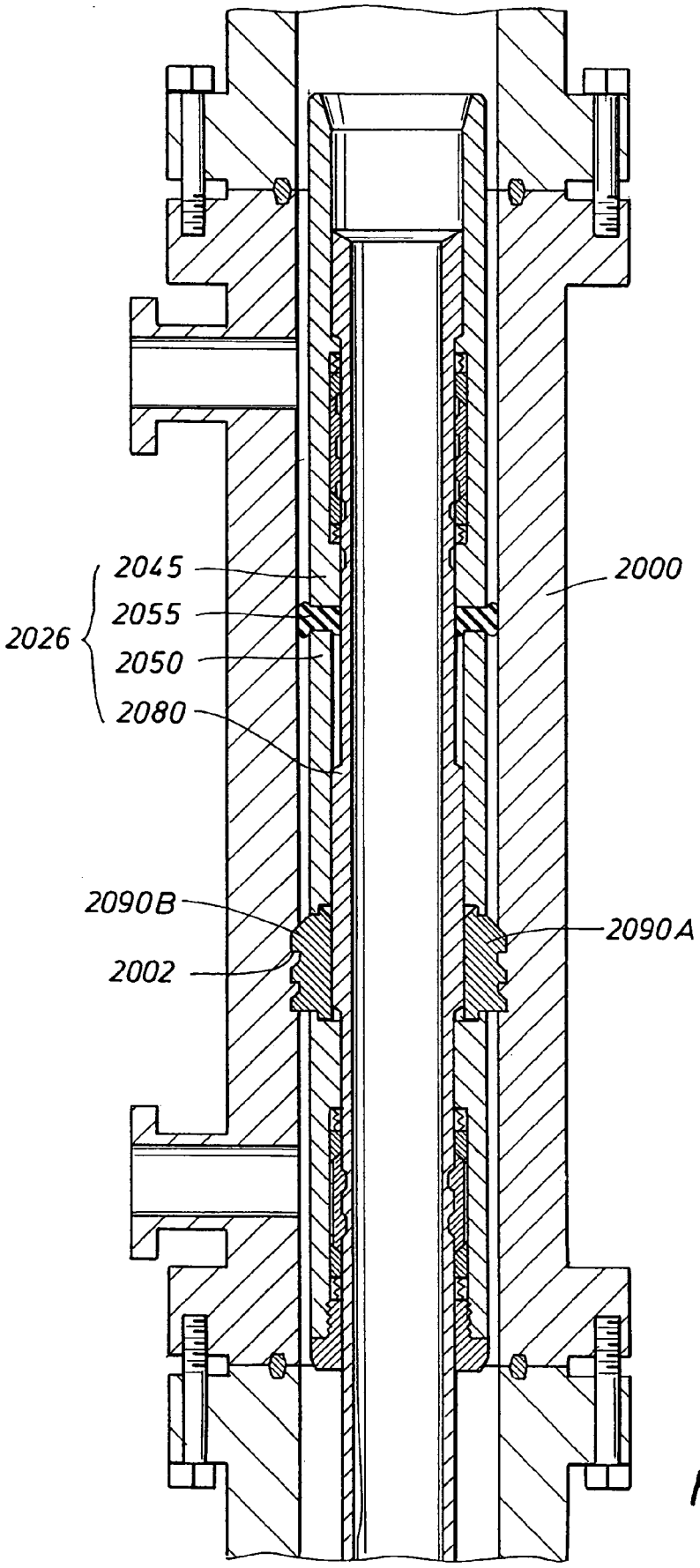
FIG. 32A is an elevation view of the upper section of the embodiment of FIGS. 29A-29B with the extendible member in a fully extended position.
Figure 32B:
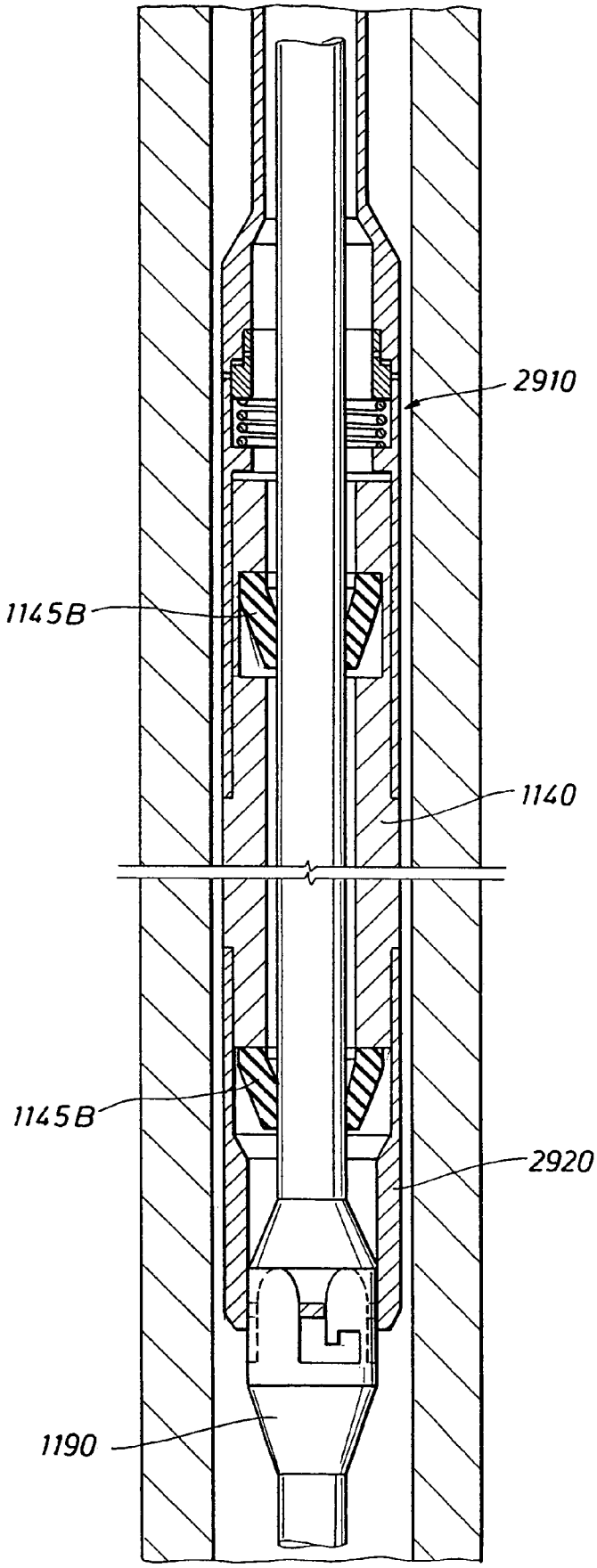
FIG. 32B is an elevation view of the lower section of the embodiment of FIGS. 29A-29B, with the running tool in a partially disengaged position.
Figure 33:
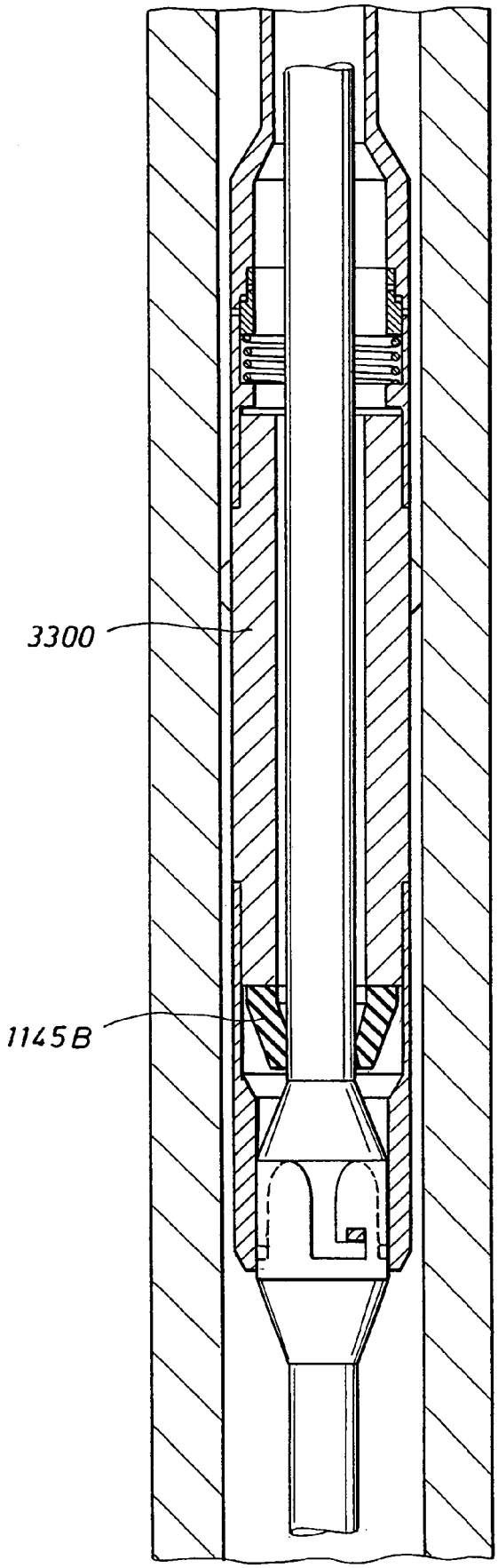
FIG. 33 is an elevation view of an embodiment of the lower section of FIG. 29B with only one stripper rubber.
Figure 34:
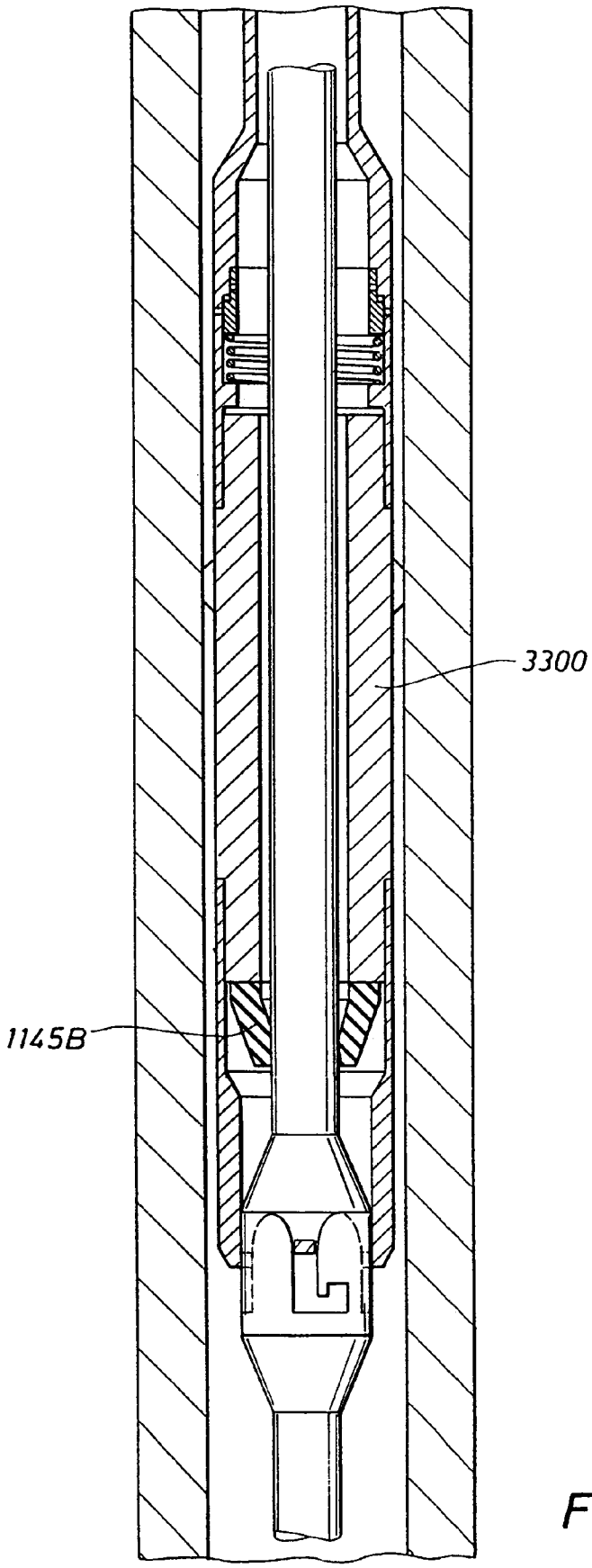
FIG. 34 is an elevation view of the embodiment of FIG. 33, with the running tool in a partially disengaged position.

Unlike the overslung configuration of FIGS. 20A-23B, however, the running tool 1190 in the underslung configuration of FIGS. 29A, 30, 31, and 32A latches to a latching section 2920 attached to the bottom of the bearing assembly 1140. The latching section 2920 uses the same latching technique described above with regard to the bell-shaped lower portion 1155 in FIG. 11, but as shown in FIGS. 29B, 32B, and 33-34, is a generally cylindrical section. FIGS. 29B and 33 show the running tool 1190 latched to the latching section 2920, while FIGS. 32B and 34 show the running tool 1190 extending downwardly after unlatching. Note that as shown in FIGS. 29B, 32B, 33, and 34, the running tool 1190 does not include the spreader members 1185 shown previously in FIGS. 11, 20A, 21 A, 22A, and 23A. However, one skilled in the art will recognize that the running tool 1190 can include the spreader members 1185 in an underslung configuration as shown in FIGS. 29B, 32B, 33, and 34.

FIGS. 29B, 32B, and 33-34 illustrate that the bearing assembly 1140 can be implemented using a unidirectional pressure relief mechanism 2910, which comprises the lower pressure relief mechanism of the bi-directional pressure relief mechanism shown in FIGS. 20A, 21A, 22A, 23A and 24, allowing pressure relief from excess downhole pressure, but using the ability of stripper rubbers 1145 to "burp" to allow relief from excess interior pressure.

FIGS. 33 and 34 illustrate a bearing assembly 3300 otherwise identical to bearing assembly 1140, that uses only a single lower stripper rubber 1145*b*, in contrast to the dual stripper rubber configuration of bearing assembly 1140 as shown in FIGS. 20A-23B. The use of two stripper rubbers

1145 is preferred to provide redundant sealing of the bearing assembly 3300 with the rotatable pipe of the drill string.

The foregoing disclosure and description of the invention are illustrative and explanatory thereof, and various changes in the details of the illustrated apparatus and construction and method of operation may be made without departing from the spirit of the invention.

We claim:

1. A system adapted for forming a borehole using a rotatable pipe and a fluid, the system comprising:

a subsea housing disposed above the borehole;

a bearing assembly positioned with the subsea housing, comprising:

an outer member, and an inner member rotatable relative to the outer member and having a passage through which the rotatable pipe may extend;

a bearing assembly seal to sealably engage the rotatable pipe with the bearing assembly; and a holding member for positioning the bearing assembly with the subsea housing.

2. The system of claim 1, further comprising:

a holding member assembly including the holding member, and a first seal disposed between the holding member assembly and the subsea housing.

3. The system of claim 2, wherein the first seal comprising:

an annular seal.

4. The system of claim 2, wherein the bearing assembly is removably positioned with the holding member assembly.

5. The system of claim 2, wherein the holding member is movable relative to the holding member assembly.

6. The system of claim 1, further comprising:

a stack positioned from an ocean floor, wherein the subsea housing is positioned above and in fluid communication with the stack.

7. The system of claim 1, wherein the first seal is movable between a sealed position and an unsealed position.

8. The system of claim 1, wherein the subsea housing is sealed with the bearing assembly by the first seal.

9. The system of claim 1, wherein the first seal is movable between a sealed position and an unsealed position, wherein the subsea housing is sealed with the bearing assembly when the first seal is in the sealed position.

10. The system of claim 1, whereby the holding member blocks movement of the bearing assembly relative to the subsea housing.

11. A system adapted for forming a borehole having a borehole fluid pressure, the system using a rotatable pipe and a fluid, the system comprising:

a subsea housing disposed above the borehole;

a bearing assembly removably positioned with the subsea housing, comprising:

an outer member; and an inner member rotatable relative to the outer member and having a passage through which the rotatable pipe may extend;

a bearing assembly seal to sealably engage the rotatable pipe;

a holding member for removably positioning the bearing assembly with the subsea housing; and a first seal, the bearing assembly sealed with the subsea housing by the first seal.

12. The system of claim 11, wherein the subsea housing comprising:

a passive latching formation.

13. The system of claim 11, wherein the bearing assembly is removably positioned with the holding member.

14. The system of claim 11, wherein the holding member comprising:

a shoulder.

15. The system of claim 11, wherein the first seal is removably positioned with the subsea housing.

16. The system of claim 11, wherein the first seal is movable between a sealed position and an unsealed position, wherein the subsea housing is sealed by the first seal when the first seal is in the sealed position, and wherein the holding member is removable from the subsea housing when the first seal is in the unsealed position.

17. A system adapted for forming a borehole in a floor of an ocean, the borehole having a borehole fluid pressure, the system using a fluid, the system comprising:

a lower tubular adapted to be fixed relative to the floor of the ocean;

a subsea housing disposed above the lower tubular;

a bearing assembly removably positioned with the subsea housing, comprising:

an outer member; and an inner member rotatable relative to the outer member and having a passage therethrough;

a bearing assembly seal disposed with the inner member;

an internal housing communicating with the bearing assembly, comprising:

a holding member extending from the internal housing for positioning with the subsea housing; and a first seal movable between a sealed position and an unsealed position, wherein the internal housing seals with the subsea housing when the first seal is in the sealed position, and wherein a pressure of the fluid below the first seal can be managed.

18. A method for controlling the pressure of a fluid in a borehole while sealing a rotatable pipe, comprising the steps of:

positioning a subsea housing above the borehole;

holding a bearing assembly within the subsea housing, the bearing assembly comprising:

an outer member; and an inner member rotatable relative to the outer member and having a passage through which the rotatable pipe may extend;

sealing the bearing assembly with the rotatable pipe; and sealing the subsea housing with the bearing assembly to control the pressure of the fluid in the borehole.

19. The method of claim 18, further comprising the step of:

rotating the rotatable pipe while managing the pressure of the fluid in the borehole.

20. The method of claim 18, further comprising the step of:

removably positioning the bearing assembly with an internal housing.

21. The method of claim 20, further comprising the step of:

sealing the subsea housing with the internal housing.

22. The method of claim 21, further comprising the step of:

moving a first seal from a retracted position to an extended sealed position for sealing the subsea housing with the internal housing.

23. A rotating control head system, comprising:

a first tubular;

an outer member removably positionable relative to the first tubular, an inner member disposed within the outer member, the inner member having a passage running therethrough and adapted to receive and sealingly engage a rotatable pipe;

bearings disposed between the outer member and the inner member to rotate the inner member relative to the outer member when the inner member is sealingly engaged with the rotatable pipe;

a subsea housing connectable to the first tubular; and a holding member for positioning the outer member with the subsea housing.

24. The rotating control head system of claim 23, wherein the holding member is movable between a retracted position and an engaged position.

25. The rotating control head system of claim 24, wherein the holding member engages the subsea housing when the holding member is in the engaged position.

26. The rotating control head system of claim 25, further comprising a running tool, wherein holding member is moved from the retracted position to the engaged position with the subsea housing by moving the running tool.

27. The rotating control head system of claim 26, wherein the running tool can retrieve the outer member when the holding member is in the retracted position.

28. The rotating control head system of claim 23, further comprising a first seal, wherein the first seal moves between an unsealed position and a sealed position, the outer member sealed with the subsea housing by the first seal when the first seal is in the sealed position; and wherein the holding member limits movement of the outer member when the first seal is in the sealed position.

29. The rotating control head system of claim 28, further comprising a second tubular, wherein the second tubular contains a second fluid having a second fluid pressure, wherein the first tubular contains a first fluid having a first fluid pressure, and wherein when the first seal is in the sealed position, the second fluid pressure can differ from the first fluid pressure.

30. The rotating control head system of claim 23, wherein the holding member comprising:

a plurality of angled shoulders.

31. A method of forming a borehole, comprising the steps of:

positioning a housing above the borehole;

moving a rotating control head relative to the housing;

extending a rotatable pipe through the rotating control head and into the borehole;

positioning the rotating control head relative to the housing;

sealing the rotating control head with the housing;

sealing an inner member of the rotating control head with the rotatable pipe, the inner member rotating with the rotatable pipe relative to an outer member of the rotating control head, providing a first fluid within the borehole, the first fluid having a first fluid pressure;

providing a second fluid within the housing, the second fluid having a second fluid pressure different from the first fluid pressure.

32. The method of claim 31, further comprising the step of:

limiting movement of the rotating control head when the rotating control head is sealed with the housing.

33. The method of claim 31, wherein the rotating control head is positioned above the housing.

34. The method of claim 31, wherein the rotating control head is positioned below the housing.

35. The method of claim 31, wherein the housing is a subsea housing, the method further comprising the step of:

forming the borehole while the inner member is sealed with the rotatable pipe and the subsea housing is sealed with the outer member.

36. A system adapted for forming a borehole using a rotatable pipe and a fluid, the system comprising:

a first housing having a bore running therethrough;

a bearing assembly disposed relative to the bore, the bearing assembly comprising:

an inner member adapted to slidingly receive and sealingly engage the rotatable pipe, wherein rotation of the rotatable pipe rotates the inner member; and an outer member for rotatably supporting the inner member;

a holding member for positioning the bearing assembly relative to the first housing; and a seal having an elastomer element for sealingly engaging the bearing assembly with the first housing.

37. An internal riser rotating control head system, the system comprising:

a housing having a bore running therethrough;

a bearing assembly disposed relative to the bore, the bearing assembly comprising:

an inner member adapted to slidingly receive the rotatable pipe, the inner member having a sealing element, wherein rotation of the rotatable pipe rotates the inner member; and an outer member for rotatably supporting the inner member, a holding member for positioning the bearing assembly relative to the housing; and a seal for sealing the bearing assembly with the housing.

38. A system for positioning a rotating control head, the system comprising:

a subsea housing having an internal formation;

a bearing assembly having a passage for receiving a rotatable pipe; and a holding member assembly connectable to the bearing assembly and the subsea housing, comprising:

an internal housing coupled to the bearing assembly; and a holding member coupled to the internal housing, the holding member engaging the internal formation to position the holding member assembly with the subsea housing.

39. The system of claim 38, the bearing assembly further comprising:

a plurality of guide members on the bearing assembly.

40. The system of claim 38, the holding member comprising:

a latching portion; and a plurality of openings.

41. The system of claim 40, the holding member assembly further comprising:

a pressure relief member for releasing pressure.

42. The system of claim 41, the pressure relief member comprising:

a valve engaging the plurality of openings in the holding member.

43. The system of claim 38, further comprising:

a running tool for moving the rotating control head assembly into the subsea housing, the subsea housing comprising:

a plurality of passive formations for engaging with the holding member assembly.

44. The system of claim 43, wherein the running tool is rotated in a first direction for drilling, and wherein the running tool is rotated in a second direction, rotationally opposite to the first direction, to disengage the running tool from the holding member assembly.

45. The system of claim 38, wherein the holding member is releasably positioned with the subsea housing.

46. The system of claim 38, the subsea housing further comprising:

a landing shoulder for blocking movement of the holding member assembly.

47. The system of claim 46, wherein the holding member assembly latches with the subsea housing when the holding member assembly engages the landing shoulder and is rotated.

48. The system of claim 47, further comprising:

a running tool for moving the rotating control head assembly into the subsea housing, wherein the running tool rotates in a first direction during drilling, and wherein the holding member assembly disengages with the subsea housing when the running tool is rotated in a second direction rotationally opposite to the first direction.

49. The system of claim 38, wherein the holding member assembly is threadedly connected to the bearing assembly.

50. The system of claim 38, the subsea housing having axially aligned openings, the subsea housing further comprising:

a first side opening; and a second side opening spaced apart from the first side opening.

51. The system of claim 50, wherein the subsea housing internal formation is between the first side opening and the second side opening.

52. The system of claim 50, wherein the holding member assembly is sealed with the subsea housing between the first side opening and the second side opening.

53. A rotating control head system, the system comprising:

a bearing assembly having a passage sized to receive a pipe; and a holding member assembly connected to the bearing assembly, comprising:

an internal housing, comprising:

a holding member chamber; and a holding member positioned within the holding member chamber, the holding member movable between a retracted position and an extended position; and an extendible portion concentrically interior to and slidably connectable to the internal housing.

54. The system of claim 53, wherein the holding member assembly is threadedly connected to the bearing assembly.

55. The system of claim 53, further comprising a subsea housing, wherein the holding member assembly is releasably positionable with the subsea housing.

56. The system of claim 55, further comprising a seal, and the subsea housing further comprising:

a first side opening; and a second side opening spaced apart from the first side opening, wherein the seal is disposed between the first side opening and the second side opening.

57. The system of claim 56, wherein the bearing assembly is disposed below the seal.

58. The system of claim 56, wherein the bearing assembly is disposed above the seal.

59. The system of claim 53, further comprising a subsea housing, wherein the bearing assembly is connected with the holding member assembly so that the bearing assembly is supported by the subsea housing.

60. The system of claim 59, wherein the holding member disengages from the subsea housing at a predetermined upward pressure on the holding member assembly.

61. The system of claim 59, further comprising:

a running tool for positioning the bearing assembly with the subsea housing, the running tool comprising:

a latching member for latching with the holding member assembly.

62. The system of claim 61, wherein the pipe is rotated in a first direction, and wherein the running tool disengages from the holding member assembly when the pipe is rotated in a direction rotationally opposite to the first direction.

63. The system of claim 53, the internal housing further comprising:

an upper annular portion;

a lower annular portion, movable relative to the upper annular portion; and an elastomer positioned between the upper annular portion and the lower annular portion.

64. The system of claim 63, wherein the holding member chamber is defined by the lower annular portion.

65. The system of claim 63, wherein extension of the extendible portion moves the upper annular portion toward the lower annular portion while the holding member moves to the extended position, thereby extruding the elastomer.

66. The system of claim 65, wherein the upper annular portion having a shoulder; and the extendible portion having a shoulder, the extendible portion shoulder engaging with the upper annular portion shoulder to move the upper annular portion toward the lower annular portion.

67. The system of claim 63, further comprising:

an upper dog member positioned with the upper annular portion; and an upper dog recess defined in the extendible portion, wherein upper dog member releasably engages with the upper dog recess.

68. The system of claim 67, wherein the upper dog member and the upper dog recess interengage the extendible portion with the upper annular portion.

69. The system of claim 67, wherein the upper dog member and the upper dog recess release the extendible portion from the upper annular portion at a predetermined force.

70. The system of claim 63, further comprising:

a lower dog member positioned with the lower annular portion; and a lower dog recess defined in the extendible portion, wherein the lower dog member releasably engages with the lower dog recess.

71. The system of claim 70, wherein the lower dog member and the lower dog recess interengage the extendible portion with the lower annular portion.

72. The system of claim 71, the lower annular portion further comprising:

an end portion connected to the lower annular portion.

73. The system of claim 63, the extendible portion further comprising:

a running tool bell landing portion.

74. The system of claim 53, wherein an outer surface of the extendible portion blocks the holding member radially outward.

75. The system of claim 53, wherein the holding member assembly further comprising:

a running tool bell landing portion; and the system further comprising a running tool, comprising:

a bell portion engageable with the running tool bell landing portion.

76. The system of claim 53, the bearing assembly further comprising:

a seal sealably engaging the pipe in the passage.

77. The system of claim 53, the bearing assembly further comprising:

a plurality of bearings; and a pressure compensation mechanism adapted to automatically provide fluid pressure to the plurality of bearings, comprising:

an upper chamber in fluid communication with the plurality of bearings;

a lower chamber in fluid communication with the plurality of bearings;

an upper spring-loaded piston forming one wall of the upper chamber; and a lower spring-loaded piston forming one wall of the lower chamber.

78. The system of claim 77, the pressure compensation mechanism further comprising:

an upper chamber fill pipe communicating with the upper spring-loaded piston.

79. The system of claim 53, the bearing assembly comprising:

a pressure relief mechanism.

80. The system of claim 79, the pressure relief mechanism comprising:

a first pressure relief mechanism having an open position and a closed position, the first pressure relief mechanism changing to the open position when a first fluid pressure inside the holding member assembly exceeds a second fluid pressure outside the holding member assembly.

81. The system of claim 80, the first pressure relief mechanism further comprising:

a slidable member having a passage therethrough for allowing fluid flow through the passage when in the open position, the open position aligning the slidable member passage with a passage through the holding member assembly; and a spring adapted to urge the slidable member to the closed position.

82. The system of claim 81, the pressure relief mechanism comprising:

a second annular slidable member moving between a closed position and an open position, the second slidable member sliding to the open position when a first fluid pressure outside the holding member assembly exceeds a second fluid pressure inside the slidable member assembly.

83. The system of claim 82, further comprising:

a spring adapted to urge the slidable member to the closed position, wherein the slidable member has a passage therethrough for allowing fluid flow through the passage when in the open position.

84. A method of controlling pressure in a subsea tubular, comprising the steps of:

positioning the subsea tubular above a borehole;

positioning a holding member assembly with the subsea tubular;

sealing the holding member assembly with the subsea tubular; and opening a pressure relief valve of the holding member assembly when a borehole pressure exceeds the fluid pressure within the subsea tubular by a predetermined pressure.

85. The method of claim 84, the step of positioning the holding member assembly comprising the step of:

reducing surging by allowing fluid passage through the holding member assembly while positioning the holding member assembly.

86. The method of claim 84, further comprising the step of:

engaging the holding member assembly with a formation on the subsea tubular.

87. The method of claim 86, the step of engaging comprising the step of:

rotating the holding member assembly into the formation in a first rotational direction.

88. The method of claim 87, further comprising the step of:

rotating the holding member assembly in a second rotational direction to unlatch the holding member assembly from the formation, the second rotational direction rotationally opposite to the first rotational direction.

89. A method of positioning a rotating control head with a subsea housing, comprising the steps of:

connecting a holding member assembly to the rotating control head;

forming an internal formation in the subsea housing;

retracting a holding member into an internal housing of the holding member assembly;

positioning the rotating control head with the subsea housing; and engaging the holding member assembly with the subsea housing by radially extending the holding member outwardly towards the internal formation.

90. The method of claim 89, the step of connecting a holding member assembly comprising the step of:

threading the holding member assembly with the rotating control head.

91. The method of claim 89, further comprising the steps of:

positioning an elastomer between an upper portion of the internal housing and a lower portion of the internal housing; and extruding the elastomer radially outwardly, sealing the holding member assembly with the subsea housing.

92. The method of claim 91, the step of extruding comprising the step of:

compressing the elastomer between the upper portion and lower portion.

93. The method of claim 91, further comprising the step of:

dogging the lower portion of the internal housing with an extendible portion when the extendible portion is in an extended position.

94. The method of claim 93, further comprising the steps of:

retracting the extendible portion;

undogging the lower portion of the internal housing from the extendible portion upon retracting; and decompressing the elastomer to unseal the holding member assembly from the subsea housing.

95. The method of claim 91, further comprising the steps of:

retracting an extendible portion;

unblocking the holding member; and disengaging the holding member from the internal formation.

96. The method of claim 89, further comprising the step of: blocking the holding member radially outwardly with an extendible portion when the extendible portion is in an extended position.

97. The method of claim 89, further comprising the step of:

disengaging the holding member when applying a predetermined force to the holding member.

98. The method of claim 89, further comprising the step of: configuring a pressure relief assembly with the holding member assembly.

99. The method of claim 98, the step of configuring comprising the steps of:

providing fluid communication via a first passage through the internal housing; and opening the first passage if fluid pressure exceeds a borehole pressure by a first predetermined pressure.

100. The method of claim 99, the step of configuring further comprising the steps of:

providing fluid communication via a second passage through the outer portion of the internal housing; and opening the second passage if borehole pressure exceeds fluid pressure by a predetermined amount.

101. A system for use in a rotating control head assembly having a bearing, the system comprising:

a pressure compensation mechanism adapted to automatically provide fluid pressure to the bearing, comprising:

a first chamber in fluid communication with the bearing;

a second chamber in fluid communication with the bearing;

a first biased barrier forming one wall of the first chamber and adapted to compress a fluid within the first chamber; and a second biased barrier forming one wall of the second chamber and adapted to compress the fluid within the second chamber.

102. The system of claim 101, the pressure compensation mechanism further comprising:

a first chamber fill pipe communicating with the first biased barrier, wherein a first end of the first chamber fill pipe is accessible through an opening in the side of the rotating control head assembly.

103. A system for positioning a rotating control head assembly within a subsea housing, the system comprising:

means for providing a bearing fluid pressure; and means integral with the rotating control head assembly for increasing the bearing fluid pressure by a predetermined amount above the higher of the subsea housing fluid pressure or the borehole pressure.

104. A subsea housing system, the system comprising:

a holding member connected to a rotating control head assembly, and an annular formation on the subsea housing for interengaging and direct contact with the holding member without regard to a rotational position of the holding member.

105. The system of claim 104, the annular formation comprising:

a plurality of recesses configured to cooperatively interengage with a plurality of protuberances of the holding member.

106. The system of claim 105, wherein the plurality of recesses are identical.

107. The system of claim 105, wherein the plurality of recesses are configured to allow the holding member assembly to disengage from the annular formation at a predetermined force.

108. A rotating control head system, the system comprising:

a bearing assembly having a passage sized to receive a rotatable pipe; and a bearing assembly seal sealably engaging the rotatable pipe in the passage;

a holding member assembly connected to the bearing assembly, comprising:

an internal housing, comprising:

a holding member.

109. The system of claim 108, wherein the holding member assembly is threadedly connected to the bearing assembly.

110. The system of claim 108, further comprising a subsea housing, wherein the holding member assembly is releasably positionable with the subsea housing.

111. The system of claim 110, the subsea housing comprising:

a first side opening; and a second side opening spaced apart from the first side opening, wherein an internal formation is disposed between the first side opening and the second side opening for receiving the holding member.

112. The system of claim 111, wherein the bearing assembly is disposed below the internal formation.

113. The system of claim 111, wherein the bearing assembly is disposed above the internal formation.

114. The system of claim 110, wherein the holding member disengages from the subsea housing at a predetermined upward pressure on the holding member assembly.

115. The system of claim 110, further comprising:

a running tool for positioning the bearing assembly with the subsea housing, and;

the running tool having a latching member for latching with the holding member assembly.

116. The system of claim 115, wherein the rotatable pipe is rotated in a first direction, and wherein the running tool disengages from the holding member assembly when the rotatable pipe is rotated in a direction rotationally opposite to the first direction.

117. The system of claim 108, further comprising a subsea housing, wherein the bearing assembly is connected with the holding member assembly so that the bearing assembly is connected with the subsea housing.

118. The system of claim 108, the bearing assembly comprising:

a pressure relief mechanism.

119. The system of claim 118, the pressure relief mechanism comprising:

a first pressure relief mechanism having an open position and a closed position, the first pressure relief mechanism changing to the open position when a first fluid pressure inside the holding member assembly exceeds a second fluid pressure outside the holding member assembly.

120. A rotating control head system adapted for use with a pipe, the system comprising:

a bearing assembly having a passage sized to receive the pipe;

a holding member assembly connected to the bearing assembly, the holding member assembly comprising:

an internal housing having a holding member; and a running tool bell landing portion; and a running tool having a bell portion engageable with the running tool bell landing portion.

121. A rotating control head system adapted for use with a pipe, the system comprising:

a bearing assembly having a passage sized to receive the pipe;

a holding member assembly connected to the bearing assembly, the holding member assembly comprising:

an internal housing having a holding member; and the bearing assembly further comprising:

a bearing; and a pressure compensation mechanism adapted to automatically provide fluid pressure to the bearing, comprising:

a first chamber in fluid communication with the bearing;

a second chamber in fluid communication with the bearing;

a first piston forming one wall of the first chamber; and a second piston forming one wall of the second chamber.

122. A system for forming a borehole using a rotatable pipe, the system comprising:

a first housing disposed above the borehole;

a bearing assembly having an inner member and an outer member and being positioned with said first housing, said inner member rotatable relative to said outer member and having a passage through which the rotatable pipe may extend;

a bearing assembly seal to sealably engage the rotatable pipe with said bearing assembly; and a holding member for positioning said bearing assembly with said first housing.

123. A system for forming a borehole using a rotatable pipe, the system comprising:

a first housing disposed above the borehole;

a bearing assembly having an inner member and an outer member and being removably positioned with said first housing, said inner member rotatable relative to said outer member and having a passage through which the rotatable pipe may extend;

a bearing assembly seal to sealably engage the rotatable pipe;

a holding member for removably positioning said bearing assembly with said first housing; and a first housing seal disposed in said first housing, said bearing assembly sealed with said first housing by said first housing seal.

124. A system for forming a borehole in a floor of an ocean, the system comprising:

a lower tubular adapted to be fixed relative to the floor of the ocean;

a first housing disposed above said lower tubular;

a bearing assembly having an inner member and an outer member and being removably positioned with said first housing, said inner member rotatable relative to said outer member and having a passage;

a bearing assembly seal disposed with said inner member;

an internal housing having a holding member, said internal housing receiving said bearing assembly, said holding member extending from said internal housing and into said first housing; and a first housing seal disposed in said first housing, said first housing seal movable between a sealed position and an open position, whereby said internal housing seals with said first housing seal when said first housing seal is in the sealed position.

125. A method for managing the pressure of a fluid in a borehole while sealing a rotatable pipe, comprising the steps of:

positioning a first housing above the borehole;

holding a bearing assembly having an inner member and an outer member with said first housing;

sealing said bearing assembly with the rotatable pipe; and sealing said first housing with said bearing assembly to manage the pressure of the fluid in the borehole while limiting upward movement of said bearing assembly relative to said first housing; and wherein said inner member is rotatable relative to said outer member, and wherein said inner member has a passage through which the rotatable pipe may extend.

126. A rotating control head system for use with a rotatable pipe, the system comprising:

an outer member;

an inner member disposed within said outer member, said inner member having a passage to receive and sealingly engage the rotatable pipe;

a plurality of bearings disposed between said outer member and said inner member to rotate said inner member relative to said outer member when the inner member is sealingly engaged with the rotatable pipe;

a first housing disposed above said borehole, said first housing having a seal for sealing with said outer member; and a holding member for limiting positioning of said outer member with said first housing.

127. A method for drilling a borehole, comprising the steps of:

positioning a first housing above the borehole;

positioning a rotating control head with said first housing;

extending a rotatable pipe through said rotating control head and into the borehole;

sealing said rotating control head with said first housing with a seal that limits upward movement of said rotating control head relative to said first housing; and sealing an inner member of said rotating control head to said rotatable pipe, said inner member rotating with said rotatable pipe relative to an outer member.

128. A system for forming borehole using a rotatable pipe and a fluid, the system comprising:

a first housing having a bore running therethrough;

a bearing assembly disposed with said bore, said bearing assembly comprising an inner member and an outer member for rotatably supporting said inner member, said inner member being adapted to slidingly receive and sealingly engage the rotatable pipe, wherein rotation of the rotatable pipe rotates said inner member within said bore;

a holding member for positioning said bearing assembly with said first housing; and a seal disposed in an annular cavity in said first housing, said seal having an elastomeric element for sealingly engaging said bearing assembly with said first housing.

129. A rotating control head system, the system comprising:

a housing having a bore running therethrough;

a bearing assembly disposed with said bore, said bearing assembly comprising an inner member and an outer member for rotatably supporting said inner member, said inner member being adapted to slidingly receive and sealingly engage the rotatable pipe, wherein rotation of the rotatable pipe rotates said inner member within said bore, the inner member having thereon a sealing element;

a holding member for positioning said bearing assembly with said first housing; and a seal disposed in said housing for securing said bearing assembly to said housing.

130. A system for use in a rotating control head assembly having a bearing, wherein the assembly is in fluid communication with an external fluid pressure, the system comprising:

a pressure compensation mechanism to provide a fluid pressure to the bearing relative to the external fluid pressure comprising:

a first chamber in fluid communication with the bearing;

a second chamber in fluid communication with the external fluid pressure; and a first barrier to separate the fluid pressure within the first chamber and the external fluid pressure wherein the first chamber and second chamber are integral with the rotating control head assembly.

131. The system of claim 130 wherein the first chamber having a hydraulic fluid.

132. The system of claim 130 wherein said second chamber including an urging member to urge said first barrier.

133. The system of claim 132 wherein said urging member providing a pressure to said first barrier in addition to the external fluid pressure.

134. The system of claim 133 wherein the urging member is a spring.

135. The system of claim 130 wherein the first chamber has a fluid pressure greater than the external fluid pressure independent of hydraulic connections with the rotating control head assembly.

136. The system of claim 135 wherein the fluid pressure to the bearing is greater than the external fluid pressure.

137. The system of claim 130 wherein said external fluid pressure is a borehole fluid pressure.

138. The system of claim 130 wherein said external fluid pressure is a seawater fluid pressure.

139. A method for maintaining a bearing fluid pressure on a bearing in a rotating control head assembly, comprising the steps of:

positioning the rotating control head assembly above a borehole having a borehole fluid pressure;

communicating the borehole fluid pressure to the rotating control head assembly;

communicating the bearing fluid pressure to the bearing;

separating the borehole fluid pressure from the bearing fluid pressure; and urging the bearing fluid pressure to a pressure different from the borehole fluid pressure wherein the urging member is integral with the rotating control head assembly.

140. The method of claim 139, wherein the step of urging the bearing fluid pressure comprises urging the bearing fluid pressure higher than the borehole fluid pressure.

141. The method of claim 140, wherein at least one of the steps of urging the bearing fluid pressure comprises a mechanical urging member.

142. The method of claim 140, wherein the step of urging the bearing fluid pressure comprises urging the bearing fluid pressure higher than the third fluid pressure.

143. The method of claim 140, wherein the steps of urging the bearing fluid pressure comprises urging the bearing fluid pressure higher than higher of the borehole fluid pressure or the third fluid pressure.

144. The method of claim 140, wherein the third fluid pressure is pressure from sea water.

145. The method of claim 139, further comprising the steps of:

communicating a third fluid pressure to the rotating control head assembly;

separating the third fluid pressure from the bearing fluid pressure; and urging the bearing fluid pressure to a pressure different from the third fluid pressure.

146. The method of claim 139, wherein the step of urging the bearing fluid pressure comprises an urging member integral with the rotating control head assembly.

147. The method of claim 146, wherein the integral urging member is independent of hydraulic connections with the rotating control head assembly.

148. A method for managing the pressure of a fluid in a borehole while sealing a rotatable pipe, comprising the steps of:

positioning a housing above the borehole;

positioning a tubular above the housing;

moving a plurality of bearings on an outer member of a rotating control device in the tubular, the outer member being adapted to receive an inner member having a passage through which the rotatable pipe may extend, the inner member adapted to rotate relative to the outer member;

holding the outer member to limit movement relative to the housing; and sealing the housing with the outer member with a seal movable between an open position and a sealed position.

149. The method of claim 148 further comprising the step of:

blocking movement of the outer member relative to the housing.

150. The method of claim 149 wherein the step of sealing the housing is performed after the step of blocking movement of the outer member.

151. The method of claim 148 further comprising the step of:

supporting the outer member on a tool as the outer member is moved in the tubular.

152. The method of claim 151 wherein the tool is a drill collar.

153. The method of claim 151 wherein the tool is a stabilizer.

154. The method of claim 151 wherein the tool having a bell portion and the outer member having a bell landing portion to engage the tool bell portion upon rotation of the tool.

155. The method of claim 148 wherein the step of sealing the housing comprises the step of:

moving an annular seal between a sealed position and an open position.

156. The method of claim 148 wherein the steps of holding the outer member and sealing the housing comprise the step of:

moving the seal from an open position to a sealed position.

157. The method of claim 156 further comprising an internal housing wherein the internal housing is attached to the outer member and the seal is sealed on the internal housing.

158. The method of claim 156 further comprising the step of:

moving a piston in the housing from a closed position to an open position to open an outlet in the housing while sealing the housing and holding the outer member.

159. The method of claim 148 wherein the tubular is a riser.

160. The method of claim 148 wherein the outer member is attached to an internal housing.

161. The method of claim 160 wherein the internal housing having a holding member.

162. The method of claim 148 further comprising the step of:

moving a piston in the housing from a closed position to an open position to open an outlet in the housing while sealing the housing.

163. A system for managing the pressure of a fluid in a borehole while sealing a rotatable pipe, comprising:

a housing positioned above the borehole;

a tubular positioned above the housing;

an outer member of a rotating control device sized to be moved in the tubular, the outer member adapted to receive an inner member having a passage through which the rotatable pipe may extend, the inner member adapted to rotate relative to the outer member;

a plurality of bearings on the outer member of the rotating control device;

a holding member to limit movement of the outer member relative to the housing; and a seal movable between an open position and a sealed position for sealing the housing with the outer member.

164. The system of claim 163 further comprising a blocking shoulder to block movement of the outer member relative to the housing.

165. The system of claim 164 wherein the seal moving from an open position to a sealed position after the outer member is blocked from movement relative to the housing.

166. The system of claim 163 further comprising a tool for moving the outer member in the tubular.

167. The system of claim 166 wherein the tool is a drill collar.

168. The system of claim 166 wherein the tool is a stabilizer.

169. The system of claim 166 wherein the tool having a bell portion and the outer member having a bell landing portion to engage the tool bell portion upon rotation of the tool.

170. The system of claim 163 wherein the seal for sealing the housing comprises an annular seal movable between a sealed position and an open position.

171. The system of claim 163 wherein the seal for sealing the housing comprises an annular seal movable from an open position to a sealed position.

172. The system of claim 163 further comprising an internal housing having the holding member and wherein the internal housing is attached to the outer member.

173. The system of claim 172 further comprising:

an outlet in the housing; and a piston movable in the housing from a closed position to an open position to open the outlet in the housing while sealing the housing with the internal housing.

174. The system of claim 163 wherein the tubular is a riser.

175. The system of claim 163 further comprising an internal housing wherein the outer member is attached to the internal housing.

176. The system of claim 175 wherein the internal housing having the holding member to limit movement.

177. The system of claim 163 further comprising:

an outlet in the housing; and a piston movable in the housing from a closed position to an open position to open the outlet in the housing while sealing the housing.

* * * * *